US008495770B2

(12) United States Patent
Koga et al.

(10) Patent No.: US 8,495,770 B2
(45) Date of Patent: Jul. 30, 2013

(54) NOZZLE DEVICE AND HYGIENIC WASHING DEVICE

(75) Inventors: Ryouichi Koga, Nara (JP); Tomio Arikawa, Yamatokoriyama (JP); Itaru Enguchi, Nara (JP); Yasuhiro Kawamoto, Sakai (JP)

(73) Assignee: Panasonic Corporation, Osaka (JP)

( * ) Notice: Subject to any disclaimer, the term of this patent is extended or adjusted under 35 U.S.C. 154(b) by 1249 days.

(21) Appl. No.: 10/554,624

(22) PCT Filed: Apr. 27, 2004

(86) PCT No.: PCT/JP2004/006066

§ 371 (c)(1),
(2), (4) Date: Oct. 27, 2005

(87) PCT Pub. No.: WO2004/097125

PCT Pub. Date: Nov. 11, 2004

(65) Prior Publication Data

US 2006/0207006 A1 Sep. 21, 2006

(30) Foreign Application Priority Data

| | | |
|---|---|---|
| Apr. 28, 2003 | (JP) | 2003-124454 |
| Apr. 28, 2003 | (JP) | 2003-124455 |
| Jul. 7, 2003 | (JP) | 2003-271508 |
| Jul. 7, 2003 | (JP) | 2003-271509 |
| Jul. 23, 2003 | (JP) | 2003-278231 |

(51) Int. Cl.
*E03D 9/00* (2006.01)

(52) U.S. Cl.
USPC ..... 4/420.4

(58) Field of Classification Search
USPC ..... 4/420.4, 443–448; 239/398, 419, 239/399
See application file for complete search history.

(56) References Cited

U.S. PATENT DOCUMENTS

| | | | | |
|---|---|---|---|---|
| 3,182,860 | A * | 5/1965 | Gallo, Sr. | 222/136 |
| 3,829,013 | A * | 8/1974 | Ratnik | 239/14.2 |
| 4,136,407 | A * | 1/1979 | Maurer | 4/448 |
| 4,597,111 | A | 7/1986 | Hirashiba et al. | |
| 4,704,748 | A | 11/1987 | Takeda et al. | |

(Continued)

FOREIGN PATENT DOCUMENTS

| | | |
|---|---|---|
| CA | 1288121 | 8/1991 |
| CN | 2220497 | 2/1996 |

(Continued)

OTHER PUBLICATIONS

English Language Abstract of JP11-193567.

(Continued)

*Primary Examiner* — Lori Baker
(74) *Attorney, Agent, or Firm* — Greenblum & Bernstein P.L.C.

(57) ABSTRACT

In a nozzle device a spray hole for spraying washing water and a pipe forming a first flow path that introduces the washing water to the spray hole is provided. Further, the spray hole is provided in a cover that surrounds the pipe. The cover is integrally formed of a cylindrical metal whose front end is closed. A space between an outer surface of the pipe and an inner peripheral surface of the cover member forming a second flow path that introduces the washing water to the spray hole. Further, the second flow path surrounds surface of the pipe in a circumferential direction of the cover member.

21 Claims, 55 Drawing Sheets

U.S. PATENT DOCUMENTS

| | | | | |
|---|---|---|---|---|
| 4,819,878 | A | 4/1989 | Bailey et al. | |
| 5,484,107 | A | 1/1996 | Holmes | |
| 5,813,060 | A * | 9/1998 | Klopocinski | 4/351 |
| 5,873,524 | A * | 2/1999 | Bodelin et al. | 239/8 |
| 5,970,528 | A | 10/1999 | Shirai et al. | |
| 6,161,778 | A * | 12/2000 | Haruch | 239/290 |
| 6,618,865 | B1 | 9/2003 | Kim | |
| 6,754,912 | B1 * | 6/2004 | Hayashi et al. | 4/420.2 |
| 2001/0030247 | A1 * | 10/2001 | Chung et al. | 239/398 |
| 2003/0140407 | A1 * | 7/2003 | Matsumoto et al. | 4/420.4 |
| 2005/0246828 | A1 | 11/2005 | Shirai et al. | |

FOREIGN PATENT DOCUMENTS

| | | | |
|---|---|---|---|
| DE | 4106992 | | 10/1991 |
| DE | 29724651 | | 8/2002 |
| FR | 2564503 | | 11/1985 |
| JP | 57-172048 | | 10/1982 |
| JP | 58-140278 | | 9/1983 |
| JP | 59-102033 | | 6/1984 |
| JP | 61-126239 | | 6/1986 |
| JP | 1-180573 | | 12/1989 |
| JP | 2-218457 | | 8/1990 |
| JP | 4-73078 | | 6/1992 |
| JP | 5-118075 | | 5/1993 |
| JP | 7-292746 | | 11/1995 |
| JP | 8-49277 | | 2/1996 |
| JP | 8-49279 | | 2/1996 |
| JP | 8-284236 | | 10/1996 |
| JP | 8-326126 | | 12/1996 |
| JP | 10-090078 | | 4/1998 |
| JP | 10-90078 | | 4/1998 |
| JP | 11-193567 | | 7/1999 |
| JP | 2995932 | | 10/1999 |
| JP | 2000-96679 | | 4/2000 |
| JP | 2000-096679 | | 4/2000 |
| JP | 2000-240131 | A | 9/2000 |
| JP | 2000-333884 | | 12/2000 |
| JP | 2001-90154 | | 4/2001 |
| JP | 2001-90155 | | 4/2001 |
| JP | 2001-132055 | | 5/2001 |
| JP | 2001-348904 | | 12/2001 |
| JP | 2001-348940 | | 12/2001 |
| JP | 2001-355272 | | 12/2001 |
| JP | 3292185 | | 3/2002 |
| JP | 2002-102809 | | 4/2002 |
| JP | 2002-213004 | | 7/2002 |
| JP | 2002-275996 | | 9/2002 |
| JP | 2002-285619 | | 10/2002 |
| JP | 2003-13481 | | 1/2003 |
| JP | 2003-119869 | | 4/2003 |
| JP | 2003-193537 | | 7/2003 |
| WO | 97/03255 | | 1/1997 |
| WO | 98/49402 | | 11/1998 |

OTHER PUBLICATIONS

English Language Abstract of JP2003-13481.
English Language Abstract of JP2001-90155.
English Language Abstract of JP3292185.
English Language Abstract of JP2003-119869.
English Language Abstract of 2001-348940.
English Language Abstract of JP10-90078.
English Language Abstract of JP2000-96079.
English Language Abstract of JP2000-333884.
English Language Abstract of JP5-33378.
English Language Abstract of JP2001-355272.
English Language Abstract of JP2002-275996.
English Language Abstract of JP2001-132055.
English Language Abstract of JP8-49279.
English Language Abstract of JP7-292746.
English Language Abstract of JP8-284236.
English Language Abstract of JP8-326126.
English Language Abstract of JP8-49277.
English language Abstract of JP 2002-102809, Apr. 9, 2002.
English language Abstract of JP 2001-90154, Apr. 3, 2001.
English language Abstract of JP 5-118075, May 14, 1993.
English language Abstract of JP 2002-285619, Oct. 3, 2002.
English language Partial Translation of 2003-119869.
English language Partial Translation of 57-172048.
English language Partial Translation of 1-180573.
English language Partial Translation of 2000-96679.
English language Abstract and partial translation of JP 2000-240131 A, Sep. 5, 2000.
English language partial translation of JP 2003-119869 A, Apr. 23, 2003.
English language translation of paragraphs [0012], [0046] and Fig. 4, 7, 9-11 of JP 2003-119869.
Search report from E.P.O., mail date is Nov. 19, 2010.
First page of related patent publication (Chinese), mail date is Nov. 10, 2010.
A partial English language translation of JP 2003-193537.
English machine translation of JP 2000-333884.
English machine translation of JP 2003-119869.
English machine translation of JP 10-090078.
English machine translation of JP 2000-096679.
English machine translation of JP 2001-348940.

* cited by examiner

NOZZLE DEVICE AND HYGIENIC WASHING DEVICE

TECHNICAL FIELD

The present invention relates to a sanitary washing apparatus that washes the private parts of the human body.

BACKGROUND ART

In sanitary washing apparatuses that wash the private parts of the human bodies, washing water is sprayed from nozzles projecting to positions of washing from the positions where nozzle devices are accommodated to do washing.

In such nozzle devices, front ends of nozzles approach the private parts of the human bodies at the time of washing operations so that the washing water is sprayed. In this case, dirt may, in some cases, adhere to the nozzles in the case of washing. Therefore, various types of functions for cleaning the nozzles have been proposed.

Examples of the functions of cleaning the nozzles include cleaning a nozzle cleaning nozzle (see JP-A-11-193567, for example). In this case, dirt that has adhered to a nozzle itself can be cleaned by causing washing water to flow through the nozzle before or after a washing operation of the private parts of the human body. Consequently, a user can wash his or her private parts using washing water sprayed from the clean nozzle.

However, the dirt that has adhered to a step, a groove, a clearance, and so forth on a surface of the nozzle is not easily cleaned.

When the whole nozzle is covered with a cover in order to eliminate the step, the groove, the clearance, and so forth on the surface of the nozzle, the nozzle is made large in size. In order to make a sanitary washing apparatus compact, it is desired that the nozzle device is miniaturized.

As another example of the functions of cleaning the nozzles, a sanitary washing apparatus in which a cleaning chamber is provided at a front end of a nozzle to spray washing water has been proposed (see JP-A-2003-13481).

In the sanitary washing apparatus having the cleaning chamber, the washing water sprayed into the cleaning chamber is rebounded on an inner wall of the cleaning chamber, thereby washing the front end of the nozzle. In this case, the washing water is only sprayed to the front end of the nozzle, so that only local washing is done.

On the other hand, in sanitary washing apparatuses that wash the private parts of the human bodies, various functions have been devised in order to realize washing conforming to the tastes of users. For example, the function of adjusting the spray form of washing water sprayed from a nozzle is provided in order to realize washing conforming to the taste of a user (see JP-A-2001-90155, for example).

According to the foregoing document, a user adjusts the spray form of the washing water sprayed from the nozzle in conformity with his or her taste.

A nozzle device disclosed in the foregoing document has a swirling application chamber communicating with a water discharge hole, an eccentric pipe, and an axis-directed pipe. The eccentric pipe eccentrically communicates with the swirling application chamber, to cause washing water to flow into the swirling application chamber. In this case, the washing water that has flown into the swirling application chamber is sprayed as spiral flow from the water discharge hole. Further, the axis-directed pipe communicates with the swirling application chamber with its axis directed thereto, to cause the washing water to flow into the swirling application chamber. In this case, the washing water that has flown into the swirling application chamber is sprayed from the water discharge hole without application of a swirling force.

It is possible to vary the degree of the swirling force and perform wide-narrow setting of a washing range by adjusting the ratio of the flow rate of the washing water supplied to the eccentric pipe and the flow rate of the washing water supplied to the axis-directed pipe.

In the above-mentioned conventional nozzle device, however, the washing water sprayed from the water discharge hole encounters high flow resistance in the swirling application chamber from the axis-directed pipe through the swirling application chamber, thereby causing a pressure loss. Therefore, the velocity of flow of the washing water sprayed from the water discharge hole is reduced. In the above-mentioned sanitary washing apparatus, the density at the center of the washing water sprayed in a spiral shape (a cone shape) from the nozzle is lower than that in the vicinity of the outer periphery thereof. Therefore, parts of the private parts of the human body may not be sufficiently washed.

Users generally desire a strong washing feeling due to linear flow and a soft washing feeling due to widened spiral flow. Therefore, sanitary washing apparatuses capable of efficiently spraying linear flow having a high velocity of flow as well as capable of washing the private parts of the human bodies throughout have been desired. In order to realize compactness of the sanitary washing apparatuses, miniaturization of the nozzle devices has been desired.

DISCLOSURE OF INVENTION

An object of the present invention is to provide a nozzle device that easily cleans dirt that has adhered, efficiently sprays washing water, has high reliability, and can be miniaturized, and a sanitary washing apparatus comprising the same.

Another object of the present invention is to provide a nozzle device capable of sufficiently ensuring a sanitary state of a human body washing nozzle in a simple configuration, and a sanitary washing apparatus comprising the same.

Still another object of the present invention is to provide a sanitary washing apparatus capable of selecting the spray form of washing water in conformity with the taste, physical conditions, or the like of a user and capable of sufficiently washing a wide range of the private parts of the human body.

A nozzle device according to an aspect of the present invention comprises a spray hole for spraying washing water; a pipe forming a first flow path that introduces the washing water to the spray hole; and a cover member having the spray hole, provided so as to surround the pipe, and integrally formed of a cylindrical metal whose front end is closed, a space between the pipe and the cover member forming a second flow path that introduces the washing water to the spray hole.

In the nozzle device, the pipe is covered with the cover member integrally formed of the cylindrical metal whose front end is closed. Consequently, dirt does not easily adhere to a surface of a nozzle. Even if dirt adheres to the surface of the nozzle, the dirt can be easily cleaned.

The cover member is formed of the metal, so that a surface of the cover member has a gloss. Consequently, a user feels clean. Further, the cover member is formed of the metal, so that the pressure of the washing water is not absorbed by the cover member. Therefore, the washing water can be efficiently sprayed.

Furthermore, the pipe forms the first flow path, and the space between the pipe and the cover member forms the second flow path. Such a double-pipe structure of the cover member and the pipe allows the first and second flow paths to be formed within the cover member having a small diameter. Consequently, the nozzle device can be miniaturized.

The nozzle device may further comprise a spray member having an orifice and merging the washing water supplied from the first flow path and the washing water supplied from the second flow path to introduce the merged washing water into the orifice.

In this case, the washing water supplied from the first flow path and the washing water supplied from the second flow path are merged in the spray member, and the merged washing water is sprayed from the orifice. Consequently, the spray form of the washing water can be changed by adjusting the ratio of the respective amounts of the washing water from the first flow path and the washing water from the second flow path. Both the first flow path and the second flow path are accommodated within the cover member, and fluid pressure is held by the cover member. Further, the difference in pressure between the first flow path and the second flow path is small, and airtightness is not required because the fluid pressure is held in the cover member.

The spray member may form a spray space (i.e., internal space) having an opening at its one end and having the orifice at the other end, the first flow path may introduce the washing water to the spray space from the opening, the second flow path may introduce the washing water to the spray space from its peripheral surface, and the spray space may have a cross-sectional area that gradually or continuously decreases from the opening to the hole.

In this case, the washing water is supplied from the opening of the spray space by the first flow path. The cross-sectional area of the spray space gradually or continuously decreases from the opening to the orifice, so that the washing water supplied from the opening is sprayed from the orifice by gradually or continuously increasing the velocity of flow. In this case, the washing water flows into the orifice from the opening having a large cross-sectional area in the spray space, and encounters resistance from only an inner peripheral surface of the spray space, so that it has a small pressure loss. Consequently, linear flow having a high velocity of flow is efficiently sprayed from the orifice.

The washing water is supplied from the peripheral surface of the spray space by the second flow path. Therefore, the washing water flows along the inner peripheral surface of the spray space, so that it is given a swirling force and is sprayed as spiral flow while spreading from the orifice. In this case, the washing water does not encounter resistance from the opening, while encountering resistance from only the inner peripheral surface, so that it has a small pressure loss. Consequently, spiral flow is efficiently sprayed from the orifice.

Furthermore, the spray space has a configuration having a small pressure loss, so that the cross-sectional area of the flow path need not be increased in order to reduce the pressure loss. Consequently, the nozzle device can be miniaturized.

The spray space may include a first space having a first inner diameter from the opening to the orifice, a second space having a second inner diameter smaller than the first inner diameter, and a third space having a third inner diameter smaller than the second inner diameter, and the washing water introduced from the second flow path may be supplied to the second space.

In this case, the washing water does not encounter resistance from the opening of the second space, while encountering resistance from only the inner peripheral surface, so that it has a small pressure loss. Consequently, spiral flow is efficiently sprayed from the orifice.

The second space may be a cylindrical space, and the washing water introduced from the second flow path may be supplied along an inner peripheral surface of the cylindrical space.

In this case, the washing water supplied to the second space from the second flow path efficiently generates spiral flow. Consequently, the washing water sprayed from the orifice has a divergent angle, and a user can obtain a soft washing feeling.

The axis of the second flow path may be directed inward from a peripheral wall of the cylindrical space such that the washing water is discharged toward the outermost periphery of a swirl having no vorticity within the cylindrical space from the second flow path.

In this case, the washing water supplied to the cylindrical space from the second flow path does not disarrange the speed distribution of spiral flow flowing in the cylindrical space. Consequently, the washing water within the cylindrical space can be efficiently swirled.

The first space may have an inner diameter that continuously decreases from the opening to the second space. In this case, the washing water flowing in the first space is sprayed from the orifice by continuously increasing the velocity of flow thereof. A flow path loss in the first space is reduced, so that the pressure loss of the washing water is reduced. Consequently, water power in a case where the washing water is sprayed from the orifice is increased, which is efficient.

The third space may have an inner diameter that continuously decreases from the second space to the orifice. In this case, the washing water flowing in the third space is sprayed from the orifice by continuously increasing the velocity of flow thereof. A flow path loss in the third space is reduced, so that the pressure loss of the washing water is reduced. Consequently, water power in a case where the washing water is sprayed from the orifice is increased, which is efficient.

The inner diameter of the cylindrical space may be two times to five times the inner diameter of the orifice. In this case, the velocity of flow of the washing water sprayed from the orifice can be increased while reducing the flow path loss.

The cross-sectional area of the first flow path may be larger than the cross-sectional area of the opening of the spray space. In this case, the pressure loss of the washing water flowing in the first flow path is reduced. Consequently, the washing water can be maintained at a high pressure until it flows into the opening of the spray space.

The spray hole may be formed on a peripheral wall in the vicinity of a front end of the cover member, and the spray member may be inserted into the front end of the cover member. In this case, the washing water sprayed from the spray member is sprayed from the spray hole in the vicinity of the front end of the cover member.

The front end of the cover member may have a substantially hemispherical shape. In this case, dirt does not easily adhere to a front end of the nozzle. Further, the dirt that has adhered is easily washed away. Consequently, the nozzle device is kept clean.

The metal may be stainless. In this case, the growth of bacteria that have adhered to the cover member can be restrained by the antibacterial properties of stainless.

The cover member may be formed by drawing forming. In this case, a surface of the cover member is not rough, so that dirt does not easily adhere thereto. Further, the surface of the cover member has a gloss, so that a user feels clean.

A part of the peripheral wall in the vicinity of the front end of the cover member may be formed so as to have a flat surface, and the spray hole may be formed on the flat surface. In this case, the position in the circumferential direction of the spray member is fixed by the flat surface. Consequently, the washing water sprayed from the orifice does not strike the spray hole, not to prevent the washing water from being sprayed.

The spray hole may have a larger inner diameter than the orifice. In this case, the washing water sprayed from the hole does not strike the spray hole, not to prevent the washing water from being sprayed.

The spray member may have a positioner abutting against an inner surface at the front end of the cover member such that the orifice is positioned relative to the spray hole. In this case, the positioner abuts against the inner surface at the front end of the cover member, so that the position in a back-and-forth direction of the spray member is fixed. Consequently, the washing water sprayed from the orifice does not strike the spray hole, not to prevent the washing water from being sprayed.

The positioner may comprise a first flat portion formed in the cover member, and a second flat portion formed in the spray member, and the pipe may be inserted into the cover member such that the second flat portion in the spray member is opposite to the first flat portion in the cover member.

In this case, an inner surface of the flat portion formed in the cover member and the second flat portion formed in the spray member are opposed to each other, so that the spray member is positioned in the circumferential direction within the cover member. Consequently, the orifice is prevented from being shifted from the spray hole. As a result, the washing water can be prevented from being scattered by the shift in position of the orifice from the spray hole.

Furthermore, the orifice is automatically positioned relative to the spray hole by only inserting the pipe into the cover member, so that positioning work becomes easy.

The nozzle device may further comprise an annular sealing member for watertightly sealing an area between the spray member around the hole and the cover member around the spray hole.

In this case, the washing water in the first flow path does not flow out of the spray hole through a clearance between the spray member and the cover member. Even if dirt adheres to the front end of the nozzle device, the dirt does not directly enter the first flow path from the spray hole through the clearance between the spray member and the cover member. Further, even when the dirt that has entered from the spray hole enters the orifice, the dirt is immediately discharged by the washing water sprayed from the orifice. Consequently, the inside of the nozzle device can be always kept clean.

The positioner may comprise a front end abutment portion provided at a front end of the spray member and abutting against the inner surface at the front end of the cover member.

In this case, the front end abutment portion abuts against the inner surface at the front end of the cover member, so that the spray member is positioned in the axial direction within the cover member. Consequently, the orifice is prevented from being shifted from the spray hole. As a result, the washing water can be prevented from being scattered by the shift in position of the orifice from the spray hole.

The positioner may comprise a peripheral surface abutment portion provided in the spray member and abutting against an inner peripheral surface of the cover member.

In this case, the peripheral surface abutment portion provided in the spray member abuts against the inner surface of the cover member, so that the spray member is positioned in the circumferential direction within the cover member. Consequently, the orifice is prevented from being shifted from the spray hole. As a result, the washing water can be prevented from being scattered by the shift in position of the orifice from the spray hole.

The positioner may comprise an engagement portion provided at a rear end of the cover member, and a portion to be engaged, provided at a rear end of the pipe, with which the engagement portion is engaged.

In this case, the portion to be engaged provided at the rear end of the pipe and the engagement portion provided at the rear end of the cover member are engaged with each other, so that the spray member is reliably positioned in the circumferential direction within the cover member. Consequently, the orifice is prevented from being shifted from the spray hole. As a result, the washing water can be prevented from being scattered by the shift in position of the orifice from the spray hole.

A sanitary washing apparatus according to another aspect of the present invention is a sanitary washing apparatus that sprays washing water supplied from a water supply source to the human body, comprising pressure means for pressurizing the washing water supplied from the water supply source; a nozzle device; and path selection means for selectively supplying the washing water pressurized by the pressure means to one or both of the first flow path and the second flow path in the nozzle device, the nozzle device comprising a spray hole for spraying washing water, a pipe forming the first flow path that introduces the washing water to the spray hole, and a cover member having a spray hole, provided so as to surround the pipe, and integrally formed of a cylindrical metal whose front end is closed, a space between the pipe and the cover member forming the second flow path that introduces the washing water to the spray hole.

In the sanitary washing apparatus, the washing water pressurized by the pressure means is supplied to the path selection means, and the washing water supplied to the path selection means is selectively supplied to one or both of the first flow path and the second flow path by the path selection means.

In the nozzle device, the pipe is covered with the cover member integrally formed of the cylindrical metal whose front end is closed. Consequently, dirt does not easily adhere to the surface of the nozzle. Even if dirt adheres to the surface of the nozzle, the dirt can be easily cleaned.

Furthermore, the space between the pipe and the cover member is used as the flow path of the washing water, so that a new flow path need not be provided, thereby allowing the nozzle device to be miniaturized. As a result, the sanitary washing apparatus can be miniaturized.

The path selection means may comprise flow rate adjustment means for adjusting the ratio of the respective flow rates of the washing water supplied to the first flow path and the washing water supplied to the second flow path.

In this case, the ratio of the respective flow rates of the washing water flowing in the first flow path and the washing water flowing in the second flow path can be adjusted by the flow rate adjustment means. Consequently, the divergent angle of the washing water sprayed from the spray hole can be adjusted.

The sanitary washing apparatus may further comprise heating means for heating the washing water supplied from the water supply source to supply the heated washing water to the pressure means, and the heating means may be an instantaneous heating device that heats the washing water supplied from the water supply source while causing the washing water to flow.

In this case, the washing water is heated while being caused to flow by the instantaneous heating device. Consequently, the washing water is heated only when the sanitary washing apparatus is employed, thereby making it possible to keep power consumption to a minimum.

A nozzle device according to still another aspect of the present invention comprises a cylindrical human body washing nozzle having a spray hole for spraying washing water to the private parts of the human body; and a nozzle cleaning member having an inner peripheral surface in a substantially cylindrical shape surrounding an outer peripheral surface of the human body washing nozzle, the human body washing nozzle being provided so as to be storable in the nozzle cleaning member and projectable from the nozzle cleaning member, the nozzle cleaning member having a washing water introduction hole for introducing the washing water into an annular space between the outer peripheral surface of the human body washing nozzle and the inner peripheral surface of the nozzle cleaning member to spirally swirl the introduced washing water.

In the nozzle device, the washing water is sprayed to the private parts of the human body by the human body washing nozzle. Further, the washing water is introduced into the annular space between the outer peripheral surface of the human body washing nozzle and the inner peripheral surface of the nozzle cleaning member from the washing water introduction hole in the nozzle cleaning member, and is spirally swirled in the annular space. Consequently, a wide range on the outer peripheral surface of the human body washing nozzle is effectively cleaned. Consequently, the sanitary state of the human body washing nozzle can be sufficiently ensured.

The human body washing nozzle is cleaned by introducing the washing water into the annular space between the outer peripheral surface of the human body washing nozzle and the inner peripheral surface of the nozzle cleaning member, so that the configuration is simple.

The human body washing nozzle may comprise a cylinder having a cylindrical inner peripheral surface, and a cylindrical piston that can be accommodated within the cylinder and can project from the cylinder and has a spray hole at its front end, the nozzle cleaning member may be provided so as to surround the vicinity of the front end of the piston in a state where the piston is accommodated within the cylinder, and the piston may be mounted on the cylinder so as to be swingable within the nozzle cleaning member.

In this case, in the human body washing nozzle, the cylindrical piston is accommodated in the cylinder having the cylindrical inner peripheral surface and projects from the cylinder. Consequently, space saving is realized.

When the piston is accommodated in the cylinder, the vicinity of the front end of the piston is surrounded by the nozzle cleaning member, and the front end is slidable within the nozzle cleaning member.

When the washing water is introduced into the annular space between the outer peripheral surface of the human body washing nozzle and the inner peripheral surface of the nozzle cleaning member from the washing water introduction hole, the front end of the piston is sufficiently cleaned by the washing water that is spirally swirled while the piston is sliding within the cylinder. Consequently, dirt that adheres to the vicinity of the front end of the piston is more effectively cleaned.

The piston may comprise a pipe forming a first flow path that introduces the washing water to the spray hole, a cylindrical cover member having the spray hole, provided so as to surround the pipe, and closed at its front end, a second flow path that introduces the washing water to the spray hole being formed between the cover member and the pipe, and a spray member, provided at a front end of the pipe and having an orifice, for merging the washing water supplied from the first flow path and the washing water supplied from the second flow path to introduce the merged washing water into the orifice.

In this case, the washing water is introduced into the spray hole by the pipe forming the first flow path, the washing water is introduced into the spray hole by the cylindrical cover member forming the second flow path between the cover member and the pipe, and the washing water supplied from the first flow path and the washing water supplied from the second flow path are merged by the spray member provided at the front end of the pipe and having the orifice so that the merged washing water is introduced into the orifice.

Such a double-pipe structure of the cover member and the pipe allows the first and second flow paths to be formed within the cover member having a small diameter. Consequently, the nozzle device can be miniaturized.

The washing water introduction hole may be provided such that the washing water introduced into the nozzle cleaning member can be sprayed in a direction substantially tangential to an outer peripheral surface of the human body washing nozzle.

In this case, the washing water introduced into the nozzle cleaning member through the washing water introduction hole is sprayed in a direction substantially tangential to the outer peripheral surface of the human body washing nozzle. Consequently, the washing water is efficiently swirled around the outer peripheral surface of the human body washing nozzle without reducing the velocity of flow at the time of the spray.

A front end of the human body washing nozzle may project from the nozzle cleaning member when the human body washing nozzle is stored. In this case, the washing water introduced into the nozzle cleaning member flows outward along the front end of the human body washing nozzle by a Coanda effect, thereby preventing the washing water that flows out from being scattered upward from the human body washing nozzle. Here, the Coanda effect means the nature of a fluid attempting to flow, when an object is placed in flow, along the object.

A sanitary washing apparatus according to a further aspect of the present invention is a sanitary washing apparatus that sprays washing water supplied from a water supply source to the human body, further comprising a nozzle device; first washing water supply means for supplying washing water to the human body washing nozzle in the nozzle device; second washing water supply means for supplying washing water to the washing water introduction hole of the nozzle device; and a heating device that instantaneously heats the washing water supplied from the water supply source, the washing water heated by the heating device being vapor, the nozzle device comprising a cylindrical human body washing nozzle having a spray hole for spraying washing water to the private parts of the human body, and a nozzle cleaning member having an inner peripheral surface in a substantially cylindrical shape surrounding an outer peripheral surface of the human body washing nozzle, the human body washing nozzle being provided so as to be storable in the nozzle cleaning member and projectable from the nozzle cleaning member, the nozzle cleaning member having a washing water introduction hole for introducing washing water into an annular space between the outer peripheral surface of the human body washing nozzle and the inner peripheral surface of the nozzle cleaning member to spirally swirl the introduced washing water.

In the sanitary washing apparatus, the washing water is supplied to the human body washing nozzle in the nozzle device by the first washing water supply means, and the washing water is supplied to the washing water introduction hole of the nozzle device by the second washing water supply means. In the nozzle device, the washing water is sprayed to the private parts of the human body by the human body washing nozzle. Further, the washing water is introduced into the annular space between the outer peripheral surface of the human body washing nozzle and the inner peripheral surface of the nozzle cleaning member from the washing water introduction hole in the nozzle cleaning member, and is spirally swirled in the annular space. Consequently, a wide range on the outer peripheral surface of the human body washing nozzle is effectively cleaned. Consequently, the sanitary state of the human body washing nozzle can be sufficiently ensured.

The human body washing nozzle is cleaned by introducing the washing water into the annular space between the outer peripheral surface of the human body washing nozzle and the inner peripheral surface of the nozzle cleaning member, so that the configuration is simple.

The washing water supplied from the water supply source is instantaneously heated by the heating device, and the washing water heated by the heating device is supplied to the washing water introduction hole by the second washing water supply means. Consequently, the human body washing nozzle is cleaned by the high-temperature washing water, so that a high washing effect is obtained. The human body washing nozzle can be subjected to bacteria reduction, elimination, or killing depending on the heated state of the washing water. The cleaning of the human body washing nozzle using the high-temperature washing water allows a user to obtain such a feeling of safety that the human body washing nozzle is always kept clean by subjecting the human body washing nozzle to bacteria reduction, elimination or killing.

Furthermore, the washing water heated by the heating device is vapor, thereby making it possible to obtain a superior washing effect and sterilizing effect.

The sanitary washing apparatus may further comprise a toilet seat, a human body detection sensor that detects the presence or absence of the human body on the toilet seat, and a controller that controls the supply of the washing water to the washing water introduction hole by the second washing water supply means on the basis of an output of the human body detection sensor, and the controller may not supply the washing water heated by the heating device to the washing water introduction hole when the human body detection sensor detects the human body.

In this case, the human body detection sensor detects the presence or absence of the human body on the toilet seat, and the controller controls the supply of the washing water to the washing water introduction hole by the second washing water supply means on the basis of an output of the human body detection sensor. When the human body detection sensor detects the human body, the washing water heated by the heating device is not supplied to the washing water introduction hole. Consequently, a user is prevented from toughing the washing water heated by the heating device in a state where the user sits on the toilet seat.

The sanitary washing apparatus may further comprise a branched pipe that can discharge a part or all of the washing water supplied from the water supply source outward, and the second washing water supply means may supply at least a part of the washing water flowing in the branched pipe to the washing water introduction hole.

In this case, the branched pipe discharges a part or all of the washing water supplied from the water supply source outward, and the second washing water supply means supplies at least a part of the washing water flowing in the branched pipe to the washing water introduction hole.

Consequently, the flow rate of the washing water used for cleaning the human body washing nozzle can be increased, thereby allowing nozzle cleaning having a higher cleaning effect to be done.

A sanitary washing apparatus according to a still further aspect of the present invention comprises a nozzle device having a spray hole for spraying washing water supplied from a water supply source to the human body; divergent angle adjustment means for changing the divergent angle of the washing water sprayed from the spray hole of the nozzle device; advancing or retreating driving means for moving the nozzle device so as to advance or retreat between a forward position and a backward position; and control means for controlling the advancing or retreating driving means and the divergent angle adjustment means such that the advancing or retreating movement of the nozzle device by the advancing or retreating driving means and the change in the divergent angle of the washing water from the spray hole of the nozzle device are combined with each other.

In the sanitary washing apparatus, the divergent angle adjustment means changes the divergent angle of the washing water sprayed from the spray hole of the nozzle device. Consequently, linear flow having a concentrated washing range and dispersed flow having a wide washing range are generated. The nozzle device moves so as to advance or retreat between the forward position and the backward position by the advancing or retreating driving means. Further, the control means controls the advancing or retreating movement of the nozzle device by the advancing or retreating driving means and the change in the divergent angle of the washing water sprayed from the spray hole of the nozzle device. Consequently, the user can select a combination of the advancing or retreating movement of the nozzle device by the advancing or retreating driving means and the change in the divergent angle of the washing water sprayed from the spray hole of the nozzle device depending on the taste, physical conditions, or the like of the user. This allows the user to do suitable washing.

The advancing or retreating movement of the nozzle device by the advancing or retreating driving means and the change in the divergent angle of the washing water sprayed from the spray hole of the nozzle device are combined with each other so that the private parts of the human body are washed, thereby allowing a wide range of the private parts of the human body to be sufficiently washed.

The control means may control the advancing or retreating driving means and the divergent angle adjustment means such that the divergent angle of the washing water from the spray hole of the nozzle device is changed while the nozzle device repeats the advancing or retreating movement between the forward position and the backward position.

In this case, a range in which the density of washing water is high is also formed by linear flow at the center of a washing range in which the density of washing water is low. Thus, a wide range of the private parts of the human body can be sufficiently washed. Further, the washing water scattered to the vicinity of the private parts of the human body by the linear flow having water power can be washed away by dispersed flow. Therefore, the private parts of the human body are kept cleaner.

The control means may control the advancing or retreating driving means and the divergent angle adjustment means such that the washing water from the spray hole of the nozzle device is alternately switched to dispersed flow and linear flow while the nozzle device repeats the advancing or retreating movement between the forward position and the backward position.

In this case, a range in which the density of washing water is high is also formed by linear flow at the center of a washing range in which the density of washing water is low. Thus, a wide range of the private parts of the human body can be sufficiently washed. Further, the washing water scattered to the vicinity of the private parts of the human body by the linear flow having water power can be washed away by dispersed flow. Therefore, the private parts of the human body are kept cleaner.

The control means may control the advancing or retreating driving means and the divergent angle adjustment means such that the divergent angle of the washing water from the spray hole of the nozzle device is changed while the nozzle device is moving from the forward position to the backward position or from the backward position to the forward position.

In this case, a range in which the density of washing water is high is also formed by linear flow at the center of a washing range in which the density of washing water is low. Thus, a wide range of the private parts of the human body can be sufficiently washed. Further, the washing water scattered to the vicinity of the private parts of the human body by the linear flow having water power can be washed away by dispersed flow. Therefore, the private parts of the human body are kept cleaner.

The control means may control the advancing or retreating driving means and the divergent angle adjustment means such that the washing water from the spray hole of the nozzle device is switched to linear flow and dispersed flow while the nozzle device is moving from the forward position to the backward position or from the backward position to the forward position.

In this case, a range in which the density of washing water is high is also formed by linear flow at the center of a washing range in which the density of washing water is low. Thus, a wide range of the private parts of the human body can be sufficiently washed. Further, the washing water scattered to the vicinity of the private parts of the human body by the linear flow having water power can be washed away by dispersed flow. Therefore, the private parts of the human body are kept cleaner.

The control means may control the advancing or retreating driving means and the divergent angle adjustment means such that the divergent angle of the washing water from the spray hole of the nozzle device is changed in a state where the nozzle device is stopped for a predetermined time period at the forward position or the backward position.

In this case, a range in which the density of washing water is high is also formed by linear flow at the center of a washing range in which the density of washing water is low. Thus, a wide range of the private parts of the human body can be sufficiently washed. Further, the washing water scattered to the vicinity of the private parts of the human body by the linear flow having water power can be washed away by the dispersed flow. Therefore, the private parts of the human body are kept cleaner.

The control means may control the advancing or retreating driving means and the divergent angle adjustment means such that the washing water from the spray hole of the nozzle device is alternately switched to dispersed flow and linear flow in a state where the nozzle device is stopped at the forward position or the backward position.

In this case, a range in which the density of washing water is high is also formed by linear flow at the center of a washing range in which the density of washing water is low. Thus, a wide range of the private parts of the human body can be sufficiently washed. Further, the washing water scattered to the vicinity of the private parts of the human body by the linear flow having water power can be washed away by dispersed flow. Therefore, the private parts of the human body are kept cleaner.

The sanitary washing apparatus may further comprise setting means for setting a combination of the advancing or retreating movement of the nozzle device by the advancing or retreating driving means and the change in the divergent angle of the washing water from the spray hole of the nozzle device.

In this case, a user can set a washing method suitable for the taste or physical conditions of the user by the setting means.

The nozzle device may comprise a first flow path that introduces the washing water from the water supply source to the spray hole, a second flow path that introduces the washing water from the water supply source to the spray hole, and rotating flow generation means for generating rotating flow in the washing water in the first flow path, and the divergent angle adjustment means may comprise flow rate adjustment means for adjusting the respective flow rates of the washing water supplied to the first flow path and the washing water supplied to the second flow path.

In this case, the washing water can be sprayed from the spray hole through the first flow path and the second flow path in the nozzle device. Since the first flow path and the second flow path are separately formed, the respective flow rates of the washing water flowing in the first flow path and the washing water flowing in the second flow path can be independently changed. Further, rotating flow of the washing water can be generated in the first flow path, thereby allowing the dispersed flow to be sprayed from the spray hole Consequently, either one of the linear flow and the dispersed flow or mixed flow of the linear flow and the dispersed flow can be sprayed depending on the taste or physical conditions of a user by adjusting the respective flow rates of the washing water flowing in the first flow path and the second flow path. Consequently, the divergent angle and the washing area of the washing water can be changed.

The rotating flow generation means may have a cylindrical chamber, and the washing water in the first flow path may be supplied along an inner peripheral surface of the cylindrical chamber.

In this case, the washing water introduced from the first flow path is supplied along the inner peripheral surface of the cylindrical chamber, so that flow in a swirling state by a centrifugal force can be efficiently produced within the cylindrical chamber. The washing water in which the flow in the swirling state is maintained is sprayed from the spray hole, so that the dispersed flow from the spray hole is sprayed in a wide range to the surface to be washed.

The sanitary washing apparatus may further comprise pressure means for pressurizing the washing water while subjecting the washing water supplied from the water supply source to periodical pressure fluctuations, to supply the pressurized washing water to the nozzle device.

In this case, the washing water supplied from the water supply source is pressurized while being subjected to periodical pressure fluctuations by the pressure means. Consequently, a washing stimulatory effect is increased even at a low flow rate.

The sanitary washing apparatus may further comprise heating means for heating the washing water supplied from the water supply source to supply the heated washing water to the pressure means.

In this case, the washing water supplied from the water supply source can be heated by the heating means and supplied to the pressure means, so that the washing water suitably heated can be sprayed by the spray hole of the nozzle device.

The heating means may be an instantaneous heating device that heats the washing water supplied from the water supply source while causing the washing water to flow.

In this case, the washing water is heated while being caused to flow by the instantaneous heating device. Consequently, the washing water is heated only when the sanitary washing apparatus is employed, thereby making it possible to keep power consumption to a minimum. Further, the necessity of a water storage tank or the like storing washing water is eliminated, thereby realizing space saving. Further, even when a washing time period is lengthened, the temperature of the washing water is not lowered.

BEST MODE FOR CARRYING OUT THE INVENTION

Figure 1:
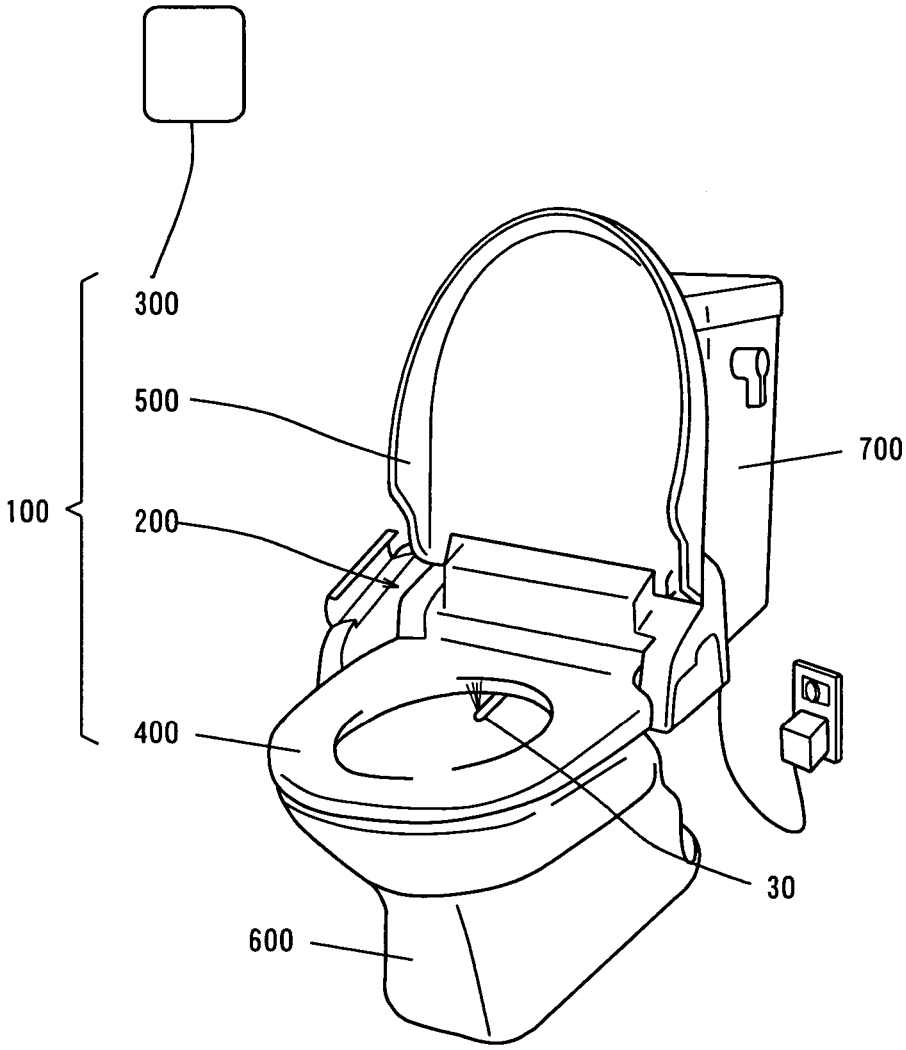
FIG. 1 is a perspective view showing a state where a sanitary washing apparatus according to a first embodiment of the present invention is mounted on a toilet bowl.

Embodiments of the present invention will be described while referring to the drawings.

(1) First Embodiment

FIG. 1 is a perspective view showing a state where a sanitary washing apparatus according to a first embodiment of the present invention is mounted on a toilet bowl.

As shown in FIG. 1, a sanitary washing apparatus 100 is mounted on a toilet bowl 600. A tank 700 is connected to a tap water pipe, and supplies washing water to the toilet bowl 600.

The sanitary washing apparatus 100 comprises a main body 200, a remote control device 300, a toilet seat 400, and a cover 500.

The toilet seat 400 and the cover 500 are attached to the main body 200 so as to be capable of being opened or closed. Further, the main body 200 is provided with a washing water supply mechanism including a nozzle unit 30, and contains a controller. The controller in the main body 200 controls the washing water supply mechanism on the basis of a signal transmitted by the remote control device 300, as described later. The controller in the main body 200 also controls a heater contained in the toilet seat 400, and a deodorizing device (not shown) and a hot air supply device (not shown), for example, provided in the main body 200.

Figure 2:
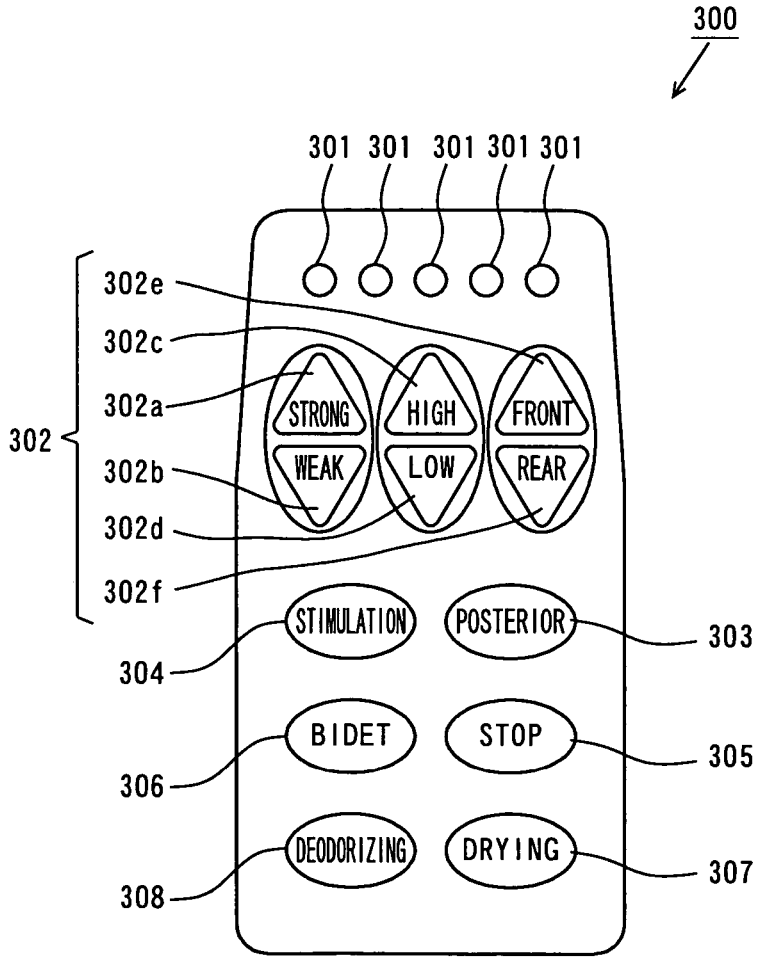
FIG. 2 is a schematic view showing an example of a remote control device shown in FIG. 1.

FIG. 2 is a schematic view showing an example of the remote control device 300 shown in FIG. 1.

As shown in FIG. 2, the remote control device 300 comprises a plurality of LEDs (Light Emitting Diodes) 301, a plurality of adjustment switches 302, a posterior switch 303, a stimulation switch 304, a stop switch 305, a bidet switch 306, a drying switch 307, and a deodorizing switch 308.

The adjustment switch 302, the posterior switch 303, the stimulation switch 304, the stop switch 305, the bidet switch 306, the drying switch 307, and the deodorizing switch 308 are pressed by a user. Consequently, the remote control device 300 transmits by radio a predetermined signal to the controller provided in the main body 200 in the sanitary washing apparatus 100, described later. The controller in the main body 200 receives the predetermined signal transmitted by radio from the remote control device 300, and controls the washing water supply mechanism or the like.

The user presses the posterior switch 303 or the bidet switch 306, for example, whereby the nozzle unit 30 in the main body 200 shown in FIG. 1 moves so that washing water is sprayed. The stimulation switch 304 is pressed, whereby washing water for stimulating the private parts of the human body is sprayed from the nozzle unit 30 in the main body 200 shown in FIG. 1. The stop switch 305 is pressed, whereby the spray of the washing water from the nozzle unit 30 is stopped.

The drying switch 307 is pressed, whereby warm air is blown by a warm air supply device (not shown) in the sanitary washing apparatus 100 on the private parts of the human body. The deodorizing switch 308 is pressed, whereby a deodorizing device (not shown) in the sanitary washing apparatus 100 removes an odor from its surroundings.

The adjustment switch 302 comprises water power adjustment switches 302*a* and 302*b*, temperature adjustment switches 302*c* and 302*d*, and nozzle position adjustment switches 302*e* and 302*f*.

The user presses the nozzle position adjustment switch 302*e* or 302*f*, whereby the position of the nozzle unit 30 in the main body 200 in the sanitary washing apparatus 100 shown in FIG. 1 is changed. The temperature adjustment switch 302*c* or 302*d* is pressed, whereby the temperature of the washing water sprayed from the nozzle unit 30 is changed. Further, the water power adjustment switch 302*a* or 302*b* is pressed, whereby the water power (pressure) of the washing water sprayed from the nozzle unit 30 and the spray form are changed. The plurality of LEDs (Light Emitting Diodes) 301 light up as the adjustment switch 302 is pressed.

The main body 200 in the sanitary washing apparatus 100 according to the first embodiment of the present invention will be described.

Figure 3:
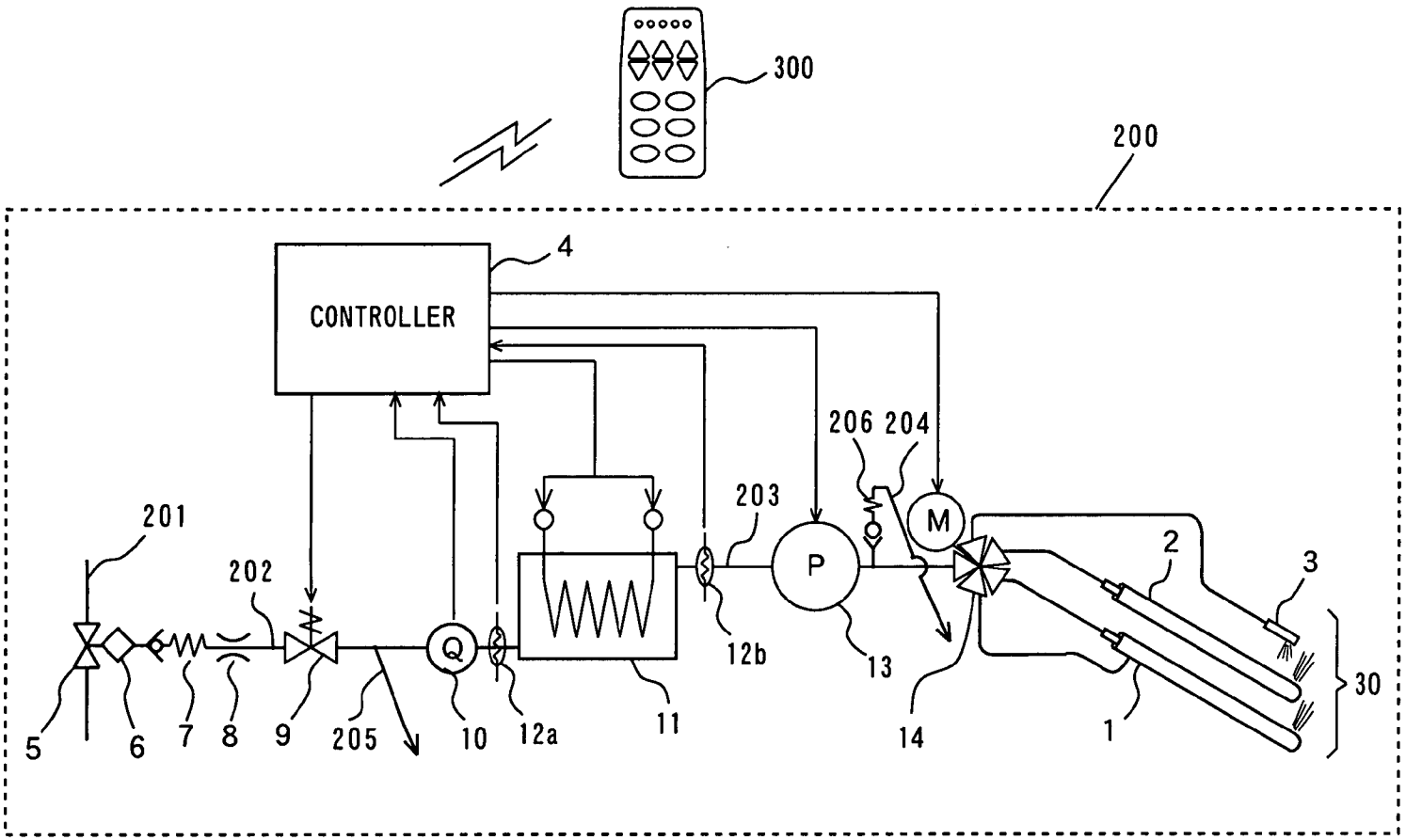
FIG. 3 is a schematic view showing the configuration of a main body in the sanitary washing apparatus according to the first embodiment of the present invention.

FIG. 3 is a schematic view showing the configuration of the main body 200 in the sanitary washing apparatus 100 according to the first embodiment of the present invention.

The main body 200 shown in FIG. 3 comprises a controller 4, a branched water faucet 5, a strainer 6, a check valve 7, a constant flow valve 8, a stop solenoid valve 9, a flow sensor 10, a heat exchanger 11, temperature sensors 12*a* and 12*b*, a pump 13, a switching valve 14, and a nozzle unit 30. Further, the nozzle unit 30 comprises a posterior nozzle 1, a bidet nozzle 2, and a nozzle cleaning nozzle 3. The switching valve 14 comprises a motor M.

As shown in FIG. 3, the branched water faucet 5 is inserted into a tap water pipe 201. The strainer 6, the check valve 7, the constant flow valve 8, the stop solenoid valve 9, the flow sensor 10, and the temperature sensor 12*a* are inserted in this order into a pipe 202 connected between the branched water faucet 5 and the heat exchanger 11. Further, the temperature sensor 12*b* and the pump 13 are inserted into a pipe 203 connected between the heat exchanger 11 and the switching valve 14.

Clear water flowing through the tap water pipe 201 is first supplied as washing water to the strainer 6 by the branched water faucet 5. The strainer 6 removes dirt, impurities, etc. included in the washing water. The check valve 7 then prevents the washing water in the pipe 202 from flowing backward. The constant flow valve 8 keeps the flow rate of the washing water flowing in the pipe 202 constant.

A relief pipe 204 is connected between the pump 13 and the switching valve 14, and a relief water pipe 205 is connected between the stop solenoid valve 9 and the flow sensor 10. A relief valve 206 is inserted into the relief pipe 204. The relief valve 206 is opened when the pressure, particularly on the downstream side of the pump 13, in the pipe 203 exceeds a predetermined value, thereby preventing problems such as damage to equipment at the abnormal time and the disconnection of a hose. On the other hand, the washing water which is not sucked by the pump 13 in the washing water which is supplied after the flow rate thereof is adjusted by the constant flow valve 8 is discharged from the relief water pipe 205. Consequently, a predetermined back pressure is exerted on the pump 13 without being dependent on water supply pressure.

The flow sensor 10 then measures the flow rate of the washing water flowing in the pipe 202, to give a measured flow rate value to the controller 4. The temperature sensor 12*a* measures the temperature of the washing water flowing in the pipe 202, to give a measured temperature value to the controller 4.

The heat exchanger 11 then heats the washing water supplied through the pipe 202 to a predetermined temperature on the basis of a control signal fed by the controller 4. The temperature sensor 12*b* measures the temperature of the washing water heated to the predetermined temperature by the heat exchanger 11, to give a measured temperature value to the controller 4.

The pump 13 feeds by pressure the washing water heated by the heat exchanger 11 to the switching valve 14 on the basis of the control signal fed by the controller 4. The switching valve 14 supplies the washing water to any one of the posterior nozzle 1, the bidet nozzle 2, and the nozzle cleaning nozzle 3 in the nozzle unit 30 on the basis of the control signal fed by the controller 4. Consequently, the washing water is sprayed from any one of the posterior nozzle 1, the bidet nozzle 2, and the nozzle cleaning nozzle 3. Further, the switching valve 14 adjusts the flow rate of the washing water sprayed from the nozzle unit 30 on the basis of the control signal fed by the controller 4. Consequently, the flow rate of the washing water sprayed from the nozzle unit 30 is changed.

The controller 4 feeds the control signal to the stop solenoid valve 9, the heat exchanger 11, the pump 13, and the switching valve 14 on the basis of the signal transmitted by radio from the remote control device 300 shown in FIG. 1, the measured flow rate value given from the flow sensor 10, and the measured temperature value given from the temperature sensors 12*a* and 12*b*.

Figure 4:
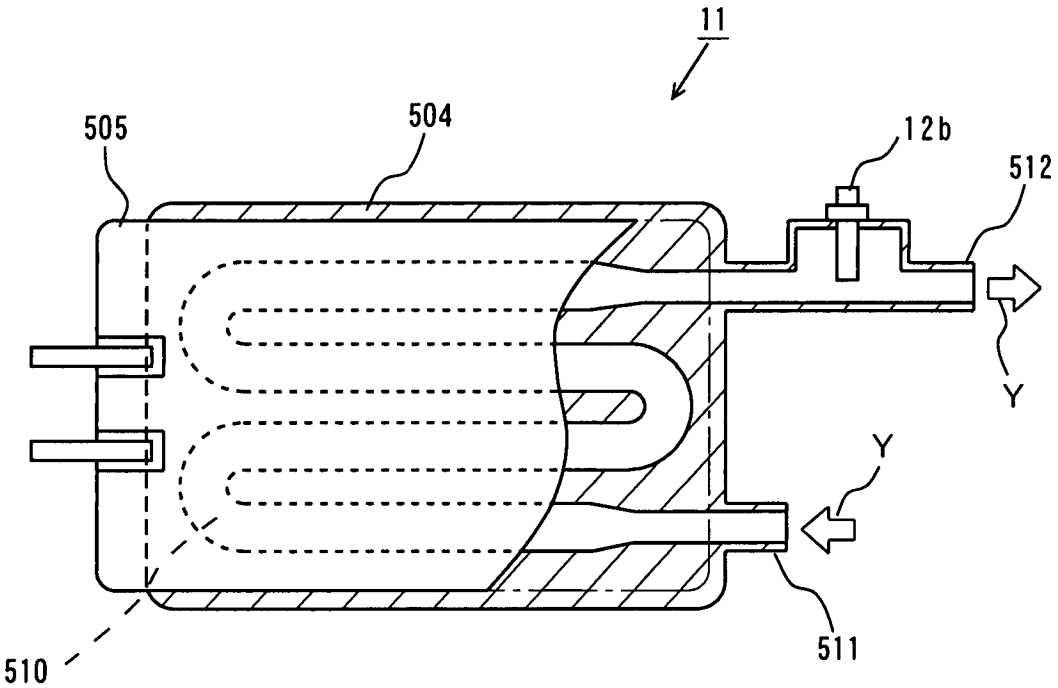
FIG. 4 is a partially cutaway sectional view showing an example of the configuration of a heat exchanger.

FIG. 4 is a partially cutaway sectional view showing an example of the configuration of the heat exchanger 11.

As shown in FIG. 4, a bent snaked pipe 510 is embedded in a resin case 504. A flat plate-shaped ceramic heater 505 is provided so as to be brought into contact with the snaked pipe 510. The washing water is supplied to the snaked pipe 510 from a water supply port 511, is heated more efficiently by the ceramic heater 505 while flowing in the snaked pipe 510, and is discharged from a discharge port 512, as indicated by an arrow Y.

The controller 4 shown in FIG. 3 controls the temperature of the ceramic heater 505 in the heat exchanger 11 by feedback control on the basis of the measured temperature value given from the temperature sensor 12*b*.

Although in the first embodiment, the controller 4 controls the temperature of the ceramic heater 505 in the heat exchanger 11 by feedback control, the present invention is not limited to the same. For example, the temperature of the ceramic heater 505 may be controlled by feed forward control. Alternatively, complex control for controlling the ceramic heater 505 by feed forward control when the temperature rises, while controlling the ceramic heater 505 by feedback control at the steady time may be carried out.

Figure 5:
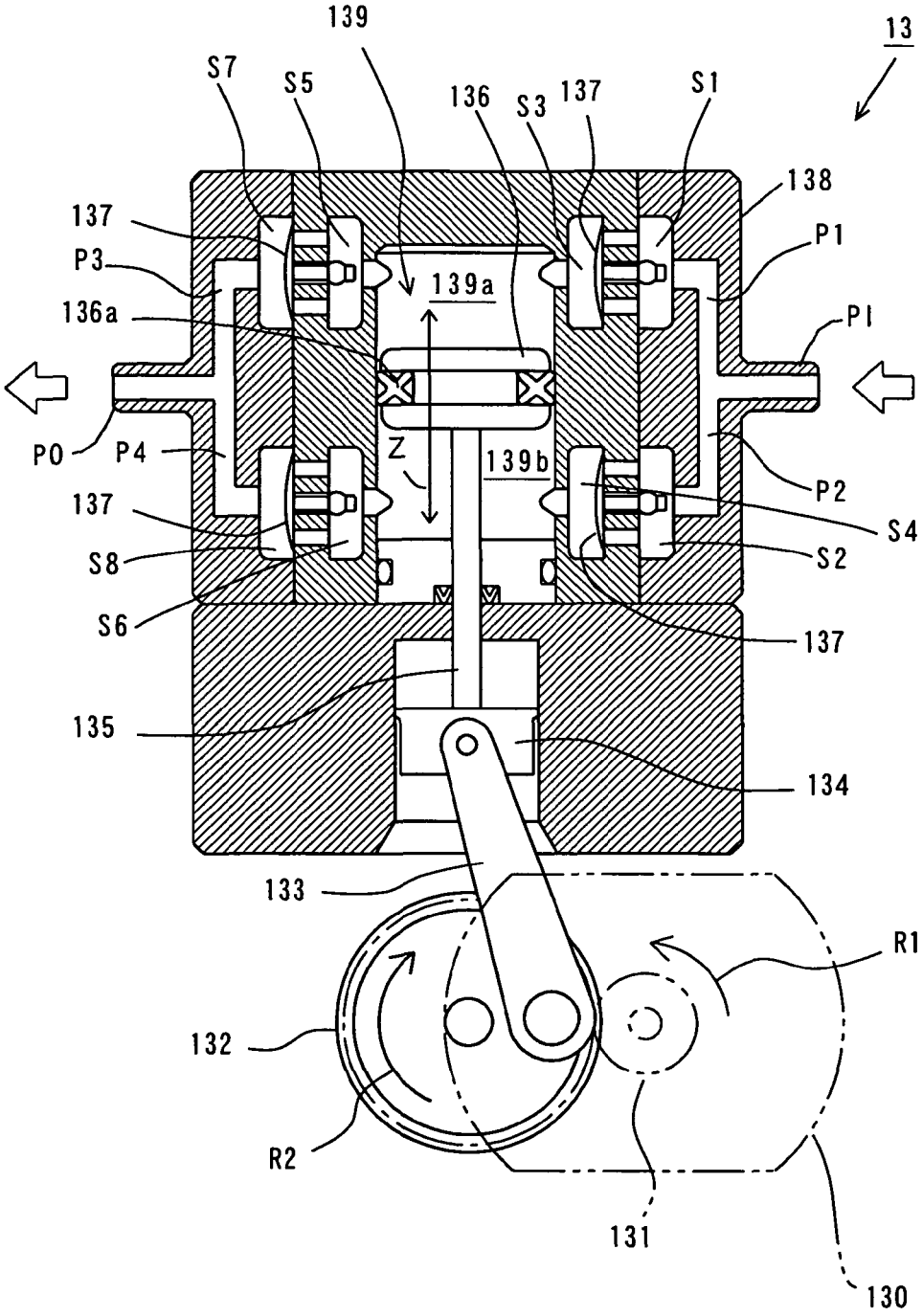
FIG. 5 is a cross-sectional view showing an example of the configuration of a pump.

FIG. 5 is a cross-sectional view showing an example of the configuration of the pump 13. The pump shown in FIG. 5 is a multiple acting type reciprocating pump.

In FIG. 5, a columnar space 139 is formed in a main body 138. A pressure feeding piston 136 is provided in the columnar space 139. An X-shaped packing 136*a* is mounted on the outer periphery of the pressure feeding piston 136. The columnar space 139 is divided into a pump chamber 139*a* and a pump chamber 139*b* by the pressure feeding piston 136.

A washing water inlet PI is provided on one side of the main body 138, and a washing water outlet PO is provided on the other side thereof. The heat exchanger 11 is connected to the washing water inlet PI through the pipe 203 shown in FIG. 3, and the switching valve 14 is connected to the washing water outlet PO through the pipe 203.

The washing water inlet PI communicates with the pump chamber 139*a* through an internal flow path P1, a small chamber S1, and a small chamber S3, and communicates with the pump chamber 139*b* through an internal flow path P2, a small chamber S2, and a small chamber S4.

The pump chamber 139*a* communicates with the washing water outlet PO through a small chamber S5, a small chamber S7, and an internal flow path P3. The columnar space 139*b* communicates with the washing water outlet PO through a small chamber S6, a small chamber S8, and an internal flow path P4.

The small chamber S3, the small chamber S4, the small chamber S7, and the small chamber S8 are respectively provided with umbrella packings 137.

A gear 131 is attached to the axis of rotation of the motor 130, and a gear 132 is engaged with the gear 131. Further, one end of a crank shaft 133 is attached to the gear 132 so as to be rotatable with its one point supported thereon, and the pressure feeding piston 136 is attached to the other end of the crank shaft 133 through a piston holder 134 and a piston holding bar 135.

When the axis of rotation of the motor 130 is rotated on the basis of the control signal fed by the controller 4 shown in FIG. 3, the gear 131 attached to the axis of rotation of the motor 130 is rotated in a direction indicated by an arrow R1, and the gear 132 is rotated in a direction indicated by an arrow R2. Consequently, the pressure feeding piston 136 moves up and down in a direction indicated by an arrow Z.

Figure 6:
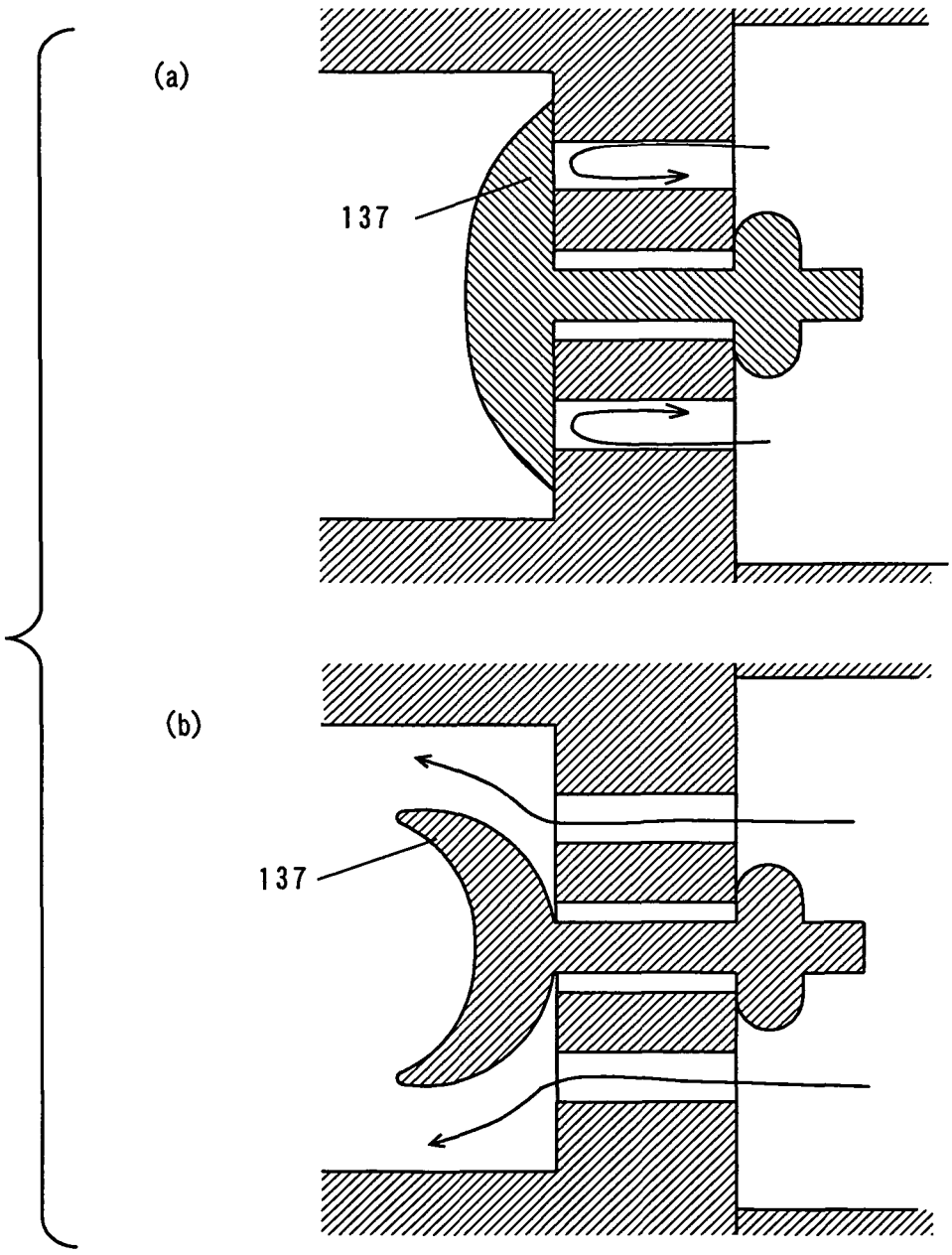
FIG. 6 is a schematic view for explaining the operations of an umbrella packing.

FIG. 6 is a schematic view for explaining the operations of the umbrella packings 137.

When the pressure feeding piston 136 shown in FIG. 5 moves downward, to increase the volume of the pump chamber 139*a*, for example, the pressure in the pump chamber 139*a* is lower than the pressure in the small chamber S1. Accordingly, the umbrella packing 137 provided in the small chamber S3 is deformed, as shown in FIG. 6(*b*). As a result, the washing water supplied from the washing water inlet PI flows into the pump chamber 139*a* through the internal flow path P1, the small chamber S1, and the small chamber S3. In this case, the pressure in the pump chamber 139*a* is lower than the pressure in the small chamber S7, whereby the umbrella packing 137 provided in the small chamber S7 is not deformed from the state shown in FIG. 6(*a*). Therefore, the washing water does not flow into the pump chamber 139*a*. Conversely, the washing water is not discharged from the washing water outlet PO.

On the other hand, when the pressure feeding piston 136 shown in FIG. 5 moves upward, to decrease the volume of the pump chamber 139*a*, the pressure in the pump chamber 139*a* is higher than the pressure in the small chamber S1. Accordingly, the umbrella packing 137 provided in the small chamber S3 is not deformed from the state shown in FIG. 6(*a*) As a result, the washing water inside the small chamber S1 does not flow into the pump chamber 139*a*. In this case, the umbrella packing 137 provided in the small chamber S7 is deformed, as shown in FIG. 6(*b*). Therefore, the washing water inside the pump chamber 139*a* is discharged from the washing water outlet PO through the small chamber S5, the small chamber S7, and the internal flow path P3.

The umbrella packing 137 provided in the small chamber S4 is deformed, as shown in FIG. 6(*b*), when the pressure feeding piston 136 moves upward, while not being deformed from the state shown in FIG. 6(*a*) when the pressure feeding piston 136 moves downward. On the other hand, the umbrella packing 137 provided in the small chamber S8 is not deformed from the state shown in FIG. 6(*a*) when the pressure feeding piston 136 moves upward, while being deformed, as shown in FIG. 6(*b*), when the pressure feeding piston 136 moves downward. Therefore, the washing water from the washing water inlet PI flows into the pump chamber 139*b* when the washing water inside the pump chamber 139*a* is discharged form the washing water outlet PO, while the washing water inside the pump chamber 139*b* is discharged form the washing water outlet PO when the washing water from the washing water inlet PI flows into the pump chamber 139*a*.

Figure 7:
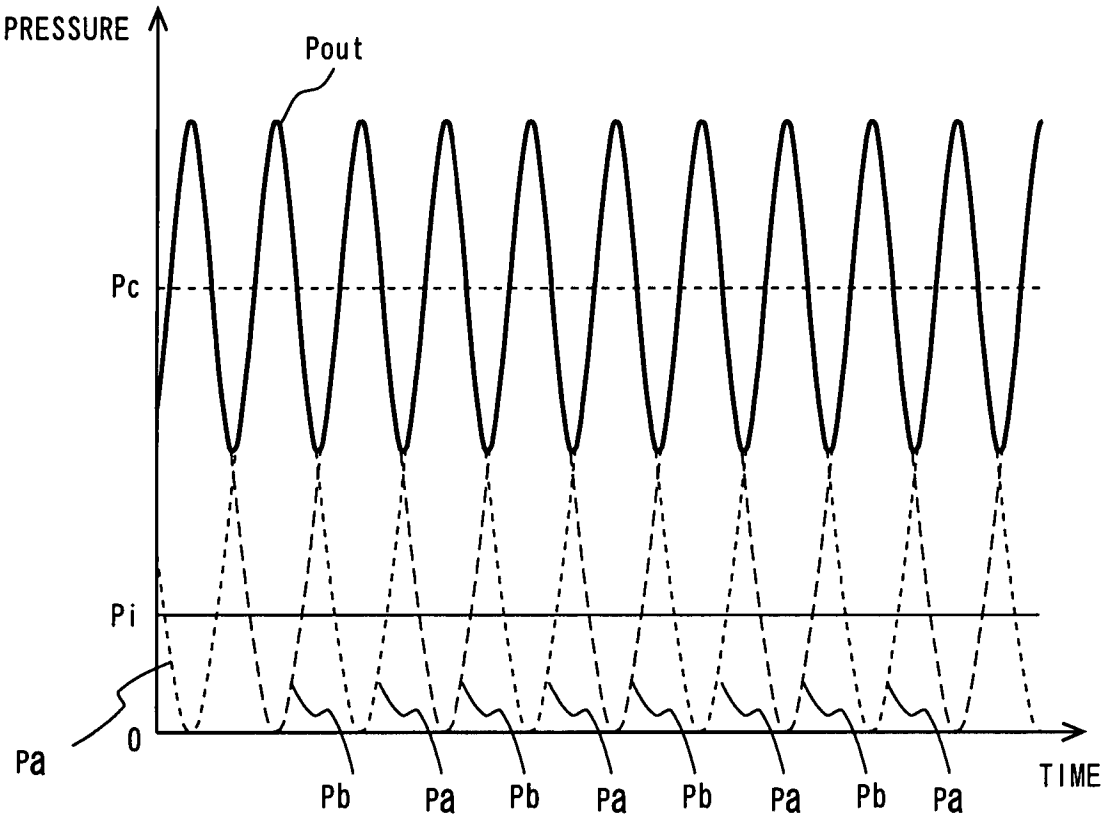
FIG. 7 is a diagram showing the change in pressure of the pump shown in FIG. 5.

FIG. 7 is a diagram showing the change in pressure in the pump 13 shown in FIG. 5. In FIG. 7, the vertical axis indicates pressure, and the horizontal axis indicates time.

As shown in FIG. 7, washing water at a pressure of Pi is supplied to the washing water inlet PI in the pump 13. In this case, the pressure feeding piston 136 shown in FIG. 6 moves up and down so that the pressure Pa of the washing water inside the pump chamber 139*a* is changed, as indicated by a dotted line. On the other hand, the pressure Pb of the washing water inside the pump chamber 139*b* is changed, as indicated by a broken line. The pressure Pout of the washing water discharged from the washing water outlet PO in the pump 13 is periodically changed upward and downward, centered at the pressure Pc, as indicated by a thick solid line.

The pressure feeding piston 136 thus moves up and down in the pump 13 so that pressure is alternately applied to the washing water in the pump chamber 139*a* and the washing water in the pump chamber 139*b*. Accordingly, the washing water at the washing water inlet PI is discharged from the washing water outlet PO after the pressure thereof is raised.

Figure 8:
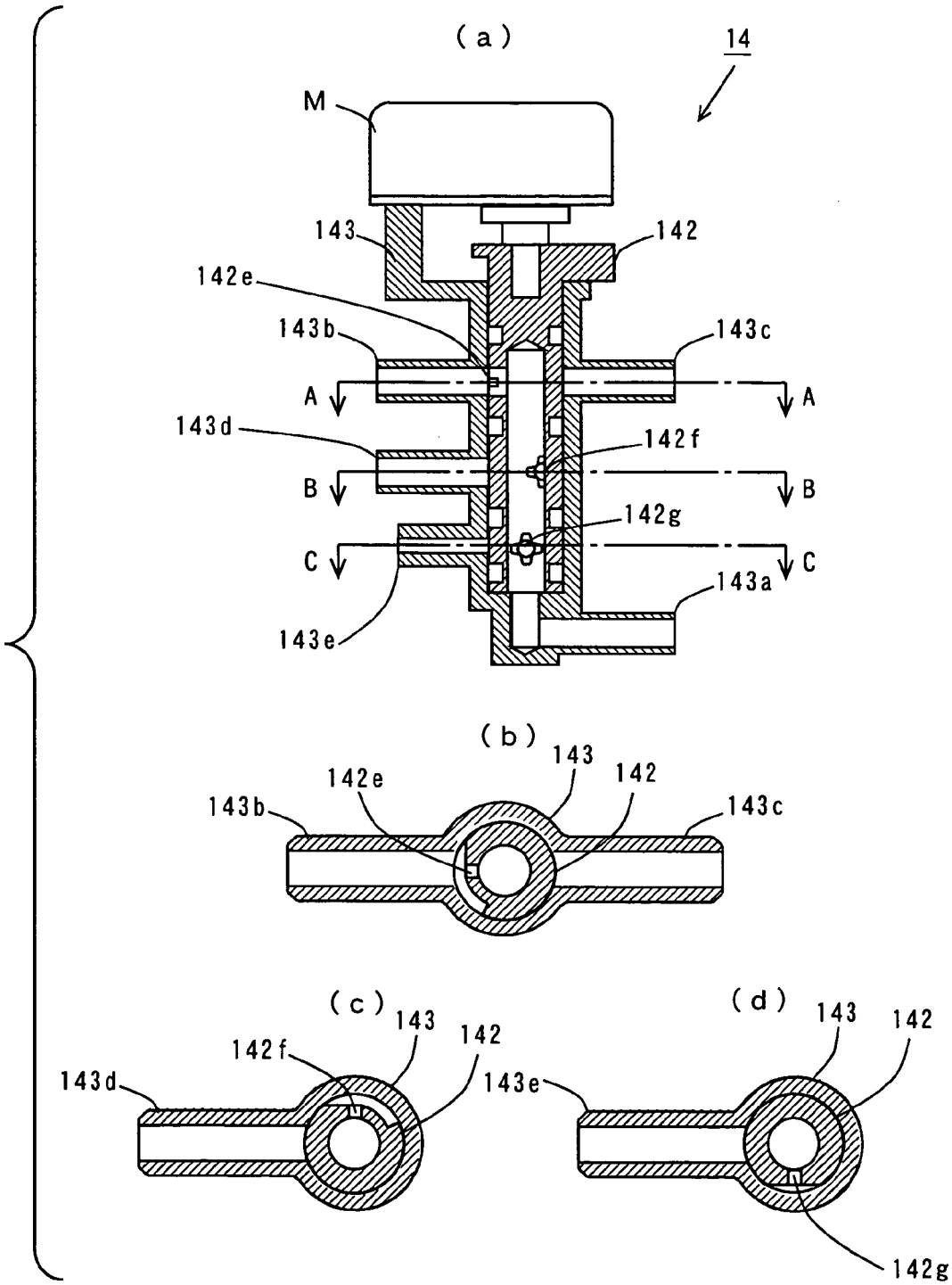
FIG. 8 is a vertical sectional view of a switching valve, a cross-sectional view taken along a line A-A of the switching valve, a cross-sectional view taken along a line B-B of the switching valve, and a cross-sectional view taken along a line C-C of the switching valve.

FIG. 8(*a*) is a vertical sectional view of the switching valve 14, FIG. 8(*b*) is a cross-sectional view taken along a line A-A of the switching valve 14 shown in FIG. 8(*a*), FIG. 8(*c*) is a cross-sectional view taken along a line B-B of the switching valve 14 shown in FIG. 8(*a*), and FIG. 8(*d*) is a cross-sectional view taken along a line C-C of the switching valve 14 shown in FIG. 8(*a*).

The switching valve 14 shown in FIG. 8(*a*) comprises a motor M, an inner cylinder 142, and an outer cylinder 143.

The inner cylinder 142 is inserted into the outer cylinder 143, and the axis of rotation of the motor M is attached to the inner cylinder 142. The motor M performs a rotating operation on the basis of the control signal fed by the controller 4. The motor M is rotated so that the inner cylinder 142 is rotated.

As shown in FIGS. 8(*a*), 8(*b*), 8(*c*), and 8(*d*), a washing water inlet 143*a* is provided at one end of the outer cylinder 143, washing water outlets 143*b* and 143*c* are respectively provided at opposite positions on sides thereof, a washing water outlet 143*d* is provided at a position, different from the washing water outlets 143*b*, 143*c*, and 143*d* on the sides thereof, and a washing water outlet 143*e* is provided at a position, different from the washing water outlets 143*b*, 143*c*, and 143*d* on the sides thereof. Holes 142*e*, 142*f*, and 142*g* are provided at different positions of the inner cylinder 142. Chamfers composed of a curved line and a straight line are respectively formed, as shown in FIG. 8(*b*) and 8(*c*), around the holes 142*e* and 142*f*, and a chamfer composed of a straight line is formed, as shown in FIG. 8(*d*), around the hole 142*g*.

By the rotation of the inner cylinder 142, the hole 142*e* is opposable to the washing water outlet 143*b* or 143*c* in the outer cylinder 143, the hole 142*f* is opposable to the washing water outlet 143*d* in the outer cylinder 143, and the hole 142*g* is opposable to the washing water outlet 143*e* in the outer cylinder 143.

The pipe 203 shown in FIG. 3 is connected to the washing water inlet 143*a*, the bidet nozzle 2 is connected to the washing water outlet 143*b*, the first flow path in the posterior nozzle 1 is connected to the washing water outlet 143*c*, the second flow path in the posterior nozzle 1 is connected to the washing water outlet 143*d*, and the nozzle cleaning nozzle 3 is connected to the washing water outlet 143*e*.

Figure 9:
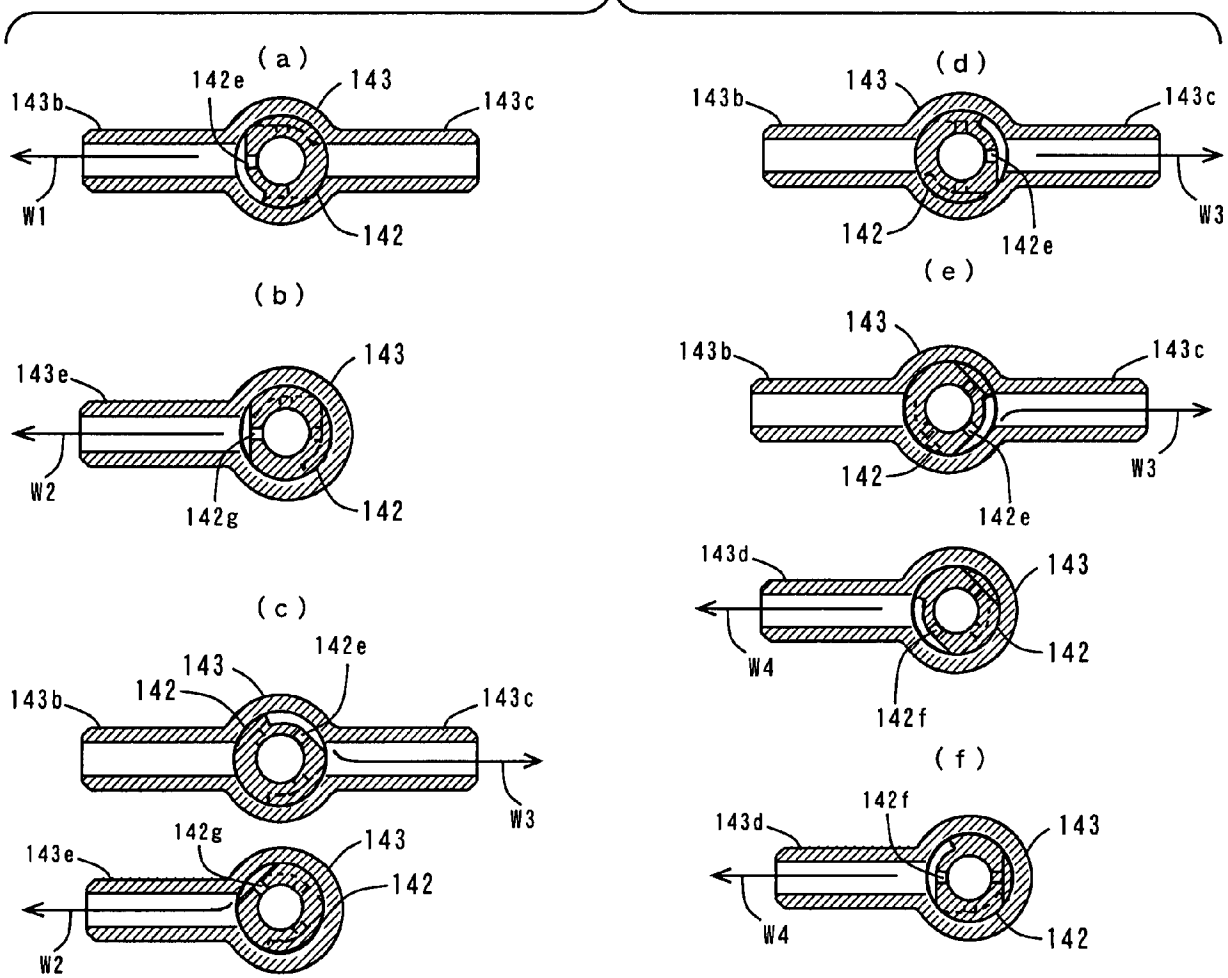
FIG. 9 is a cross-sectional view showing the operations of the switching valve shown in FIG. 8.

FIG. 9 is a cross-sectional view showing the operations of the switching valve 14 shown in FIG. 8.

FIGS. 9(*a*) to 9(*f*) illustrate states where the motor M in the switching valve 14 is rotated through angles of zero, 90 degrees, 135 degrees, 180 degrees, 225 degrees, and 270 degrees, respectively.

First, when the motor M is not rotated (rotated through an angle of zero), as shown in FIG. 9(*a*), the chamfer around the hole 142*e* in the inner cylinder 142 is opposed to the washing water outlet 143*b* in the outer cylinder 143. Consequently, the washing water passes in the inner cylinder 142 from the washing water inlet 143*a*, to flow out of the washing water outlet 143*b*, as indicated by an arrow W1.

When the motor M then rotates the inner cylinder 142 through 90 degrees, as shown in FIG. 9(*b*), the chamfer around the hole 142*g* in the inner cylinder 142 is opposed to the washing water outlet 143*e* in the outer cylinder 143. Consequently, the washing water passes in the inner cylinder 142 from the washing water inlet 143*a*, to flow out of the washing water outlet 143*e*, as indicated by an arrow W2.

When the motor M then rotates the inner cylinder 142 through 135 degrees, as shown in FIG. 9(*c*), a part of the chamfer around the hole 142*g* in the inner cylinder 142 is opposed to the washing water outlet 143*e* in the outer cylinder 143, and a part of the chamfer around the hole 142*e* in the inner cylinder 142 is opposed to the washing water outlet 143*c* in the outer cylinder 143. Consequently, a small amount of washing water passes in the inner cylinder 142 from the washing water inlet 143*a*, to flow out of the washing water outlets 143*c* and 143*e*, respectively, as indicated by an arrow W2 and an arrow W3.

When the motor M then rotates the inner cylinder 142 through 180 degrees, as shown in FIG. 9(*d*), the chamfer around the hole 142*e* in the inner cylinder 142 is opposed to the washing water outlet 143*c* in the outer cylinder 143. Consequently, the washing water passes in the inner cylinder 142 from the washing water inlet 143*a*, to flow out of the washing water outlet 143*c*, as indicated by an arrow W3.

When the motor M then rotates the inner cylinder 142 through 225 degrees, as shown in FIG. 9(*e*), a part of the chamfer around the hole 142*e* in the inner cylinder 142 is opposed to the washing water outlet 143*c* in the outer cylinder 143, and a part of the chamfer around the hole 142*f* in the inner cylinder 142 is opposed to the washing water outlet 143*d* in the outer cylinder 143. Consequently, a small amount of washing water passes in the inner cylinder 142 from the washing water inlet 143*a*, to flow out of the washing water outlets 143*c* and 143*d*, respectively, as indicated by an arrow W3 and an arrow W4.

When the motor M rotates the inner cylinder 142 through 270 degrees, as shown in FIG. 9(*f*), the chamfer around the hole 142*f* in the inner cylinder 142 is opposed to the washing water outlet 143*d* in the outer cylinder 143. Consequently, the washing water passes in the inner cylinder 142 from the washing water inlet 143*a*, to flow out of the washing water outlet 143*d*, as indicated by an arrow W4.

As described in the foregoing, the motor M is rotated on the basis of the control signal from the controller 4 so that any one of the holes 142*e*, 142*f*, and 142*g* in the inner cylinder 142 is opposed to the washing water outlets 143*b* to 143*e* in the outer cylinder 143, and the washing water that has flown in from the washing water inlet 143*a* flows out of any one of the washing water outlets 143*b* to 143*e*.

Figure 10:
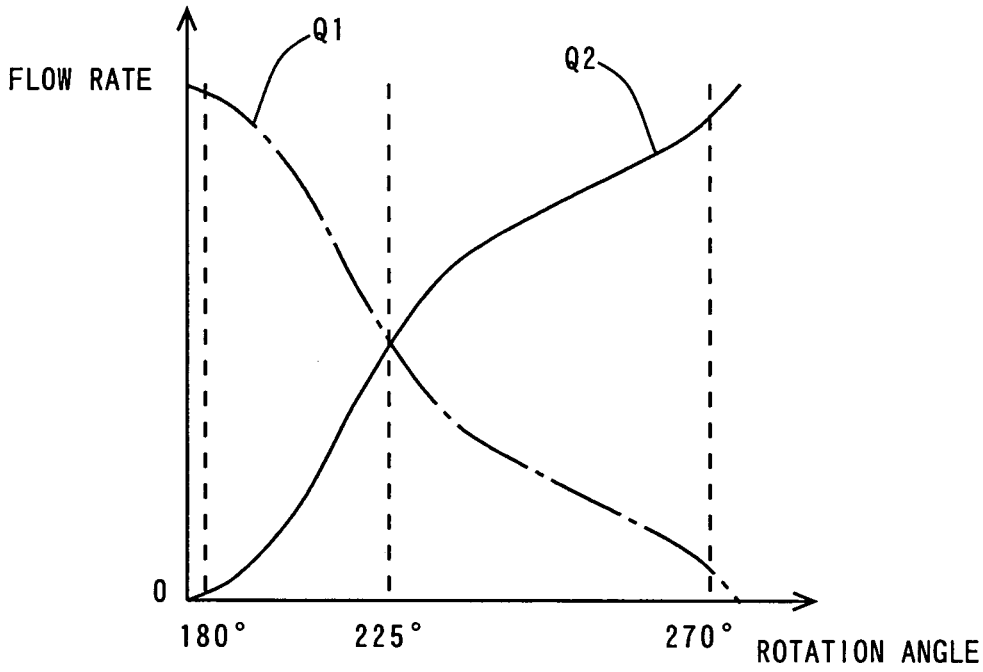
FIG. 10 is a diagram showing the flow rate of washing water flowing out of a washing water outlet in the switching valve shown in FIG. 9.

FIG. 10 is a diagram showing the flow rate of washing water flowing out of the washing water outlet 143*c* and the washing water flowing out of the washing water outlet 143*d* in the switching valve 14 shown in FIG. 9. In FIG. 10, the horizontal axis indicates the rotation angle of the motor M, and the vertical axis indicates the respective flow rates of washing water flowing in the washing water outlets 143*c* and 143*d*. A one-dot and dash line Q1 indicates the change in the flow rate of the washing water flowing out of the washing water outlet 143*c*, and a solid line Q2 indicates the change in the flow rate of the washing water flowing out of the washing water outlet 143*d*.

When the motor M is rotated through 180 degrees, as shown in FIG. 10, for example, the flow rate of the washing water flowing out of the washing water outlet 143*c* takes the maximum value, so that no washing water flows out of the washing water outlet 143*d*. As the rotation angle of the motor M increases, the flow rate of the washing water flowing out of the washing water outlet 143*c* decreases, and the flow rate of the washing water flowing out of the washing water outlet 143*d* increases. When the motor M is rotated through 270 degrees, no washing water flows out of the washing water outlet 143*c*, so that the flow rate of the washing water flowing out of the washing water outlet 143*d* takes the maximum value.

As described in the foregoing, the controller 4 controls the rotation angle of the motor M in the switching valve 14, thereby making it possible to control the ratio of the respective flow rates of the washing water flowing out of the washing water outlet 143*c* and the washing water flowing out of the washing water outlet 143*d*.

Figure 11:
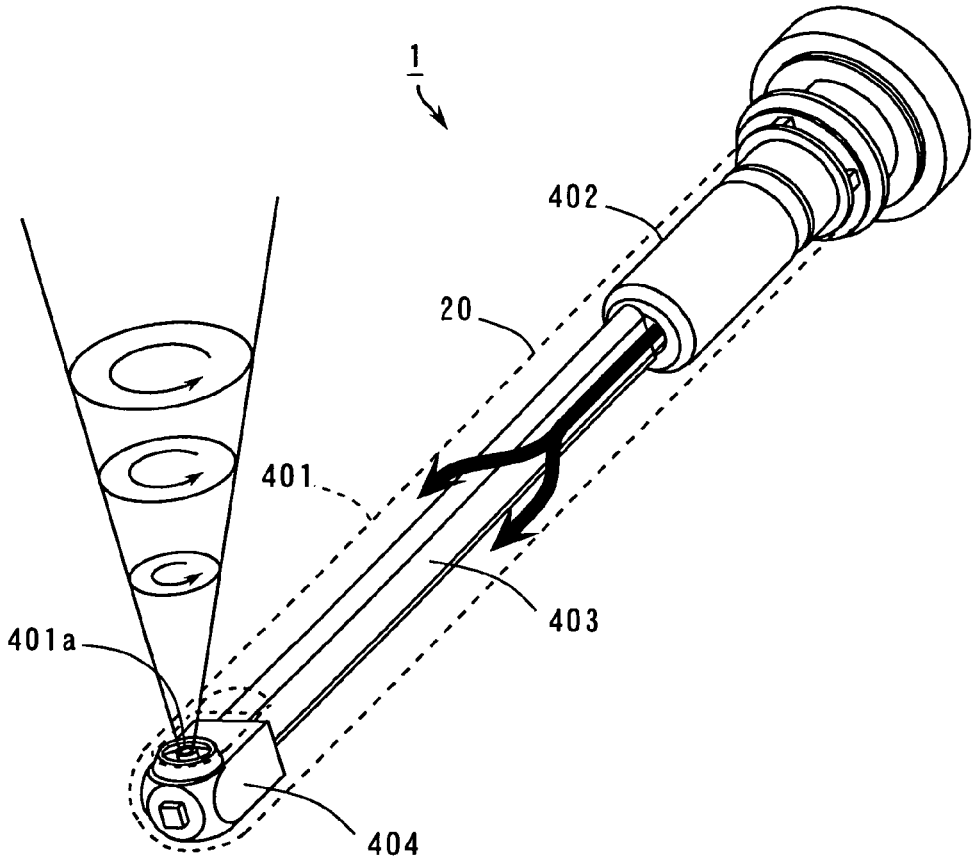
FIG. 11 is a perspective view of a piston in a posterior nozzle in a nozzle unit.
Figure 12:
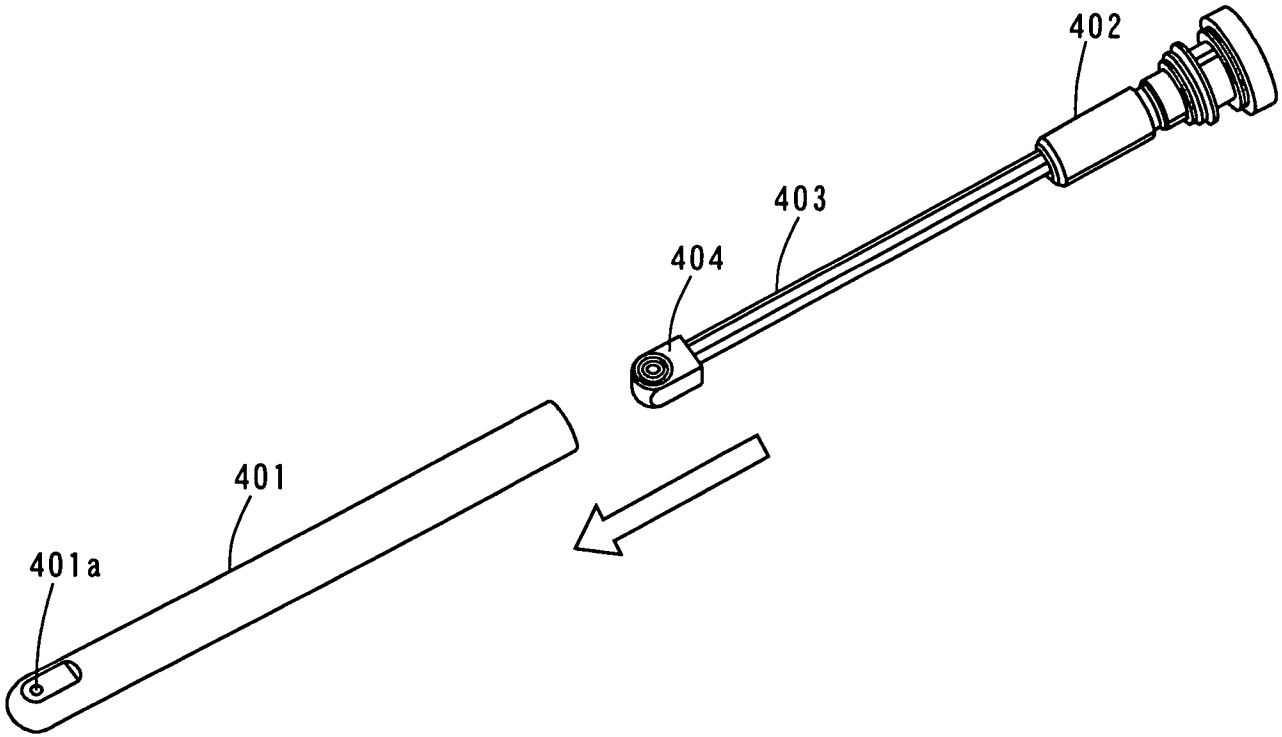
FIG. 12 is an exploded perspective view of a piston.

The posterior nozzle 1 in the nozzle unit 30 shown in FIG. 3 will be then described. FIG. 11 is a perspective view of a piston 20 in the posterior nozzle 1 in the nozzle unit 30, and FIG. 12 is an exploded perspective view of the piston 20.

As shown in FIG. 11, the piston 20 in the posterior nozzle 1 comprises a nozzle cover 401, a two-flow path pipe 402, a one-flow path pipe 403, and a flow path merger 404. In FIG. 11, the nozzle cover 401 is indicated by a broken line. As shown in FIG. 12, a spray hole 401*a* is provided on an upper surface at a front end of the nozzle cover 401.

The two-flow path pipe 402 has two flow paths through which washing water flows. A rear end of the one-flow path pipe 403 is connected to one of the flow paths, and the flow path merger 404 is connected to a front end of the one-flow path pipe 403. As shown in FIG. 11, the nozzle cover 401 covers the two-flow path pipe 402, the one-flow path pipe 403, and the flow path merger 404.

The washing water supplied to one of the flow paths of the two-flow path pipe 402 is supplied to the flow path merger 404 through the one-flow path pipe 403. The washing water supplied to the other flow path of the two-flow path pipe 402 is supplied to the flow path merger 404 after passing through a space between the one-flow path pipe 403 and the nozzle cover 401. The washing water supplied to the flow path merger 404 is sprayed toward the human body from the spray hole 401*a*. The washing water sprayed at this time is changed into dispersed spiral flow. The details will be described later.

Figure 13:
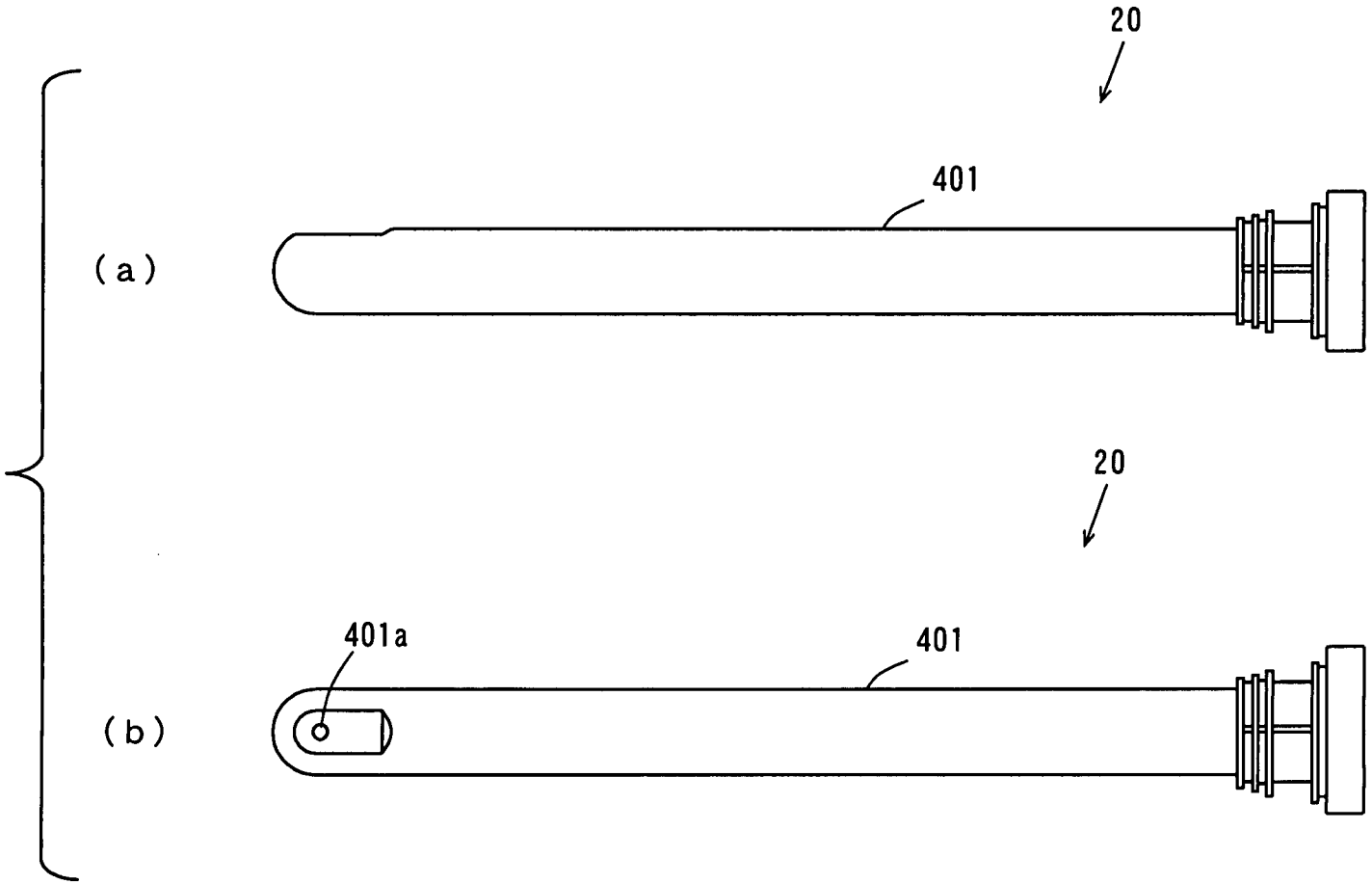
FIG. 13 is a side view of a piston and a plan view of the piston.

FIG. 13(*a*) is a side view of the piston 20, and FIG. 13(*b*) is a plan view of the piston 20.

As shown in FIGS. 13(*a*) and 13(*b*), the nozzle cover 401 has a cylindrical structure whose front end is closed in a hemispherical shape and has an integral structure having no joint. A plane is partially formed in an upper part at a front end of the nozzle cover 401, and a spray hole 401*a* is formed at the center of the plane. The nozzle cover 401 is formed by subjecting stainless to drawing forming.

Since the nozzle cover 401 has no joint, it is sanitary because dirt is easily washed away even if the dirt adheres thereto. Since stainless metal has an antibacterial action, no bacteria grow on the surface of the nozzle cover 401.

Since the nozzle cover 401 is composed of stainless, the nozzle cover 401 can be thin-walled while ensuring the strength thereof, thereby achieving miniaturization of the posterior nozzle 1. In this case, even if pressurized washing water is supplied to the nozzle cover 401, the nozzle cover 401 is not deformed. The pipe diameter of the nozzle cover 401 is 10 mm, for example, and the wall thickness thereof is about 0.2 mm.

Furthermore, the nozzle cover 401 is formed by drawing forming, so that the surface thereof is not rough, and dirt does not easily adhere thereto. The surface of the nozzle cover 401 has a gloss, so that the user feels clean.

Figure 14:
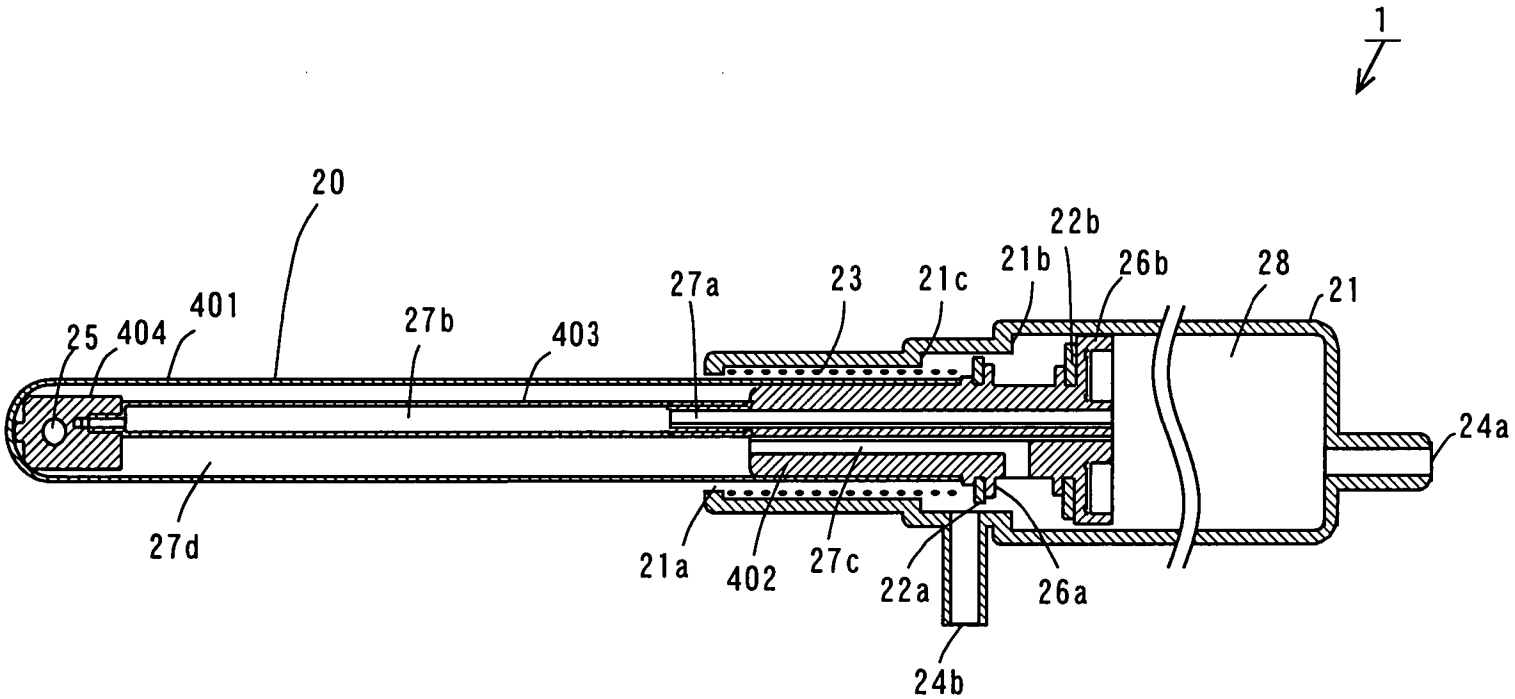
FIG. 14 is a cross-sectional view of a posterior nozzle.

FIG. 14 is a cross-sectional view of the posterior nozzle 1.

As shown in FIG. 14, the posterior nozzle 1 comprises a piston 20, a cylindrical cylinder 21, seal packings 22*a* and 22*b*, and a spring 23.

An orifice 25 for spraying washing water is formed on an upper surface of the flow path merger 404. Flange-shaped stoppers 26*a* and 26*b* are provided at a rear end of the piston 20. Further, the seal packings 22*a* and 22*b* are respectively mounted on the stoppers 26*a* and 26*b*.

Inside the two-flow path pipe 402, a flow path 27*a* communicating with the one-flow path pipe 403 from its rear end surface is formed, and a flow path 27*c* communicating with a front end surface of the two-flow path pipe 402 from a peripheral surface of the piston 20 between the stopper 26*a* and the stopper 26*b* is formed.

Inside the one-flow path pipe 403, a flow path 27*b* communicating with the flow path merger 404 from the flow path 27*a* in the two-flow path pipe 402 is formed. A space between the nozzle cover 401 and the one-flow path pipe 403 is a flow path 27*d*. The details of the flow path merger 404 will be described later.

On the other hand, the cylinder 21 comprises a small diameter portion at its front end, an intermediate portion having an intermediate diameter, and a large diameter portion at its rear end. Consequently, a stopper surface 21*c* against which the stopper 26*a* in the piston 20 can abut through the seal packing 22*a* is formed between the small diameter portion and the intermediate portion, and a stopper surface 21*b* against which the stopper 26*b* in the piston 20 can abut through the seal packing 22*b* is formed between the intermediate portion and the large diameter portion.

A washing water inlet 24*a* is provided on a rear end surface of the cylinder 21, a washing water inlet 24*b* is provided on a peripheral surface of the intermediate portion of the cylinder 21, and an opening 21*a* is provided on a front end surface of the cylinder 21. An inner space of the cylinder 21 is a temperature fluctuation buffering space 28. The washing water inlet 24*a* is provided eccentrically at a position different from the central axis of the cylinder 21.

The washing water inlet 24*a* is connected to the washing water outlet 143*c* in the switching valve 14 shown in FIG. 8, and the washing water inlet 24*b* is connected to the washing water outlet 143*d* in the switching valve 14 shown in FIG. 8. When the piston 20 projects most greatly from the cylinder 21, the washing water inlet 24*b* communicates with the flow path 27*c* in the two-flow path pipe 402. The details of the operations in a case where the washing water inlet 24*b* is connected to the flow path 27*c* will be described later.

The piston 20 is inserted into the cylinder 21 so as to be movable such that the stopper 26*b* is positioned in the temperature fluctuation buffering space 28 and the front end projects from the opening 21*a*.

Furthermore, the spring 23 is disposed between the stopper 26*a* in the piston 20 and a peripheral edge of the opening 21*a* in the cylinder 21, to urge the piston 20 toward the rear end of the cylinder 21.

A micro-clearance is formed between an outer peripheral surface of the stopper 26*a* or 26*b* in the piston 20 and an inner peripheral surface of the cylinder 21, and a micro-clearance is formed between an outer peripheral surface of the piston 20 and an inner peripheral surface of the opening 21*a* in the cylinder 21.

Figure 15:
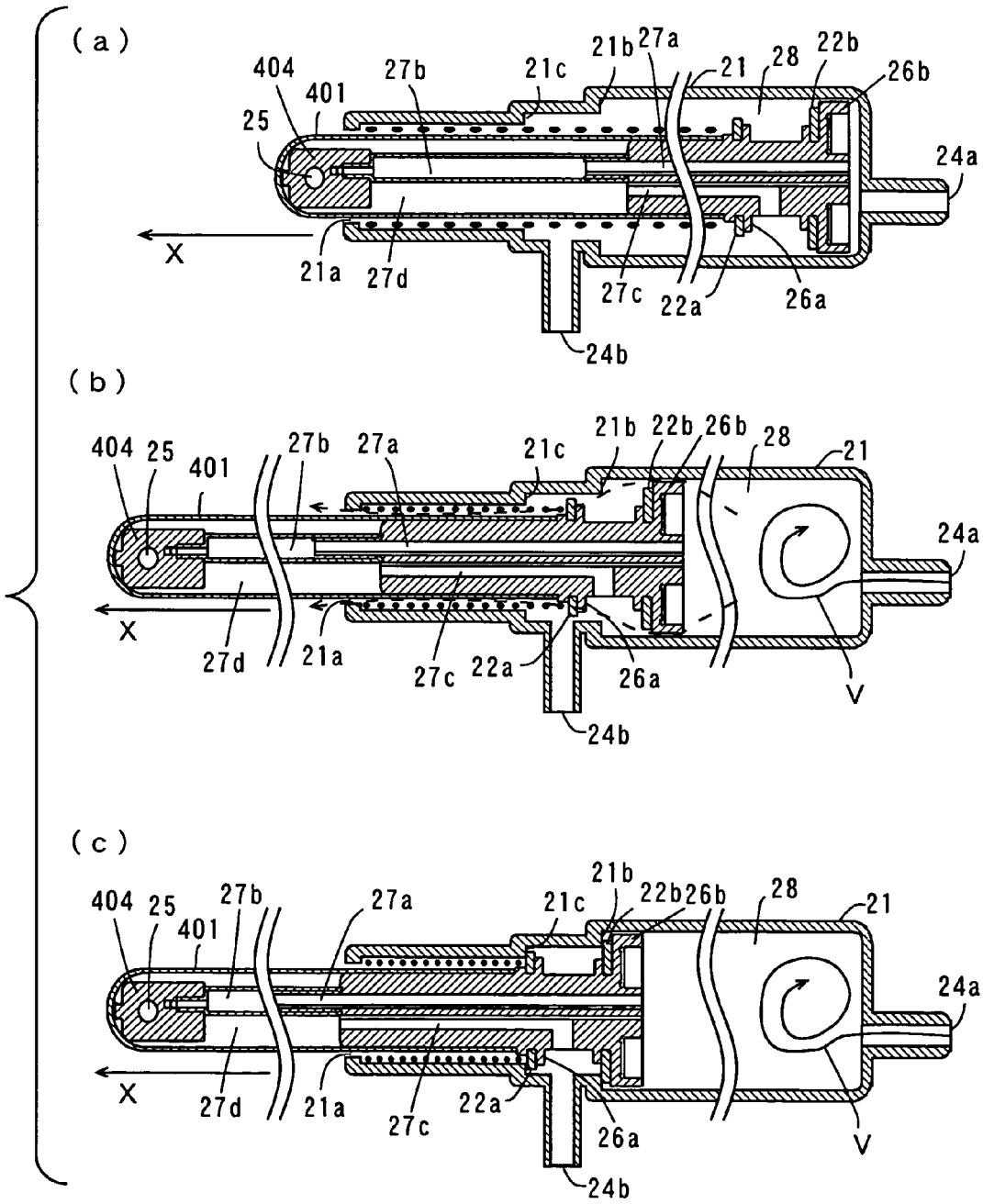
FIG. 15 is a cross-sectional view for explaining the operations of the posterior nozzle shown in FIG. 14.

Description is now made of the operations of the posterior nozzle 1 shown in FIG. 14. FIG. 15 is a cross-sectional view for explaining the operations of the posterior nozzle 1 shown in FIG. 14.

When no washing water is first supplied from the washing water inlets 24*a* and 24*b* in the cylinder 21, as shown in FIG. 15(*a*), the piston 20 retreats in the opposite direction (i.e., an opposing direction which is opposite a first direction) to a direction indicated by an arrow X (i.e., the first direction) by the elastic force of the spring 23, and is accommodated in the cylinder 21. As a result, the piston 20 enters a state where it does not project most greatly from the opening 21*a* in the cylinder 21. At this time, the temperature fluctuation buffering space 28 is not formed in the cylinder 21.

When the supply of washing water from the washing water inlet 24*a* in the cylinder 21 is then started, as shown in FIG. 15(*b*), the piston 20 gradually advances in the direction indicated by the arrow X against the elastic force of the spring 23 by the pressure of the washing water. Consequently, the temperature fluctuation buffering space 28 is formed in the cylinder 21, and the washing water flows into the temperature fluctuation buffering space 28.

Since the washing water inlet 24*a* is provided at a position eccentric from the central axis of the cylinder 21, the washing water flowing into the temperature fluctuation buffering space 28 flows in a swirling state, as indicated by an arrow V. A part of the washing water in the temperature fluctuation buffering space 28 flows out of the micro-clearance between the outer peripheral surface of the piston 20 and the inner peripheral surface of the opening 21*a* in the cylinder 21 through the micro-clearance between the outer peripheral surface of the stopper 26*a* or 26*b* in the piston 20 and the inner peripheral surface of the cylinder 21, and is supplied to the flow path merger 404 through the flow paths 27*a*, 27*b*, 27*c*, and 27*d* in the piston 20, to be slightly sprayed from the orifice 25.

When the piston 20 further advances, the stoppers 26*a* and 26*b* are respectively brought into watertight contact with the stopper surfaces 21*c* and 21*b* in the cylinder 21 through the seal packings 22*a* and 22*b*, as shown in FIG. 15(*c*). Consequently, a flow path leading from the micro-clearance between the outer peripheral surface of the stopper 26*a* or 26*b* in the piston 20 and the inner peripheral surface of the cylinder 21 to the micro-clearance between the outer peripheral surface of the piston 20 to the inner peripheral surface of the opening 21*a* in the cylinder 21 is blocked off.

Furthermore, the washing water supplied from the washing water inlet 26*b* is supplied to the cylindrical swirl chamber 29 through the flow paths 27*c* and 27*d* in the piston 20. Consequently, the washing water supplied to the flow path merger 404 through the flow paths 27*a* and 27*b* is mixed with the washing water supplied thereto through the flow paths 27*c* and 27*d*, and obtained mixed washing water is sprayed from the orifice 25.

Figure 16:
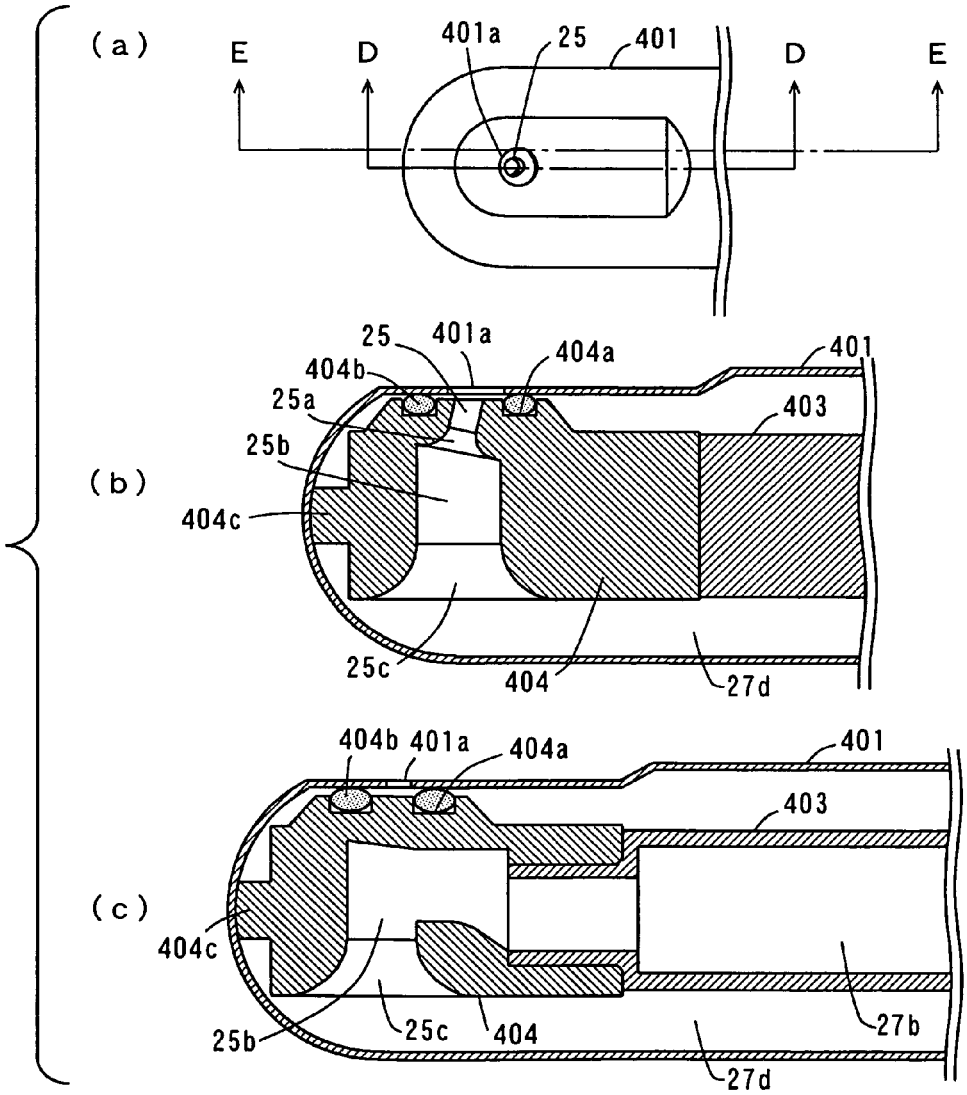
FIG. 16 is a diagram for explaining a flow path merger.

FIG. 16 is a diagram for explaining the flow path merger 404. FIG. 16(*a*) is a plan view showing a front end of the piston 20, FIG. 16(*b*) is a cross-sectional view taken along a line D-D shown in FIG. 16(*a*), and FIG. 16(*c*) is a cross-sectional view taken along a line E-E shown in FIG. 16(*a*).

As shown in FIG. 16(*a*), the spray hole 401*a* is formed such that the diameter thereof is larger than the diameter of the orifice 25. Consequently, the washing water sprayed from the orifice 25 does not strike the spray hole 401*a*, not to prevent the washing water from being sprayed.

As shown in FIG. 16(*b*), an annular groove 404*a* is formed so as to surround the orifice 25 in an upper part of the flow path merger 404, and an O-ring 404*b* is mounted on the groove 404*a*. The O-ring 404*b* and an inner peripheral surface of the nozzle cover 401 adhere to each other, not to cause the washing water in the flow path 27*d* to flow out of the spray hole 401*a* in the nozzle cover 401. Even if dirt adheres to a front end of the nozzle cover 401, the dirt does not directly enter the flow path 27*d* from the spray hole 401*a*.

Even when the dirt enters the orifice 25 from the spray hole 401*a* in the nozzle cover 401, the dirt is immediately discharged by the washing water sprayed from the orifice 25. Consequently, the inside of the nozzle cover 401 is always kept clean.

A position fixing member 404*c* is formed at a front end of the flow path merger 404. A front end of the position fixing member 404*c* is supported on an inner peripheral surface at the front end of the nozzle cover 401 so that the position of the flow path merger 404 is fixed.

Inside the flow path merger 404, the orifice 25, a flow-contracting portion 25*a*, a cylindrical swirl chamber 25*b*, and a flow-contracting portion 25*c* are formed in this order throughout from an upper end to a lower end of the flow path merger 404.

The washing water in the flow path 27*d* is supplied to the cylindrical swirl chamber 25*b* through the flow-contracting portion 25*c*. The inner diameter of the flow-contracting portion 25*c* continuously decreases toward the cylindrical swirl chamber 25*b*, so that the velocity of flow of the washing water flowing in the flow-contracting portion 25*c* is continuously raised.

The washing water supplied to the cylindrical swirl chamber 25*b* flows into the flow-contracting portion 25*a*. The inner diameter of the flow-contracting portion 25*a* continuously decreases toward the orifice 25, so that the velocity of flow of the washing water flowing in the flow-contracting portion 25*c* is continuously raised. The washing water supplied to the orifice 25 is sprayed toward the human body.

As shown in FIG. 16(*c*), the cylindrical swirl chamber 25*b* and the flow path 27*b* communicate with each other. The washing water supplied from the flow path 27*b* applies a swirling force to the washing water supplied to the cylindrical swirl chamber 25*b* from the flow path 27*d* in the cylindrical swirl chamber 25*b*, as described later, to generate spiral flow.

Figure 17:
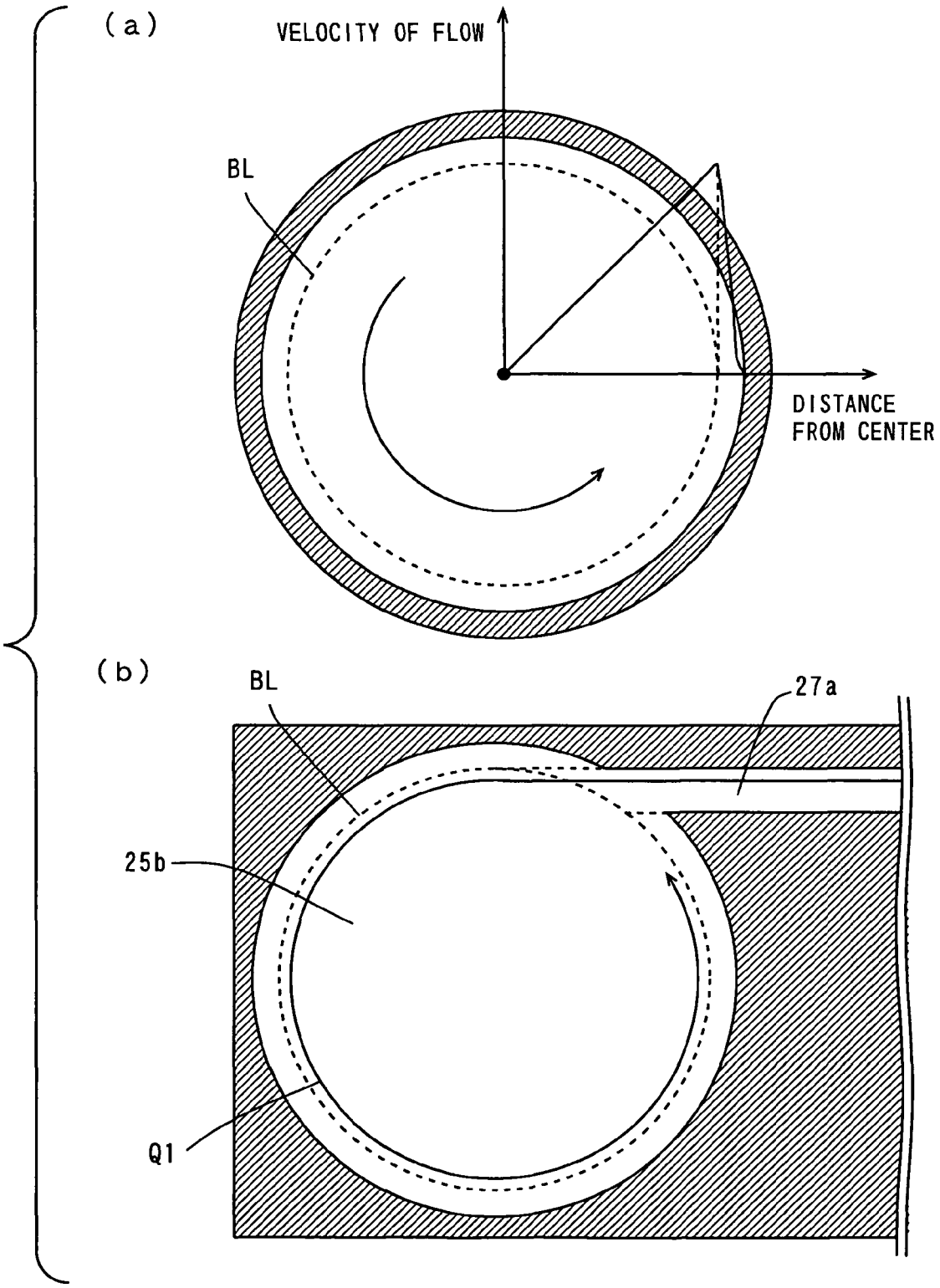
FIG. 17 is a schematic view for explaining the velocity of flow of spiral flow inside of a cylinder and a schematic view for explaining spiral flow of washing water in a cylindrical swirl chamber.

Description is herein made of the flow velocity of the spiral flow flowing in the cylinder. FIG. 17(*a*) is a schematic view for explaining the flow velocity of the spiral flow in the cylinder.

It is assumed that the spiral flow flowing in the cylinder shown in FIG. 17(*a*) is in a steady state. As shown in FIG. 17(*a*), a fluid flowing in the cylinder flows in a concentric fashion with respect to the center of the cylinder. The velocity of flow of the spiral flow is zero at the center of the cylinder, and increases in proportion to the distance from the center, so that the spiral flow forms a swirl having no vorticity.

However, the spiral flow encounters resistance from an inner peripheral surface of the cylinder in an area outside of a boundary in the vicinity of the inner peripheral surface of the cylinder. The boundary is hereinafter referred to as a laminar flow limit BL. Outside the laminar flow limit BL, a so-called boundary layer is formed, so that the velocity of flow of the spiral flow is gradually lowered, to become zero on the inner peripheral surface of the cylinder. Consequently, the flow velocity of the spiral flow reaches its maximum in the laminar flow limit BL.

FIG. 17(*b*) is a schematic view for explaining spiral flow of washing water in the cylindrical swirl chamber 25*b*. In FIG. 17(*b*), the flow of the washing water is indicated by an arrow Q1. As shown in FIG. 17(*b*), the flow path 27*a* communicates with the cylindrical swirl chamber 25*b* such that a line of extension of an outer wall of the flow path 27*a* forms a tangent to the laminar flow limit BL. Consequently, the washing water supplied from the flow path 27*a* can apply a swirling force to the washing water without encountering resistance from an inner peripheral surface of the cylindrical swirl chamber 25*b*. The washing water supplied from the flow path 27*a* applies a swirling force to the outermost periphery of a swirl having no vorticity formed within the cylindrical swirl chamber 25*b*, not to disturb the swirl having no vorticity.

Furthermore, as shown in FIG. 16(*b*), the cylindrical swirl chamber 25*b* has no bottom surface, so that the resistance encountered by the spiral flow flowing in the cylindrical swirl chamber 25*b* is reduced.

As described in the foregoing, in the cylindrical swirl chamber 25*b* in the first embodiment, flow resistance is low, thereby allowing washing water to be swirled without disturbing a swirl having no vorticity.

The change in the cross-sectional area of the flow path through which the washing water supplied to the posterior nozzle 1 flows will be described while referring to FIGS. 18 and 19.

Figure 18:
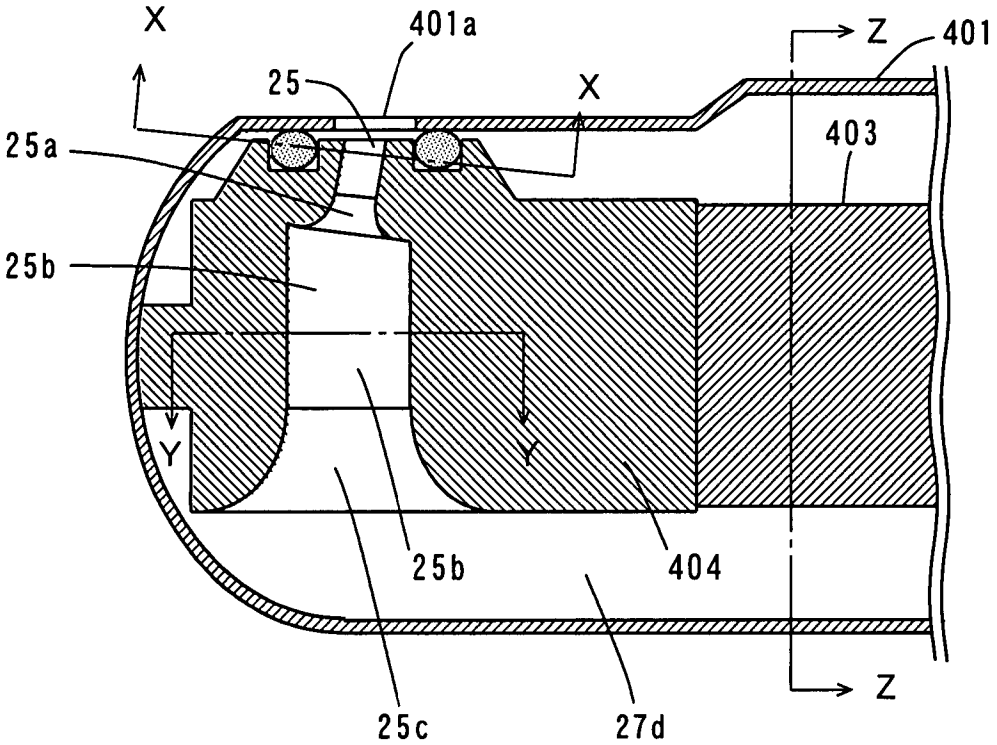
FIG. 18 is a cross-sectional view at a front end of a posterior nozzle.
Figure 19:
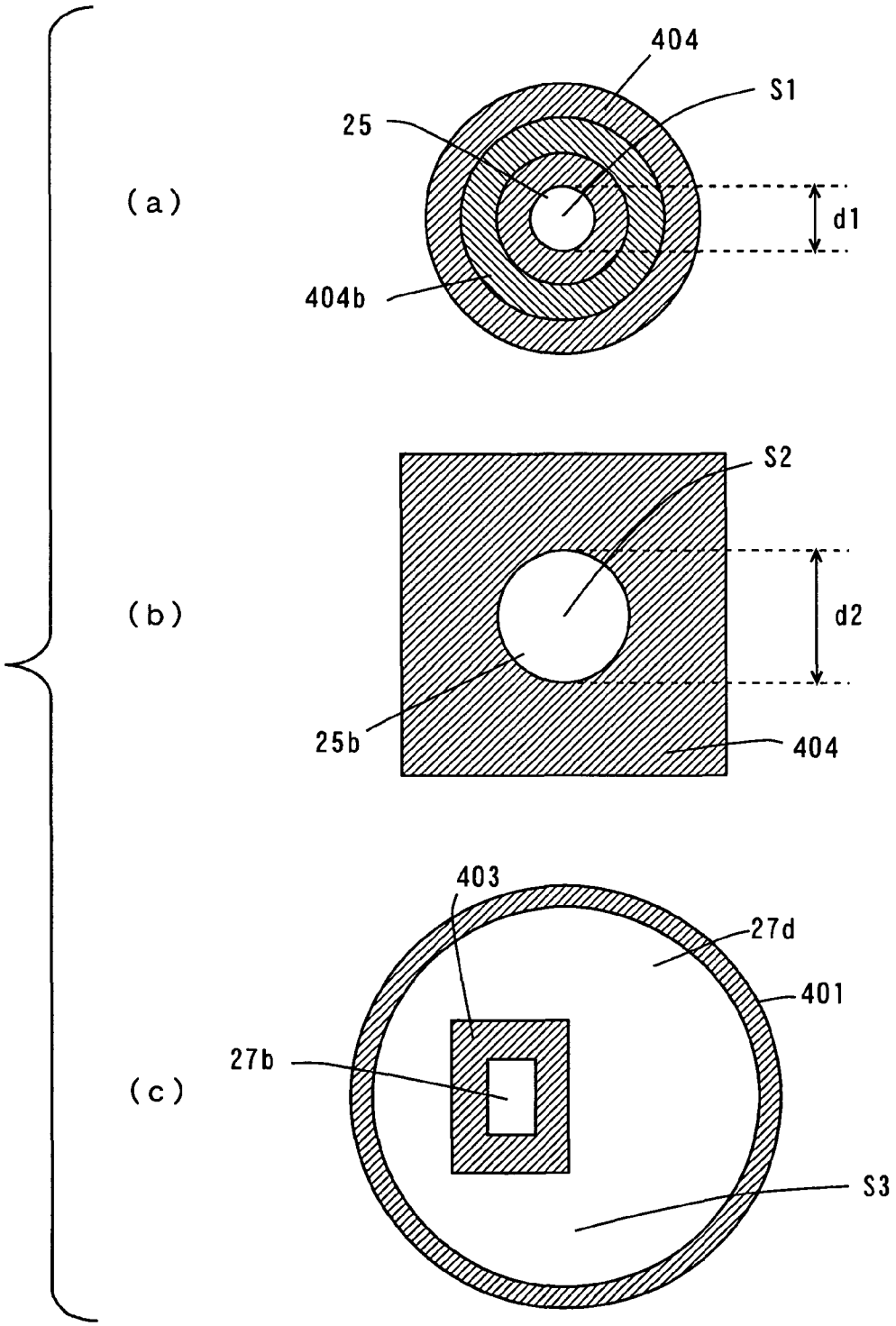
FIG. 19 is a cross-sectional view taken along a line X-X shown in FIG. 18, a cross-sectional view taken along a line Y-Y shown in FIG. 18, and a cross-sectional view taken along a line Z-Z shown in FIG. 18.

FIG. 18 is a cross-sectional view showing a front end of the posterior nozzle 1, FIG. 19(*a*) is a cross-sectional view taken along a line X-X shown in FIG. 18, FIG. 19(*b*) is a cross-sectional view taken along a line Y-Y shown in FIG. 18, and FIG. 19(*c*) is a cross-sectional area taken along a line Z-Z shown in FIG. 18.

As shown in FIG. 19(*a*), a cross-sectional area S1 represents the cross-sectional area of the orifice 25. As shown in FIG. 19(*b*), a cross-sectional area S2 represents the cross-sectional area of the cylindrical swirl chamber 25*b*. As shown in FIG. 19(*c*), the cross-sectional area S3 of the flow path 27*d* is the cross-sectional area of a region excluding the one-flow path pipe 403 from a space inside the nozzle cover 401. A relationship of S1<S2<S3 holds among the cross-sectional areas S1, S2, and S3.

Since the cross-sectional area S3 of the flow path 27*d* is relatively large, the pressure loss of the washing water flowing in the flow path 27*d* is reduced. Consequently, the washing water is maintained at a high pressure until it is supplied to the flow path merger 404.

Since the flow path 27*d*, the flow-contracting portion 25*c*, the cylindrical swirl chamber 25*b*, the flow-contracting portion 25*a*, and the orifice 25 gradually decrease in cross-sectional areas in this order, a flow path loss is reduced, so that the pressure loss of the washing water is reduced. This is efficient because water power in a case where the washing water is sprayed from the orifice 25 is increased.

Letting d1 be the diameter of the orifice 25 and letting d2 be the diameter of the cylindrical swirl chamber 25*b*, it is desirable that d2/d1 is about 2 to 5. Consequently, the velocity of flow of the washing water sprayed from the orifice 25 can be increased while reducing the flow path loss.

In the posterior nozzle 1 according to the first embodiment, a cylindrical space between the inner peripheral surface of the nozzle cover 401 and the one-flow path pipe 403 is used as a flow path of washing water. Accordingly, the cross-sectional area of the flow path of the washing water can be increased while miniaturizing the piston 20.

Figure 20:
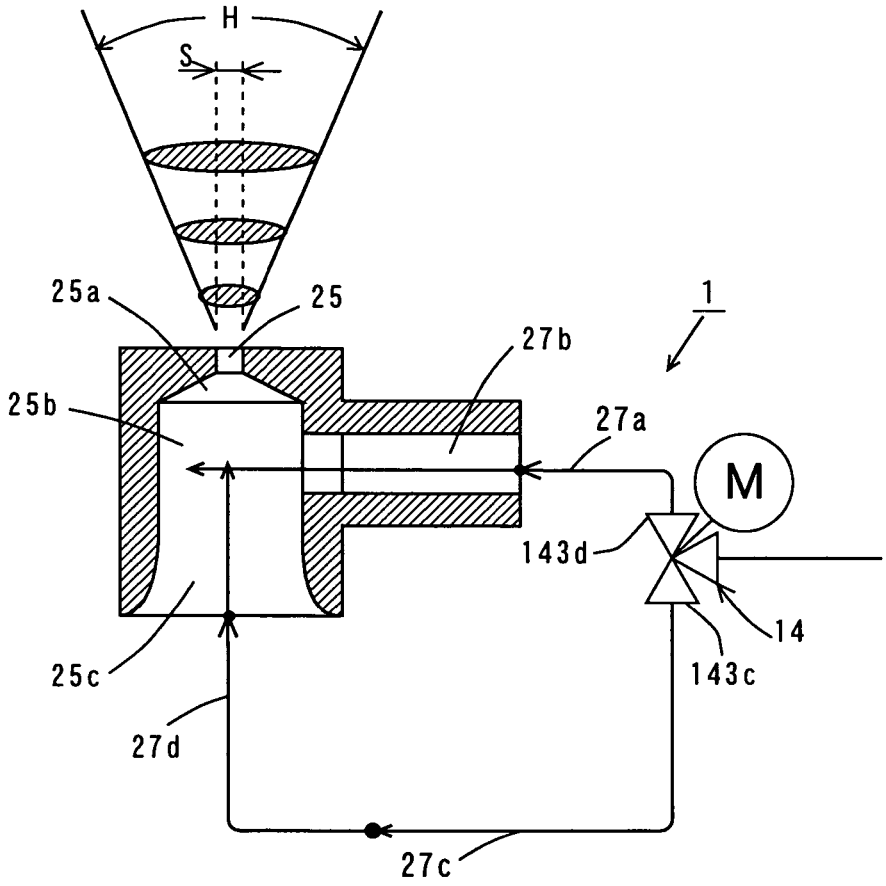
FIG. 20 is a schematic sectional view in a case where a front end of a piston is viewed from a side surface.

FIG. 20 is a schematic sectional view in a case where the front end of the piston 20 is viewed from the side.

As shown in FIG. 20, the flow path 27*d* communicates with the flow-contracting portion 25*c* from below, and the flow path 27*b* communicates with a peripheral surface of the cylindrical swirl chamber 25*b*. The washing water from the washing water outlet 143*c* in the switching valve 14 is supplied to the flow-contracting portion 25*c* through the flow paths 27*c* and 27*d*, and is sprayed as linear flow from the orifice 25 through the cylindrical swirl chamber 25*b* and the flow-contracting portion 25*a*. The washing water from the washing water outlet 143*d* in the switching valve 14 is supplied to the cylindrical swirl chamber 25*b* through the flow paths 27*a* and 27*b*, and is sprayed from the orifice 25 through the flow-contracting portion 25*a*.

The washing water supplied to the cylindrical swirl chamber 25*b* from the flow path 27*b* flows in a swirling state by a curved shape of the inner peripheral surface of the cylindrical swirl chamber 25*b*, to swirl the washing water supplied from the flow path 27*d*, as described in FIG. 19.

In the cylindrical swirl chamber 25*b*, the washing water from the flow path 27*d* is thus swirled by the washing water from the flow path 27*b*, and the swirled washing water is sprayed from the orifice 25.

When the flow rate of the washing water supplied from the flow path 27*b* is higher than the flow rate of the washing water supplied from the flow path 27*d*, for example, the washing water to be mixed in the cylindrical swirl chamber 25*b* is sprayed as dispersed spiral flow at a wider angle as indicated by an arrow H in FIG. 20 because of strong maintainance of the swirling state caused by the curved shape of the cylindrical swirl chamber 25*b*.

On the other hand, when the flow rate of the washing water supplied from the flow path 27*d* is higher than the flow rate of the washing water supplied from the flow path 27*b*, the washing water to be mixed in the cylindrical swirl chamber 29 is sprayed as linear flow at a narrow angle as indicated by an arrow S shown in FIG. 20 because of strong maintenance of the linear state.

Consequently, the controller 4 shown in FIG. 3 controls the motor M in the switching valve 14 to change the ratio of the respective flow rates at the washing water outlets 143*c* and 143*d*, so that the spray form of the washing water sprayed from the orifice 25 is changed.

Since the spiral flow generated in the cylindrical swirl chamber 25*b* is a swirl having little disturbance, as described in FIG. 17, the washing water sprayed from the orifice 25 forms a circle having no irregularities that spreads uniformly as a whole. Further, the sprayed flow of the washing water from the orifice 25 forms a cross section where washing water uniformly exists throughout from its center to outer periphery even when the divergent angle is large, as shown in FIG. 20.

In the first embodiment, when the washing area adjustment switch 302*a* shown in FIG. 2 is pressed, the flow rate of the washing water at the washing water outlet 143*c* is higher than the flow rate of the washing water at the washing water outlet 143*d*, so that the spray form of the washing water approaches linear flow. When the washing area adjustment switch 302*b* is pressed, the flow rate of the washing water at the washing water outlet 143*d* is higher than the flow rate of the washing water at the washing water outlet 143*c*, so that the spray form of the washing water approaches dispersed spiral flow.

For coupling of the one-flow path pipe 403, the flow path merger 404, and so forth, for example, a requirement of airtightness is low because fluid pressure is held by the nozzle cover 401. Consequently, the posterior nozzle 1 can be easily assembled.

Figure 21:
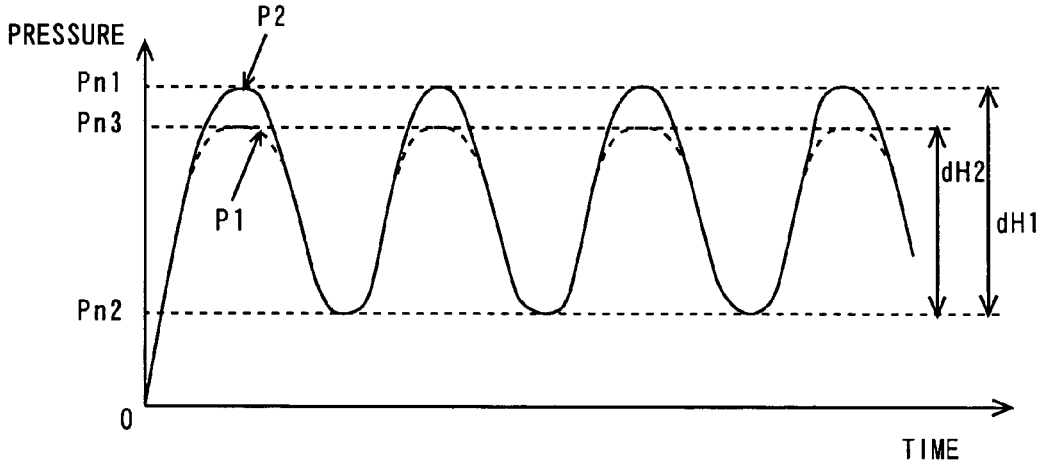
FIG. 21 is a diagram for explaining the width of pressure fluctuations of washing wafer sprayed from a hole of a posterior nozzle.

FIG. 21 is a diagram for explaining the width of pressure fluctuations of washing wafer sprayed from the orifice 25 in the posterior nozzle 1.

A dotted line P1 shown in FIG. 21 indicates the width of pressure fluctuations of washing water in a case where the nozzle cover 401 is formed of a material having elasticity (e.g., plastic). When the nozzle cover 401 in the posterior nozzle 1 is composed of a material having elasticity, the pressure of washing water pressurized by the pump 13 is absorbed by the nozzle cover 401, so that the pressure of the washing water is lowered and the width of pressure fluctuations thereof is reduced.

On the other hand, the nozzle cover 401 in the first embodiment is composed of stainless. Therefore, the pressure of washing water is not absorbed by the nozzle cover 401, so that the width of pressure fluctuations of the washing water is not reduced.

Here, let Pn3 and dH2 be respectively the maximum pressure of washing water and the width of pressure fluctuations thereof in a case where the nozzle cover 401 is formed of a material having elasticity. Letting Pn1 and dH1 be respectively the maximum pressure of washing water and the width of pressure fluctuations thereof in a case where the nozzle cover 401 is formed of stainless, relationships of Pn1>Pn3 and dH1>dH2 hold.

Consequently, pressure applied to the washing water by the pump 13 can be efficiently utilized by composing the nozzle cover 401 of stainless.

For the nozzle cover 401 according to the first embodiment, stainless, having significantly antibacterial properties, containing copper or silver can be also used. Further, a material that is not easily deformed and is integrally moldable can be used. For example, metals other than stainless, for example, copper, aluminum, nickel, and chromium may be used. Alternatively, other alloys may be used.

In the first embodiment, the spray hole 401*a* corresponds to a spray hole, the orifice 25 corresponds to a hole, the flow path 27*a* corresponds to a first flow path, the flow path 27*d* corresponds to a second flow path, the position fixing member 404*c* corresponds to a positioner, the flow path merger 204 corresponds to a spray member, the flow-contracting portion 25*c* corresponds to an opening and a first space, the cylindrical swirl chamber 25*b* corresponds to a second space, the flow-contracting portion 25*a* corresponds to a third space, the nozzle cover 401 corresponds to a cover member, the one-flow path pipe 403 corresponds to a pipe, the O-ring 402*b* corresponds to a sealing member, the pump 13 corresponds to pressure means, the switching valve 14 corresponds to path selection means and flow rate adjustment means, and the ceramic heater 505 corresponds to heating means. The nozzle cover 401 (i.e., cover member) includes a peripheral wall having a cylindrical shape configured to both surround the one-flow path pipe 403 (i.e., the pipe) and extend in the first direction. Further, a front end of the cover member extends in a second direction which is traverse to the first direction. The peripheral wall and the front end of the cover member are integrally formed of a cylindrical metal. Accordingly, the front end of the cover member is closed so as to prevent the washing water from exiting therethrough in the first direction. The peripheral wall of the cover member has an upper surface extending in the first direction and the spray hole is provided on the upper surface.

Second Embodiment

The difference of the configuration of a piston 20*a* in a posterior nozzle 1 in a second embodiment from the configuration of the piston 20 in the posterior nozzle 1 in the first embodiment, together with the function and effect thereof, will be described while referring to the following drawings.

Figure 22:
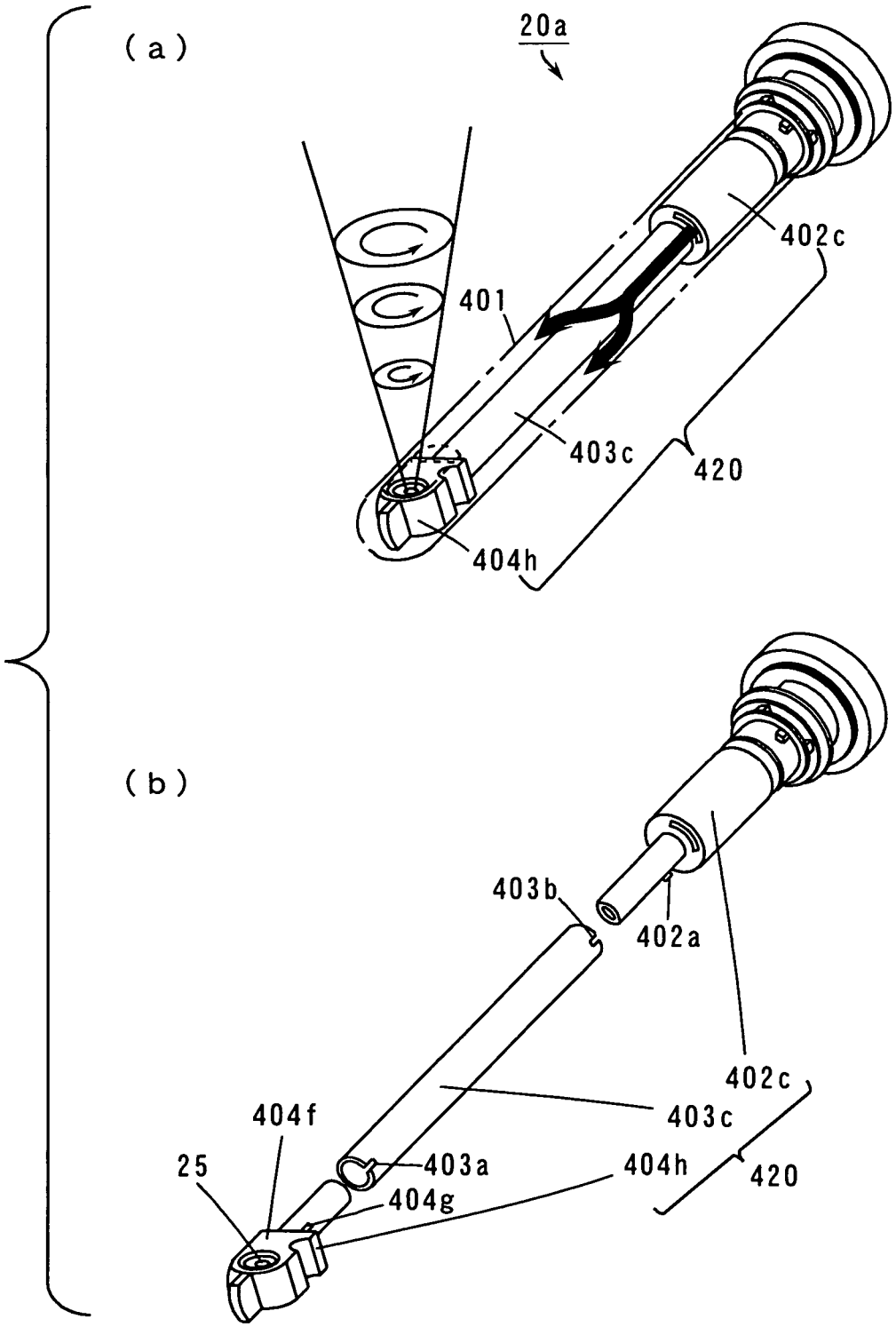
FIG. 22 is a perspective view of a piston in a posterior nozzle and an exploded perspective view of a washing water supply portion in the piston.
Figure 23:
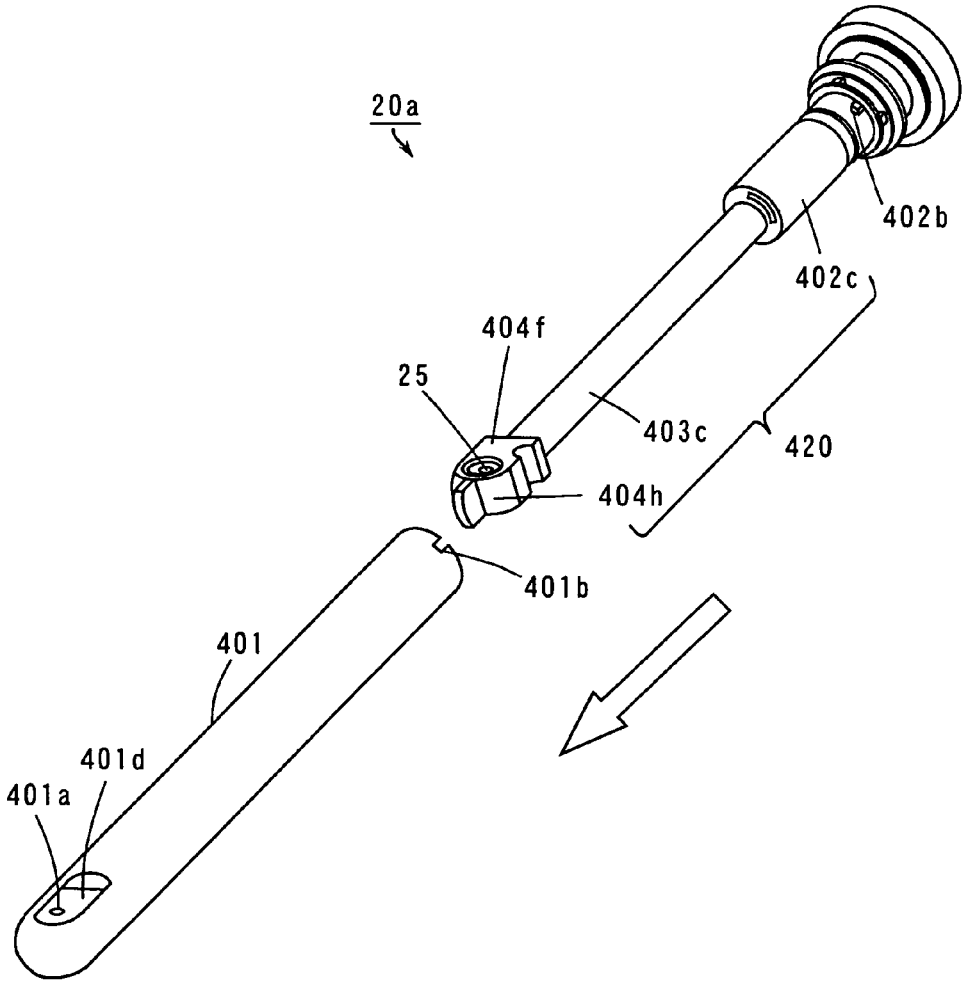
FIG. 23 is an exploded perspective view of a piston in a posterior nozzle.

FIG. 22(*a*) is a perspective view of a piston in a posterior nozzle, and FIG. 22(*b*) is an exploded perspective view of a washing water supply portion in the piston. FIG. 23 is an exploded perspective view of the piston in the posterior nozzle, FIG. 24(*a*) is a side view of the piston 20*a*, and FIG. 24(*b*) is a plan view of the piston 20*a*.

As shown in FIG. 22(*a*), the piston 20*a* comprises a nozzle cover 401 and a washing water supply portion 420. In FIG. 22(*a*), the nozzle cover 401 is indicated by a one-dot and dash line. The washing water supply portion 420 comprises a two-flow path pipe 402*c*, a one-flow path pipe 403*c*, and a flow path merger 404*h*.

As shown in FIG. 22(*b*), a notch 403*a* is provided at one end of the one-flow path pipe 403*c*, and a notch 403*b* is provided at the other end of the one-flow path pipe 403*c*.

The flow path merger 404*h* is provided with an engagement projection 404*g* that is engaged with the notch 403*a*, and the two-flow path pipe 402*c* is provided with an engagement projection 402*a* that is engaged with the notch 403*b*. The flow path merger 404*h* is provided with an orifice 25.

Here, in the flow path merger 404*h*, a surface having the orifice 25 provided thereon is taken as an upper surface, and a surface opposite thereto is taken as a lower surface. A flat portion 404*f* is formed on the upper surface of the flow path merger 404*h*.

The engagement projection 402*a* is engaged with the notch 403*b*, and the engagement projection 404*g* in the flow path merger 404*h* is engaged with the notch 403*a*, so that the two-flow path pipe 402*c*, the one-flow path pipe 403*c*, and the flow path merger 404*h* are integrated, to form the washing water supply portion 420.

As shown in FIG. 23, a notch 401*b* is provided at a rear end of the nozzle cover 401, and an engagement projection 402*b* that is engaged with the notch 401*b* is provided on an outer peripheral surface of the two-flow path pipe 402*c*.

The two-flow path pipe 402*c* has two flow paths through which washing water flows. A rear end of the one-flow path pipe 403*c* is connected to one of the flow paths, and the flow path merger 404*h* is connected to a front end of the one-flow path pipe 403*c*.

The washing water supplied to one of the flow paths in the two-flow path pipe 402*c* is supplied to the flow path merger 404*h* through the one-flow path pipe 403*c*. The washing water supplied to the other flow path in the two-flow path pipe 402*c* is supplied to the flow path merger 404*h* after passing through a space between the one-flow path pipe 403*c* and the nozzle cover 401. The washing water supplied to the flow path merger 404*h* is sprayed toward the human body from a spray hole 401*a*. The washing water sprayed at this time is changed into dispersed spiral flow. The details will be described later.

Figure 24:
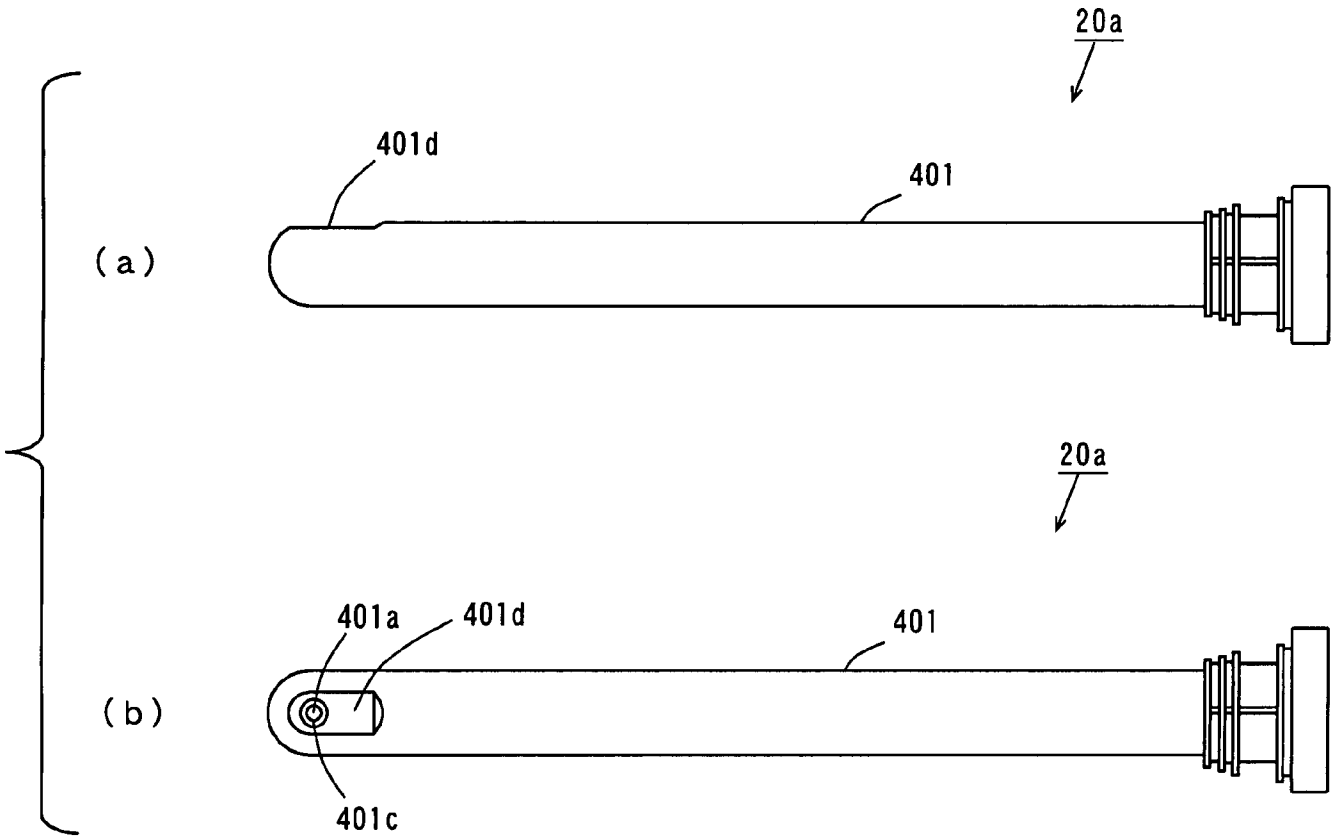
FIG. 24 is a side view of a piston and a plan view of the piston.

As shown in FIG. 23 and FIGS. 24(*a*) and 24(*b*), the nozzle cover 401 has a cylindrical structure whose front end is closed in a substantially hemispherical shape and has an integral structure having no joint.

A flat portion 401*d* is partially formed in the vicinity of a front end of the nozzle cover 401, and the spray hole 401*a* is formed at the center of the flat portion 401*d*. The nozzle cover 401 is formed by subjecting stainless to drawing forming. A circular recess 401*c* is formed in a region including the spray hole 401*a*. The details will be described later.

The washing water supply portion 420 is inserted into the nozzle cover 401, as indicated by an arrow in FIG. 23. Consequently, the flat portion 404*f* in the flow path merger 404*h* is opposed to the flat portion 401*d* in the nozzle cover 401, and the engagement projection 402*b* is engaged with the notch 401*b*, so that the washing water supply portion 420 is positioned in the nozzle cover 401.

Since the nozzle cover 401 has no joint, the nozzle cover 401 is sanitary because dirt is easily washed away even if the dirt adheres thereto. Since stainless has an antibacterial action, no bacteria grow on a surface of the nozzle cover 401.

Since the nozzle cover 401 is composed of stainless, the nozzle cover 401 can be thin-walled while ensuring the strength thereof, thereby achieving miniaturization of the posterior nozzle 1. In this case, even if pressurized washing water is supplied to the nozzle cover 401, the nozzle cover 401 is not deformed. The pipe diameter of the nozzle cover 401 is 10 mm, for example, and the wall thickness thereof is about 0.3 mm, for example.

Furthermore, the nozzle cover 401 is formed by drawing forming. Therefore, the surface thereof is not rough, so that dirt does not easily adhere thereto. The surface of the nozzle cover 401 has a gloss, so that a user feels clean.

Figure 25:
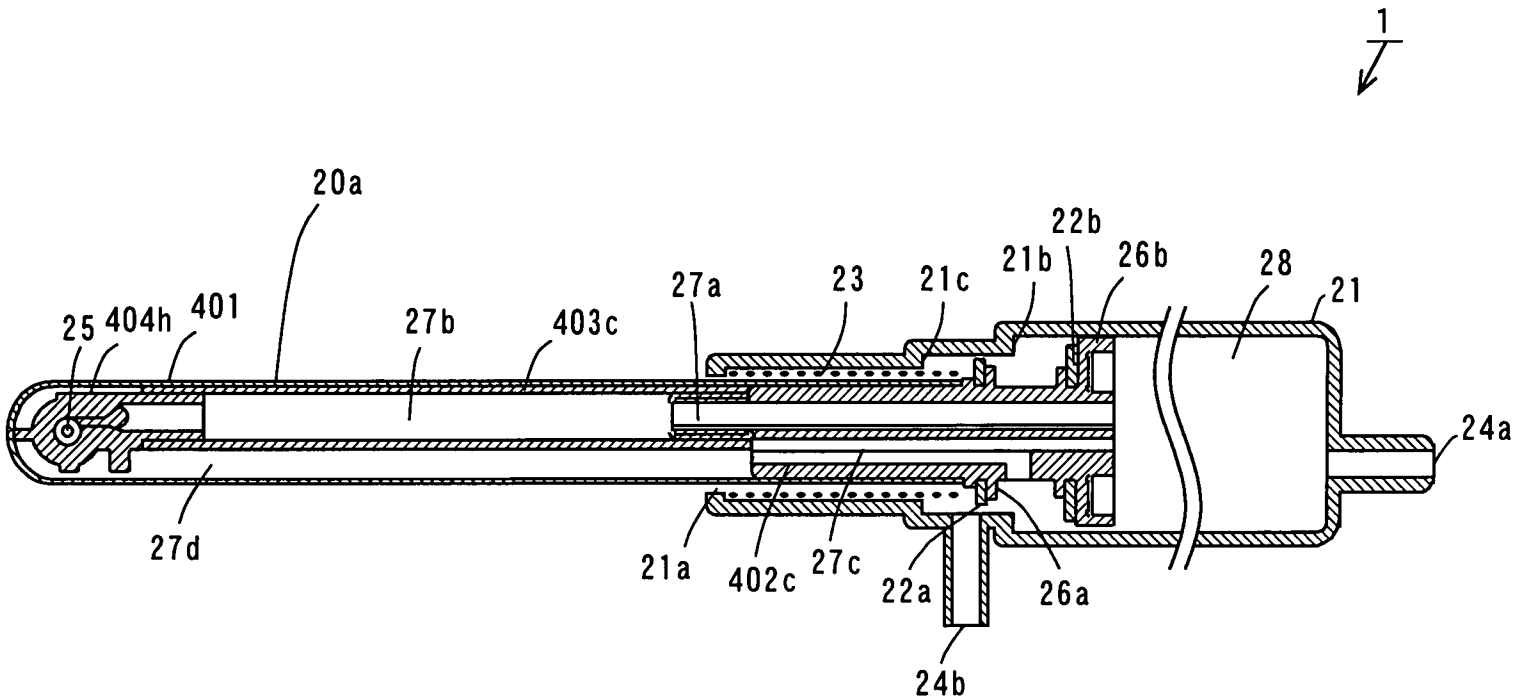
FIG. 25 is a cross-sectional view of a posterior nozzle.

FIG. 25 is a cross-sectional view of the posterior nozzle 1.

As shown in FIG. 25, the posterior nozzle 1 comprises a piston 20*a*, a cylindrical cylinder 21, seal packings 22*a* and 22*b*, and a spring 23.

An orifice 25 for spraying washing water is formed on the upper surface of the flow path merger 404*h*. Flange-shaped stoppers 26*a* and 26*b* are provided at a rear end of the piston 20*a*. Further, the seal packings 22*a* and 22*b* are respectively mounted on the stoppers 26*a* and 26*b*.

Inside the two-flow path pipe 402*c*, a flow path 27*a* communicating with the one-flow path pipe 403*c* from its rear end surface is formed. A flow path 27*c* communicating with a front end surface of the two-flow path pipe 402*c* from a peripheral surface of the piston 20*a* between the stopper 26*a* and the stopper 26*b* is formed.

Inside the one-flow path pipe 403*c*, a flow path 27*b* communicating with the flow path merger 404*h* from the flow path 27*a* in the two-flow path pipe 402*c* is formed. A space between the nozzle cover 401 and the one-flow path pipe 403*c* is a flow path 27*d*. The nozzle cover 401 has high rigidity because it is composed of stainless, so that a pulsating feeling of a fluid can be enhanced. The details of the flow path merger 404*h* will be described later.

On the other hand, the cylinder 21 comprises a small diameter portion at its front end, an intermediate portion having an intermediate diameter, and a large diameter portion at its rear end. Consequently, a stopper surface 21*c* against which the stopper 26*a* in the piston 20*a* can abut through the seal packing 22*a* is formed between the small diameter portion and the intermediate portion, and a stopper surface 21*b* against which the stopper 26*b* in the piston 20*a* can abut through the seal packing 22*b* is formed between the intermediate portion and the large diameter portion.

A washing water inlet 24*a* is provided on a rear end surface of the cylinder 21, a washing water inlet 24*b* is provided on a peripheral surface of the intermediate portion of the cylinder 21, and an opening 21*a* is provided on a front end surface of the cylinder 21. An inner space of the cylinder 21 is a temperature fluctuation buffering space 28. The washing water inlet 24*a* is provided eccentrically at a position different from the central axis of the cylinder 21.

The washing water inlet 24*a* is connected to the washing water outlet 143*c* in the switching valve 14 shown in FIG. 8, and the washing water inlet 24*b* is connected to the washing water outlet 143*d* in the switching valve 14 shown in FIG. 8. When the piston 20*a* projects most greatly from the cylinder 21, the washing water inlet 24*b* communicates with the flow path 27*c* in the two-flow path pipe 403. The details of an operation in a case where the washing water inlet 24*b* is connected to the flow path 27*c* will be described later.

The piston 20*a* is inserted into the cylinder 21 so as to be movable such that the stopper 26*b* is positioned in the temperature fluctuation buffering space 28 and its front end projects from the opening 21*a*.

Furthermore, the spring 23 is disposed between the stopper 26*a* in the piston 20*a* and a peripheral edge of the opening 21*a* in the cylinder 21, to urge the piston 20*a* toward the rear end of the cylinder 21.

A micro-clearance is formed between an outer peripheral surface of the stopper 26*a* or 26*b* in the piston 20*a* and an inner peripheral surface of the cylinder 21, and a micro-clearance is formed between an outer surface of the piston 20*a* and an inner surface of the opening 21*a* in the cylinder 21.

Figure 26:
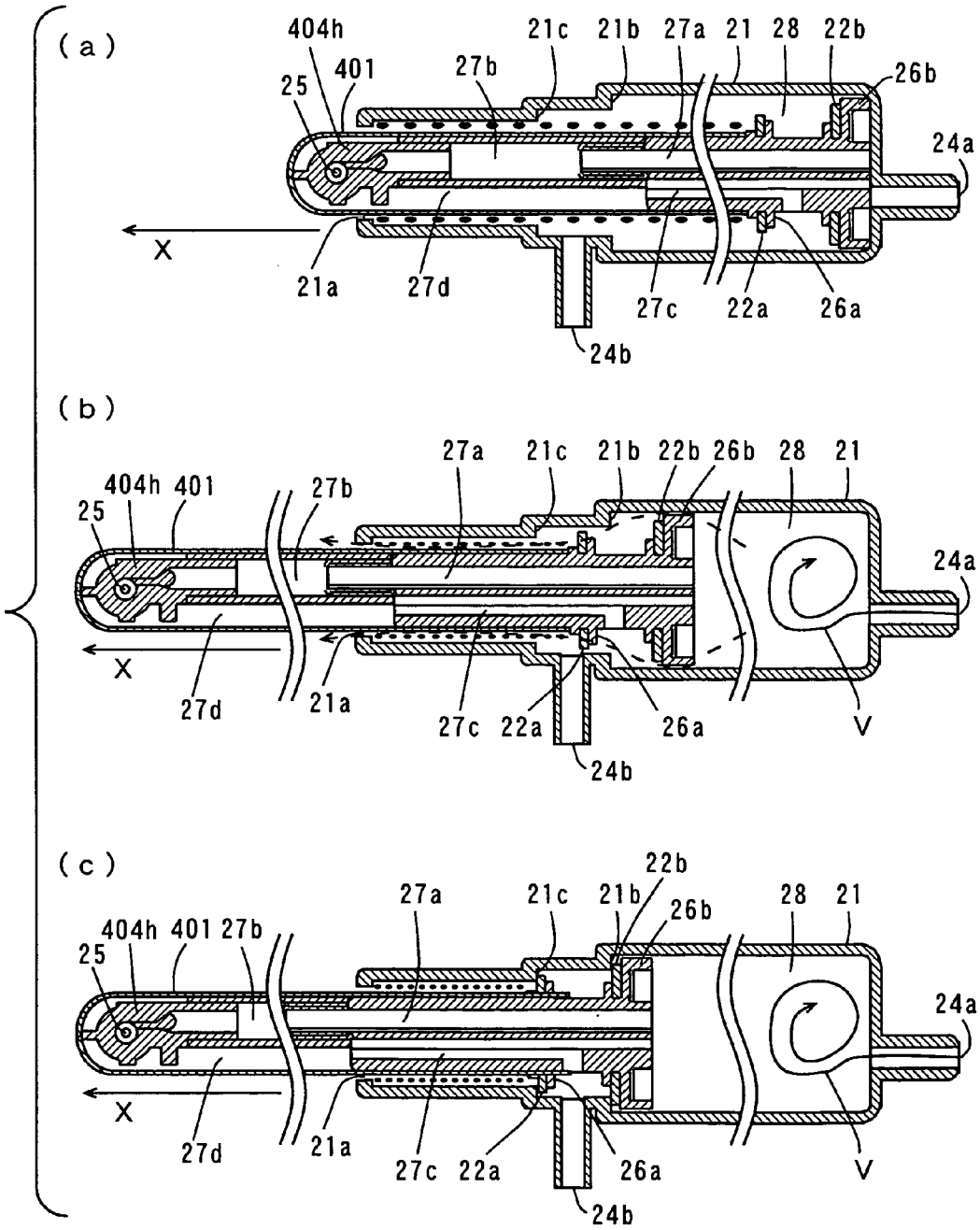
FIG. 26 is a cross-sectional view for explaining the operations of the posterior nozzle shown in FIG. 25.

Description is now made of the operations of the posterior nozzle 1 shown in FIG. 25. FIG. 26 is a cross-sectional view for explaining the operations of the posterior nozzle 1 shown in FIG. 25.

First, when no washing water is supplied from the washing water inlets 24*a* and 24*b* in the cylinder 21, as shown in FIG. 26(*a*), the piston 20*a* retreats in the opposite direction to a direction indicated by an arrow X by the elastic force of the spring 23, and is accommodated in the cylinder 21. As a result, the piston 20*a* enters a state where it does not project most greatly from the opening 21*a* in the cylinder 21. At this time, the temperature fluctuation buffering space 28 is not formed in the cylinder 21.

When the supply of washing water from the washing water inlet 24*a* in the cylinder 21 is then started, as shown in FIG. 26(*b*), the piston 20*a* gradually advances in the direction indicated by the arrow X against the elastic force of the spring 23 by the pressure of the washing water. Consequently, the temperature fluctuation buffering space 28 is formed in the cylinder 21, and the washing water flows into the temperature fluctuation buffering space 28.

Since the washing water inlet 24*a* is provided at a position eccentric from the central axis of the cylinder 21, the washing water that has flown into the temperature fluctuation buffering space 28 flows in a swirling state, as indicated by an arrow V. A part of the washing water in the temperature fluctuation buffering space 28 flows out of the micro-clearance between the outer peripheral surface of the piston 20*a* and the inner peripheral surface of the opening 21*a* in the cylinder 21 through the micro-clearance between the outer peripheral surface of the stopper 26*a* or 26*b* in the piston 20*a* and the inner surface of the cylinder 21, and is supplied to the flow path merger 404*h* through the flow paths 27*a*, 27*b*, 27*c*, and 27*d* in the piston 20*a*, to be slightly sprayed from the orifice 25.

When the piston 20*a* further advances, the stoppers 26*a* and 26*b* are respectively brought into watertight contact with the stopper surfaces 21*c* and 21*b* in the cylinder 21 through the seal packings 22*a* and 22*b*, as shown in FIG. 26(*c*). Consequently, a flow path leading from the micro-clearance between the outer peripheral surface of the stopper 26*a* or 26*b* in the piston 20*a* and the inner surface of the cylinder 21 to the micro-clearance between the outer peripheral surface of the piston 20*a* and the inner surface of the opening 21*a* in the cylinder 21 is blocked off.

Furthermore, the washing water supplied from the washing water inlet 24*b* is supplied to the flow path merger 404*h* through the flow paths 27*c* and 27*d* in the piston 20*a*. Consequently, the washing water supplied to the flow path merger 404*h* through the flow paths 27*a* and 27*b* is mixed with the washing water supplied thereto through the flow paths 27*c* and 27*d*, and obtained mixed washing water is sprayed from the orifice 25.

Figure 27:
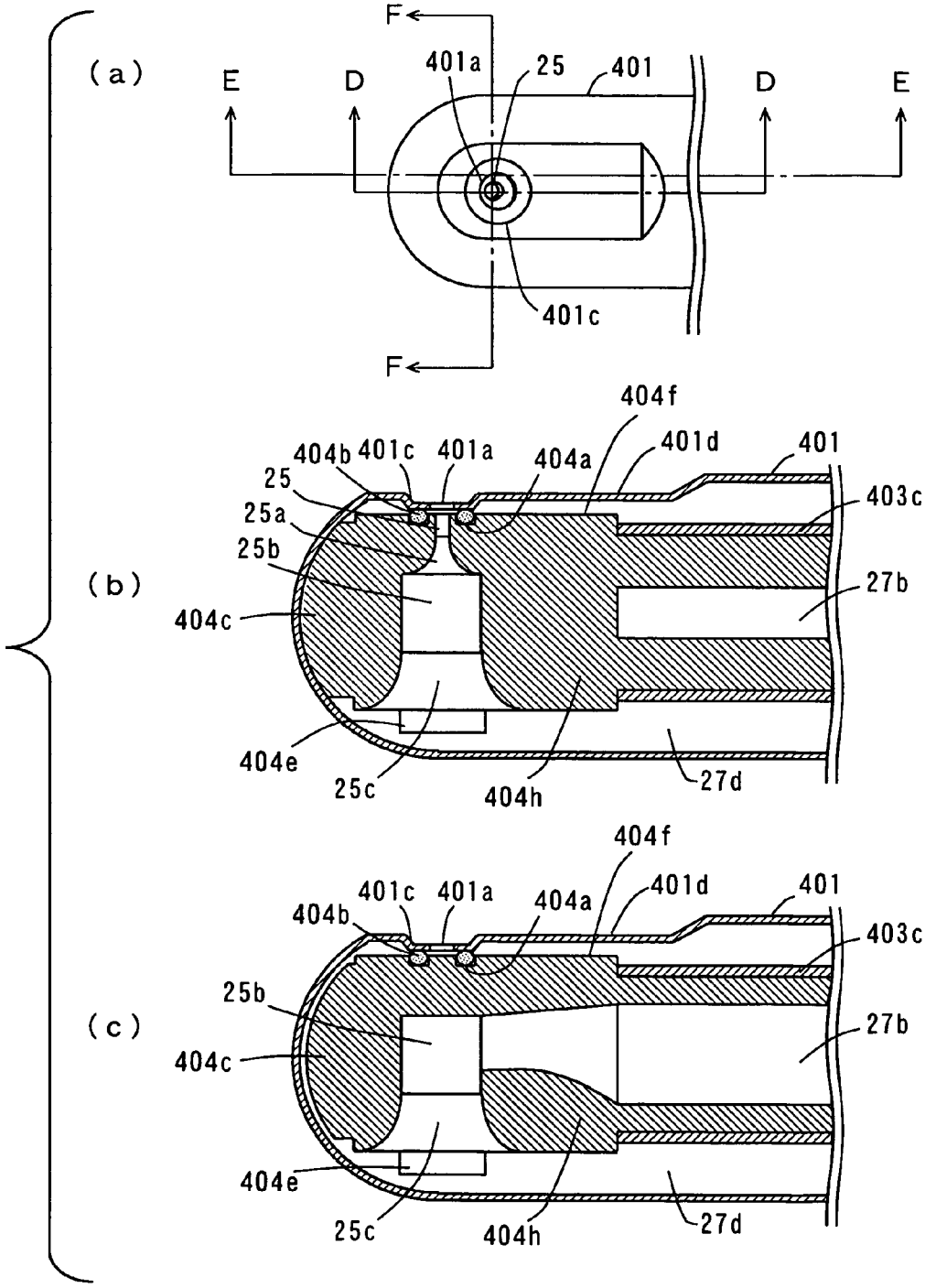
FIG. 27 is a schematic view for explaining a flow path merger.
Figure 28:
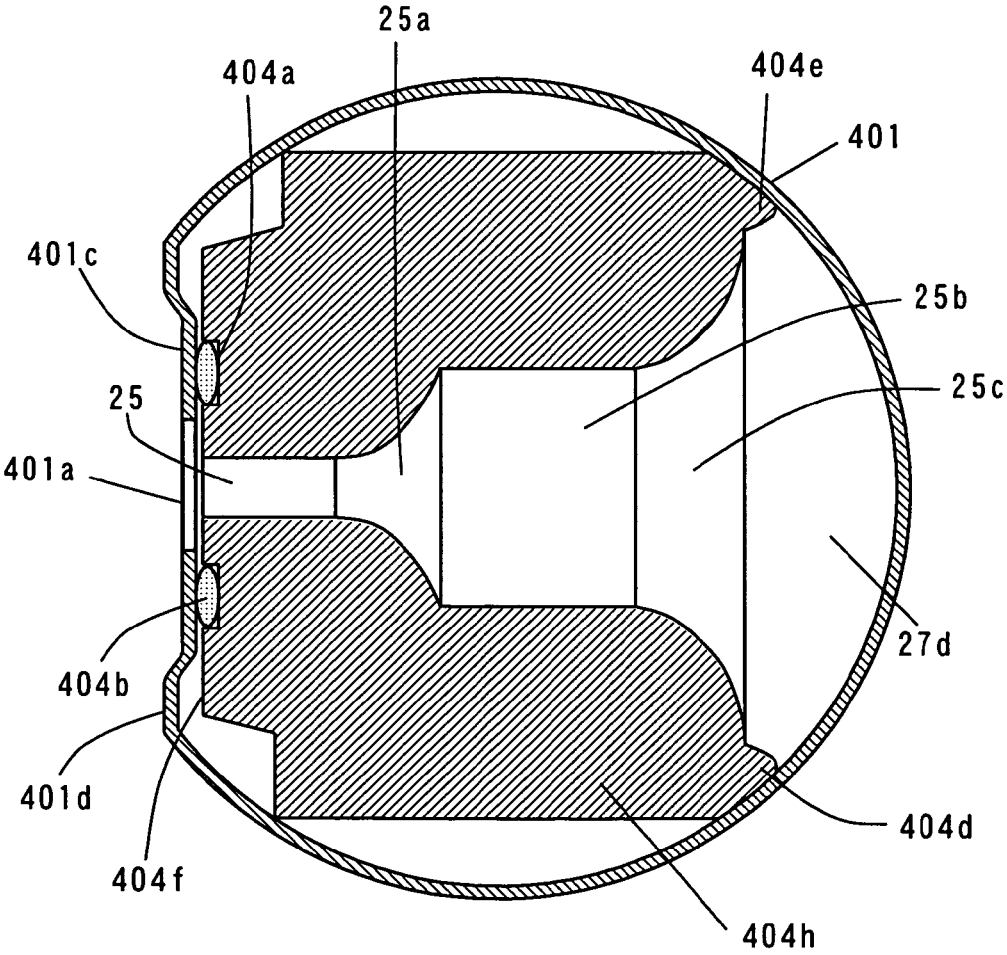
FIG. 28 is a cross-sectional view taken along a line F-F shown in FIG. 27.

FIG. 27 is a diagram for explaining the flow path merger 404*h*. FIG. 27(*a*) is a plan view at a front end of the piston 20*a*, FIG. 27(*b*) is a cross-sectional view taken along a line D-D shown in FIG. 27(*a*), and FIG. 27(*c*) is a cross-sectional view taken along a line E-E shown in FIG. 27(*a*). FIG. 28 is a cross-sectional view taken along a line F-F shown in FIG. 27(*a*).

As shown in FIG. 27(*a*), the spray hole 401*a* is formed such that the diameter thereof is larger than the diameter of the orifice 25. Consequently, the washing water sprayed from the orifice 25 does not strike the spray hole 401*a*, not to prevent the washing water from being sprayed.

As shown in FIG. 27(*b*), an annular groove 404*a* is formed so as to surround the orifice 25 in an upper part of the flow path merger 404*h*, and an O-ring 404*b* is attached to the groove 404*a*. The O-ring 404*b* and an inner surface of the nozzle cover 401 adhere to each other, not to cause the washing water from the flow path 27*d* to flow out of the spray hole 401*a* in the nozzle cover 401. Even if dirt adheres to the front end of the nozzle cover 401, the dirt does not directly enter the flow path 27*d* from the spray hole 401*a*.

Even when dirt enters the orifice 25 from the spray hole 401*a* in the nozzle cover 401, the dirt is immediately discharged by the washing water sprayed from the orifice 25. Consequently, the inside of the nozzle cover 401 is always kept clean.

As described in the foregoing, a circular recess 401*c* is provided in a region including the spray hole 401*a* in the flat portion 401*d* in the nozzle cover 401. The recess 401*c* is formed by inserting the washing water supply portion 420 at a predetermined position within the nozzle cover 401 and then, pressing a circular region having a larger diameter than that of the spray hole 401*a*, centered around the spray hole 410*a*, using a columnar jig or the like. Although the depth of the recess 401*c* is 0.1 to 0.3 mm, for example, it is not limited to the same.

Inside the flow path merger 404*h*, the orifice 25, the flow-contracting portion 25*a*, the cylindrical swirl chamber 25*b*, and the flow-contracting portion 25*c* are formed in this order throughout from its upper end to its lower end of the flow path merger 404*h*.

The washing water in the flow path 27*d* is supplied to the cylindrical swirl chamber 25*b* through the flow-contracting portion 25*c*. The inner diameter of the flow-contracting portion 25*c* continuously decreases toward the cylindrical swirl chamber 25*b*, so that the velocity of flow of the washing water flowing in the flow-contracting portion 25*c* is continuously raised.

The washing water supplied to the cylindrical swirl chamber 25*b* flows into the flow-contracting portion 25*a*. The inner diameter of the flow-contracting portion 25*a* continuously decreases toward the orifice 25, so that the velocity of flow of the washing water flowing in the flow-contracting portion 25*c* is continuously raised. The washing water supplied to the orifice 25 is sprayed toward the human body.

As shown in FIG. 27(*c*), the cylindrical swirl chamber 25*b* and the flow path 27*b* communicate with each other. The washing water supplied from the flow path 27*b* applies a swirling force to the washing water supplied to the cylindrical swirl chamber 25*b* from the flow path 27*d* in the cylindrical swirl chamber 25*b*, to generate spiral flow. A position fixing member 404*c* having a curved shape along an inner surface at the front end of the nozzle cover 410 is formed at the front end of the flow path merger 404*h*. A front end of the position fixing member 404*c* is supported on the inner surface at the front end of the nozzle cover 401 so that the flow path merger 404*h* is axially positioned within the nozzle cover 401.

As shown in FIG. 28, projections 404*d* and 404*e* each having a curved shape along the inner surface of the nozzle cover 401 are provided on both sides of the flow-contracting portion 25*c* on the lower surface of the flow path merger 404*h*.

The projections 404*d* and 404*e* abut against the inner surface of the nozzle cover 401 so as to adhere thereto.

The inner surface of the flat portion 401*d* in the nozzle cover 401 and the flat portion 404*f* in the flow path merger 404*h* are opposed to each other with the O-ring 404*b* interposed therebetween. In this state, the orifice 25 in the flow path merger 404*h* is positioned at a substantially central portion of the spray hole 401*a* in the nozzle cover 401.

In the second embodiment, the inner surface of the flat portion 401*d* in the nozzle cover 401 and the flat portion 404*f* in the flow path merger 404*h* are opposed to each other within the nozzle cover 401, so that the flow path merger 404*h* is positioned in the circumferential direction within the nozzle cover 401.

In this case, the orifice 25 is automatically positioned relative to the spray hole 401*a* only by inserting the washing water supply portion 420 into the nozzle cover 401, so that positioning work becomes easy.

Furthermore, the engagement projection 402*b* provided at the rear end of the two-flow path pipe 402*c* is engaged with the notch 401*b* provided at the rear end of the nozzle cover 401, so that the flow path merger 404*h* is reliably positioned in the circumferential direction within the nozzle cover 401. Further, the engagement projection 404*g* in the flow path merger 404*h* is engaged with the notch 403*a* in the one-flow path pipe 403*c*, and the engagement projection 402*a* in the two-flow path pipe 402*c* is engaged with the notch 403*b* in the one-flow path pipe 403*c*, so that the two-flow path pipe 402*c*, the one-flow path pipe 403*c*, and the flow path merger 404*h* can be prevented from being shifted in the circumferential direction. The front end of the position fixing member 404*c* abuts against the inner surface at the front end of the nozzle cover 401 so that the flow path merger 404*h* is axially positioned within the nozzle cover 401. Further, the projections

404*d* and 404*e* provided in the flow path merger 404*h* abut against the inner surface of the nozzle cover 401, so that the flow path merger 404*h* can be prevented from being shifted within the nozzle cover 401. Consequently, the orifice 25 can be prevented from being shifted from the spray hole 401*a*. As a result, the washing water can be prevented from being scattered by the shift in position of the orifice 25 from the spray hole 401*a*.

In the flat portion 401*d* in the nozzle cover 401, the recess 401*c* is formed in the region including the spray hole 401*a*, thereby making it possible to reinforce the flat portion 401*d*. Consequently, the flat portion 401*d* can be prevented from being deformed by the elasticity of the O-ring 404*b*.

In the second embodiment, the position fixing member 404*c* corresponds to a front end abutment portion, the flow path merger 404*h* corresponds to a spray member, the washing water supply portion 420 corresponds to a pipe, the projections 404*d* and 404*e* correspond to peripheral surface abutment portions, the notch 401*b* corresponds to an engagement portion, the engagement projection 402*b* corresponds to a portion to be engaged, the flat portion 401*d* corresponds to a first flat portion, and the flat portion 404*f* corresponds to a second flat portion.

For the nozzle cover 401 according to the second embodiment, stainless, having significantly antibacterial properties, containing copper or silver can be also used. Further, a material that is not easily deformed and is integrally moldable can be used. For example, metals other than stainless, for example, copper, aluminum, nickel, and chromium may be used. Alternatively, other alloys may be used.

Although in the second embodiment, the recess 401*c* is formed using a jig or the like, the recess 401*c* may not be formed, provided that the flat portion 401*d* is not deformed.

In the second embodiment, the flat portion 401*d* may not be formed, provided that the flow path merger 404*h* is reliably positioned in the circumferential direction within the nozzle cover 401 by the projections 404*d* and 404*e* or the engagement projection 402*b*.

Third Embodiment

The difference of the configuration of a main body in a sanitary washing apparatus according to a third embodiment from the configuration of the main body 200 in the sanitary washing apparatus according to the first embodiment, together with the function and effect thereof, will be described while referring to the following drawings.

Figure 29:
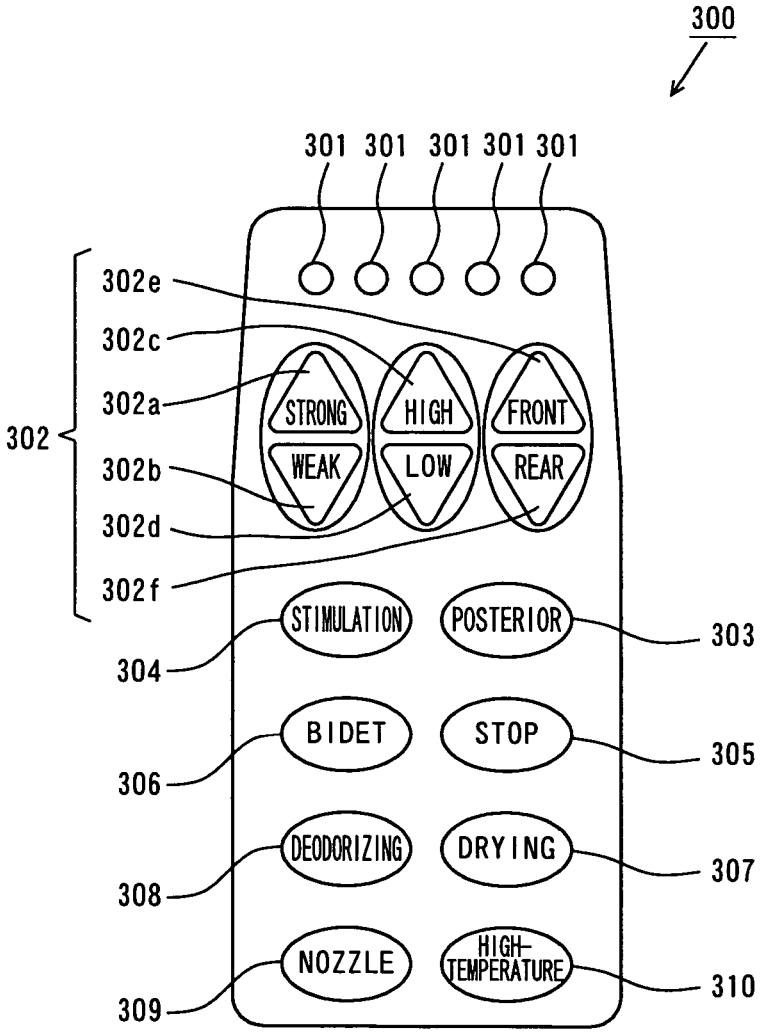
FIG. 29 is a schematic view showing another example of a remote control device shown in FIG. 1.

FIG. 29 is a schematic view showing another example of the remote control device 300 shown in FIG. 1.

As shown in FIG. 29, the remote control device 300 differs from the remote control device 300 shown in FIG. 1 according to the first embodiment in that it further comprises a nozzle cleaning switch 309 and a nozzle high-temperature cleaning switch 310.

A nozzle unit 30 is cleaned using washing water by pressing the nozzle cleaning switch 309, while being cleaned using washing water heated at high temperature by pressing the nozzle high-temperature cleaning switch 310. The details of the cleaning operation of the nozzle unit 30 by pressing the nozzle cleaning switch 309 and the nozzle high-temperature cleaning switch 310 will be described later. The cleaning of the nozzle unit 30 is hereinafter referred to as nozzle cleaning.

The main body 200 in the sanitary washing apparatus 100 according to the third embodiment of the present invention will be described.

Figure 30:
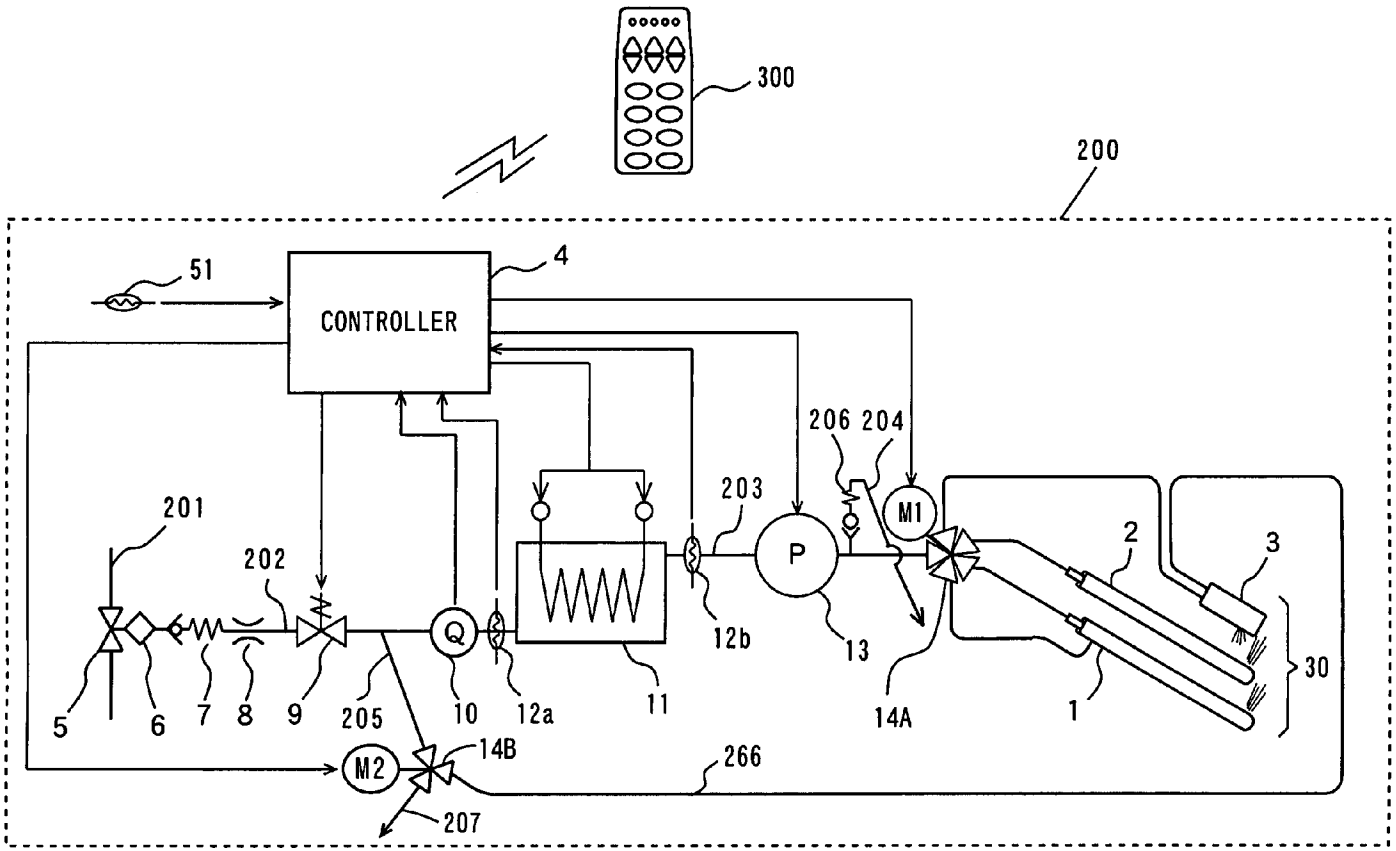
FIG. 30 is a schematic view showing the configuration of a main body in a sanitary washing apparatus according to a third embodiment of the present invention.

FIG. 30 is a schematic view showing the configuration of the main body 200 in the sanitary washing apparatus 100 according to the third embodiment of the present invention.

As shown in FIG. 30, the main body 200 differs from the main body 200 shown in FIG. 3 according to the first embodiment in that it further comprises a seating sensor 51, a relief water switching valve 14B, a relief water path 207, and a supply water path 266. The relief water switching valve 14B comprises a motor M2.

In FIG. 30, the configuration of a motor M1 is the same as the configuration of the motor M shown in FIG. 3, the configuration of a switching valve 14A is the same as the configuration of the switching valve 14 shown in FIG. 3, and the configuration of the relief water switching valve 14B is the same as the configuration of the switching valve 14A.

The relief water switching valve 14B is mounted on the downstream side of a branched pipe 205. The relief water switching valve 14B adjusts the flow rate of washing water to be supplied to the supply water path 266 and the relief water path 207 that are connected to a nozzle cleaning nozzle 3 in the nozzle unit 30 on the basis of a control signal fed by a controller 4. Consequently, a predetermined back pressure is exerted on a pump 13 without being dependent on tap water supply pressure.

In a case where washing water is supplied to a posterior nozzle 1 or a bidet nozzle 2 in the nozzle unit 30, washing water is sprayed from the posterior nozzle 1 or the bidet nozzle 2. On the other hand, in a case where washing water is supplied to the nozzle cleaning nozzle 3 through the switching valve 14A and a case where washing water is supplied to the nozzle cleaning nozzle 3 through the above-mentioned relief water switching valve 14B, the washing water is sprayed from a nozzle cleaning hole provided in the nozzle cleaning nozzle 3. The washing water is sprayed from the nozzle cleaning nozzle 3 to the posterior nozzle 1 and the bidet nozzle 2, so that the posterior nozzle 1 and the bidet nozzle 2 are cleaned. The nozzle cleaning hole in the nozzle cleaning nozzle 3 will be described later.

The temperature of the washing water sprayed from the nozzle cleaning hole in the nozzle cleaning nozzle 3 depends on a pressing operation of the nozzle cleaning switch 309 or the nozzle high-temperature cleaning switch 310 in the remote control device 300. The temperature of the washing water will be described later.

The respective flow rates of the washing water sprayed from the posterior nozzle 1 and the washing water sprayed from the bidet nozzle 2 are adjusted by the switching valve 14A. The flow rate of the washing water sprayed from the nozzle cleaning nozzle 3 is adjusted by the switching valve 14A and the relief water switching valve 14B. The respective flow rates of the washing water sprayed from the posterior nozzle 1, the bidet nozzle 2, and the nozzle cleaning nozzle 3 may be adjusted by changing the driving capability of the pump 13

In the third embodiment, the controller 4 further feeds a control signal to the relief water switching valve 14B on the basis of a signal representing the presence or absence of a user on a toilet seat 400 from the seating sensor 51.

Figure 31:
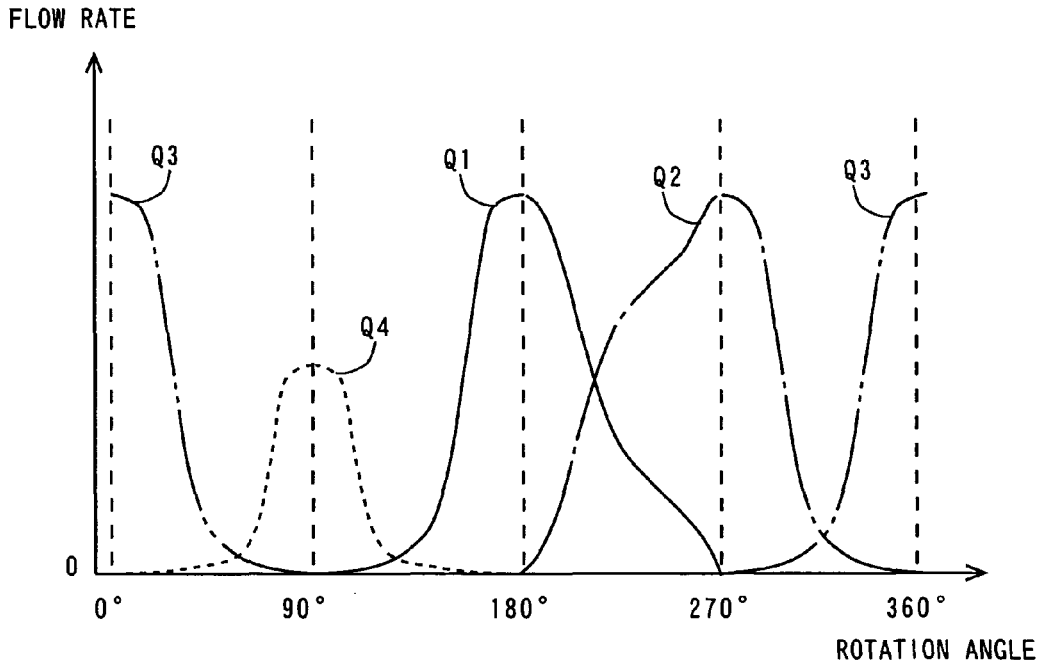
FIG. 31 is a diagram showing the flow rate of washing water flowing into a posterior nozzle from a washing water outlet in a switching valve, the flow rate of washing water flowing into a bidet nozzle from the washing water outlet, and a diagram showing the flow rate of washing water flowing into a nozzle cleaning nozzle from the washing water outlet.

FIG. 31 is a diagram showing the flow rate of washing water flowing out into the posterior nozzle 1 from washing water outlets 143*c* and 143*d* in the switching valve 14A, the flow rate of washing water flowing out into the bidet nozzle 2 from a washing water outlet 143*b*, and the flow rate of washing water flowing out into the nozzle cleaning nozzle 3 form a washing water outlet 143*e*.

In FIG. 31, the horizontal axis indicates the rotation angle of the motor M1, and the vertical axis indicates an example of the respective flow rates of washing water flowing out of the washing water outlets 143*b* to 143*e*. A solid line Q1 indicates the change in the flow rate of the washing water flowing out into the posterior nozzle 1 from the washing water outlet 143*c*, a one-dot and dash line Q2 indicates the change in the flow rate of the washing water flowing out into the posterior nozzle 1 form the washing water outlet 143*d*, a two-dot and dash line Q3 indicates the change in the flow rate of the washing water flowing out into the bidet nozzle 2 form the washing water outlet 143*b*, and a broken line Q4 indicates the change in the flow rate of the washing water flowing out into the nozzle cleaning nozzle 3 from the washing water outlet 143*e* through a heat exchanger 11.

When the motor M1 is not rotated (rotated through an angle of zero), as shown in FIG. 31, for example, the flow rate Q3 of the washing water flowing out into the bidet nozzle 2 from the washing water outlet 143*b* takes the maximum value. As the rotation angle of the motor M1 increases, the flow rate Q3 of the washing water flowing out into the bidet nozzle 2 from the washing water outlet 143*e* decreases, and the flow rate Q4 of the washing water flowing out into the nozzle cleaning nozzle 3 from the washing water outlet 143*e* increases.

When the motor M1 is further rotated through 90 degrees, the flow rate Q4 of the washing water flowing out into the nozzle cleaning nozzle 3 from the washing water outlet 143*e* takes the maximum value. As the rotation angle of the motor M1 further increases, the flow rate Q4 of the washing water flowing out into the nozzle cleaning nozzle 3 from the washing water outlet 143*e* decreases, and the flow rate Q1 of the washing water flowing out into a first flow path in the posterior nozzle 1 from the washing water outlet 143*c* increases.

When the motor M1 is then rotated through 180 degrees, the flow rate Q1 of the washing water flowing out into the first flow path in the posterior nozzle 1 from the washing water outlet 143*c* takes the maximum value. As the rotation angle of the motor M1 further increases, the flow rate Q1 of the washing water flowing out into the first flow path in the posterior nozzle 1 from the washing water outlet 143*c* decreases, and the flow rate Q2 of the washing water flowing out into a second flow path in the posterior nozzle 1 from the washing water outlet 143*d* increases.

Furthermore, when the motor M1 is rotated through 270 degrees, the flow rate Q2 of the washing water flowing out into a second flow path in the posterior nozzle 1 from the washing water outlet 143*d* takes the maximum value. As the rotation angle of the motor M1 further increases, the flow rate Q2 of the washing water flowing out into the second flow path in the posterior nozzle 1 from the washing water outlet 143*d* decreases, and the flow rate Q3 of the washing water flowing out into the bidet nozzle 2 from the washing water outlet 143*b* increases.

As described in the foregoing, the controller 4 controls the rotation angle of the motor M1 in the switching valve 14A, thereby making it possible to control the flow rates of the washing water flowing out of the washing water outlets 143*b* to 143*e*. Further, whatever angle is the rotation angle of the motor M1 in the switching valve 14A, any one of the washing water outlets 142*e*, 142*f*, and 142*g* or a chamfer (recess) around the washing water outlet is opposed to any one of the washing water outlets 143*b* to 143*e*. Accordingly, the flow path of the washing water is not closed, so that the washing water supplied from the washing water inlet 143*a* flows out of any one of the washing water outlets 143*b* to 143*e*.

The relief water switching valve 14B comprises a motor M2, an inner cylinder, and an outer cylinder, similarly to the configuration of the switching valve 14A. However, an outer cylinder of the relief water switching valve 14B is provided with one washing water inlet and two washing water outlets. Washing water is supplied from the branched pipe 205 to the one washing water inlet in the relief water switching valve 14B.

The relief water path 207 is connected to one of the two washing water outlets in the relief water switching valve 14B, and the nozzle cleaning nozzle 3 in the nozzle unit 30 is connected to the other washing water outlet through the supply water path 266.

Similarly to the switching valve 14A, the motor M2 in the relief water switching valve 14B performs a rotating operation on the basis of the control signal fed by the controller 4. The motor M2 is rotated so that an inner cylinder of the relief water switching valve 14B is rotated, and the washing water introduced into the branched pipe 205 is supplied to either one of the relief water path 207 and the supply water path 266 or is distributed at an arbitrary ratio.

The nozzle unit 30 in the third embodiment will be described while referring to the drawings.

Figure 32:
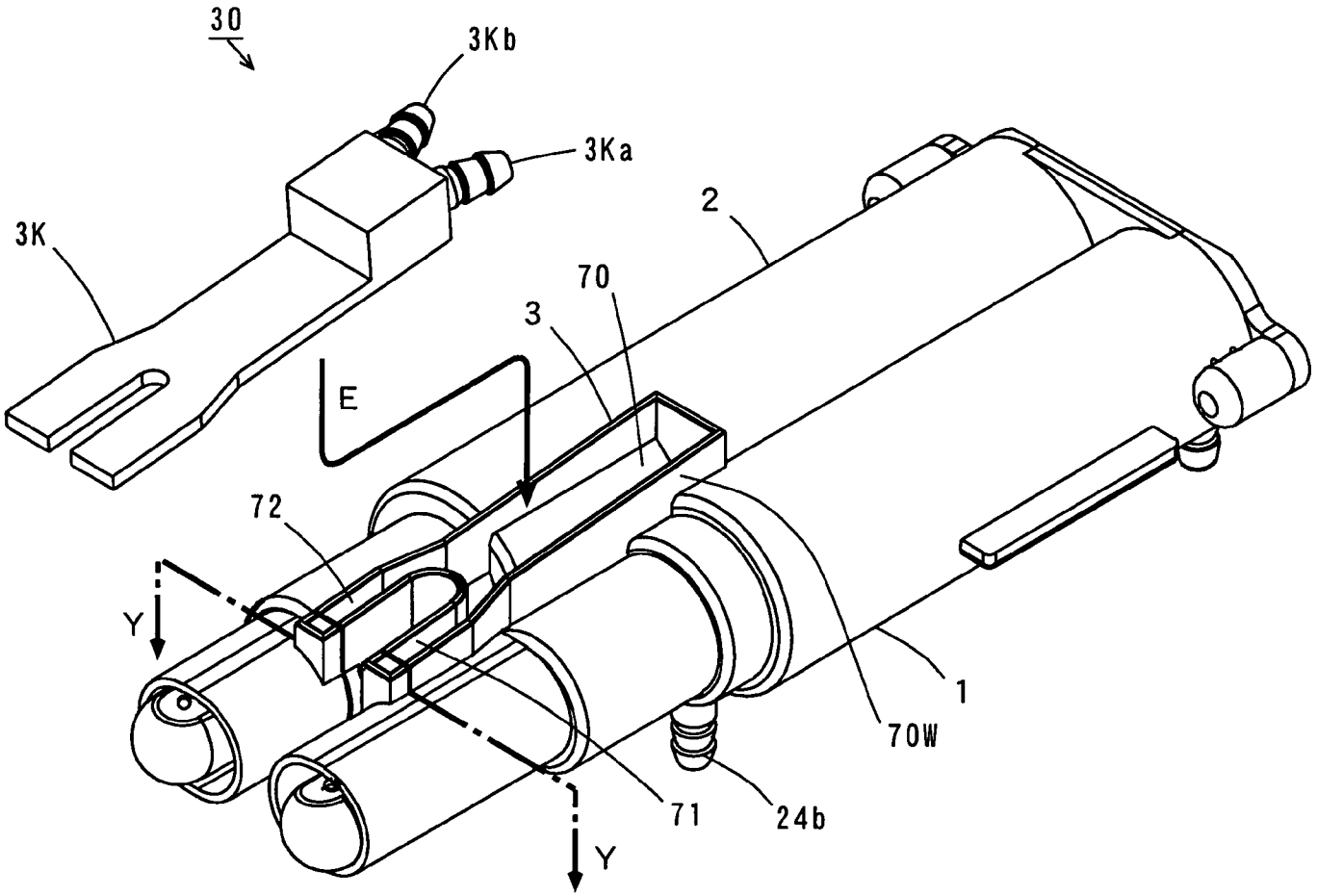
FIG. 32 is a schematic view showing the appearance of a nozzle unit shown in FIG. 1.

FIG. 32 is a perspective view showing the appearance of the nozzle unit 30 shown in FIG. 1. In FIG. 32, the posterior nozzle 1 and the bidet nozzle 2 each having a cylindrical shape are provided parallel to each other so as to be adjacent to each other. A nozzle cleaning nozzle 3 is provided on respective upper surfaces of the posterior nozzle 1 and the bidet nozzle 2 so as to cross the boundary between the posterior nozzle 1 and the bidet nozzle 2. The nozzle cleaning nozzle 3 is positioned at respective front ends of the posterior nozzle 1 and the bidet nozzle 2.

Here, the nozzle cleaning nozzle 3 comprises a sidewall 70W and a sealing member 3K that are formed integrally with the posterior nozzle 1 and the bidet nozzle 2. The sealing member 3K is mounted on an upper surface of the sidewall 70W (an arrow E in FIG. 32), so that a washing water introduction space 70, a first nozzle cleaning flow path 71, and a second nozzle cleaning flow path 72 are formed.

The washing water introduction space 70 communicates with the exterior through through-holes respectively provided in washing water introduction members 3Ka and 3Kb positioned at a rear end of the sealing member 3K. The first nozzle cleaning flow path 71 and the second nozzle cleaning flow path 72 into which the washing water introduction space 70 branches off are respectively positioned on the upper surface of the posterior nozzle 1 and the upper surface of the bidet nozzle 2.

A tube (not shown) or the like is attached to the washing water introduction members 3Ka and 3Kb in the sealing member 3K. The washing water introduction members 3Ka and 3Kb are respectively connected to the washing water outlet of the relief water switching valve 14B shown in FIG. 30 and the washing water outlet 143*e* of the switching valve 14A through the tube. Consequently, washing water is supplied to the nozzle cleaning nozzle 3 through the tube.

Figure 33:
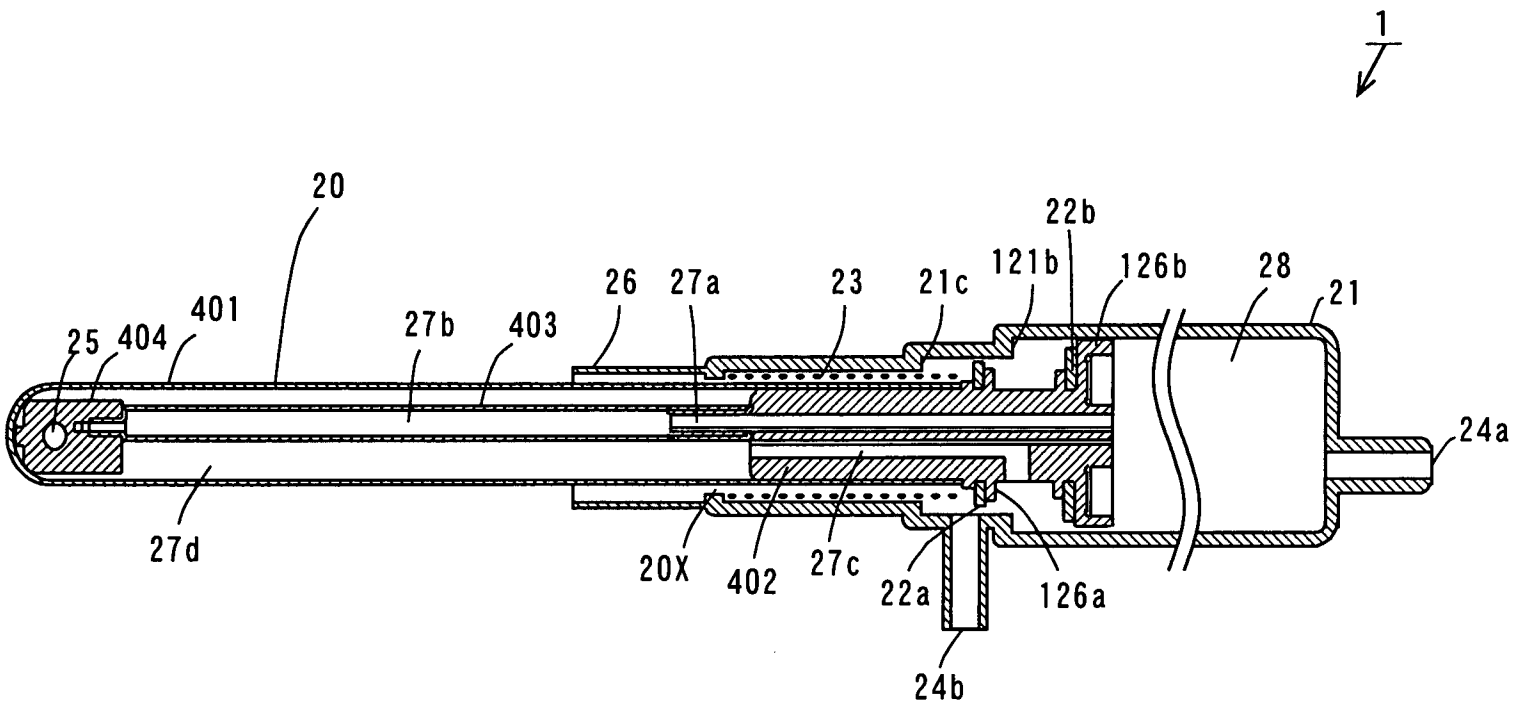
FIG. 33 is a transverse sectional view in the axial direction of a posterior nozzle shown in FIG. 32.

FIG. 33 is a transverse sectional view in the axial direction of the posterior nozzle shown in FIG. 32. Although the posterior nozzle 1 does not project in FIG. 32, a transverse sectional view in a case where the posterior nozzle 1 projects is herein illustrated.

As shown in FIG. 33, the posterior nozzle 1 comprises a piston 20, a cylindrical cylinder 21, seal packings 22*a* and 22*b*, and a spring 23.

An orifice 25 for spraying washing water is formed on an upper surface of a flow path merger 404. Flange-shaped stoppers 126*a* and 126*b* are provided at a rear end of the piston 20. Further, the seal packings 22*a* and 22*b* are respectively mounted on the stoppers 126*a* and 126*b*.

Inside a two-flow path pipe 402, a flow path 27*a* communicating with a one-flow path pipe 403 from its rear end surface is formed, and a flow path 27*c* communicating with a front end surface of the two-flow path pipe 402 from a peripheral surface of the piston 20 between the stopper 126*a* and the stopper 126*b* is formed.

Inside the one-flow path pipe 403, a flow path 27*b* communicating with the flow path merger 404 from the flow path 27*a* in the two-flow path pipe 402 is formed. A space between a nozzle cover 401 and the one-flow path pipe 403 is changed into a flow path 27*d*. The details of the flow path merger 404 will be described later.

On the other hand, the cylinder 21 comprises a small diameter portion at its front end, an intermediate portion having an intermediate diameter, and a large diameter portion at its rear end. Consequently, a stopper surface 21*c* against which the stopper 126*a* in the piston 20 can abut through the seal packing 22*a* is formed between the small diameter portion and the intermediate portion, and a stopper surface 121*b* against which the stopper 126*b* in the piston 20 can abut through the sealing packing 22*b* is formed between the intermediate portion and the large diameter portion.

A washing water inlet 24*a* is provided on a rear end surface of the cylinder 21, and a washing water inlet 24*b* is provided on a peripheral surface of the intermediate portion of the cylinder 21. Although the washing water inlet 24*b* does not appear on a transverse section shown in FIG. 32, it is illustrated in FIG. 33 for easy description. An opening 20X is provided at a front end of the cylinder 21, and a nozzle cleaning cylinder 26 formed in a substantially cylindrical shape is integrally formed. An inner space of the cylinder 21 is a temperature fluctuation buffering space 28. The washing water inlet 24*a* is provided eccentrically at a position different from the central axis of the cylinder 21.

The washing water inlet 24*a* is connected to the washing water outlet 143*c* in the switching valve 14A, and the washing water inlet 24*b* is connected to the washing water outlet 143*d* in the switching valve 14A. When the piston 20 projects most greatly from the cylinder 21, the washing water inlet 24*b* communicates with the flow path 27*c* in the two-flow path pipe 403. The details of operations in a case where the washing water inlet 24*b* is connected to the flow path 27*c* will be described later.

The piston 20 is inserted into the cylinder 21 so as to be movable such that the stopper 126*b* is positioned in the temperature fluctuation buffering space 28 and the front end projects from the opening 20X.

Furthermore, the spring 23 is disposed between the stopper 126*a* in the piston 20 and a peripheral edge of the opening 20X in the cylinder 21, to urge the piston 20 toward the rear end of the cylinder 21.

A micro-clearance is formed between an outer peripheral surface of the stopper 126*a* or 126*b* in the piston 20 and an inner peripheral surface of the cylinder 21, and a micro-clearance is formed between an outer peripheral surface of the piston 20 and an inner peripheral surface of the opening 20X in the cylinder 21.

Figure 34:
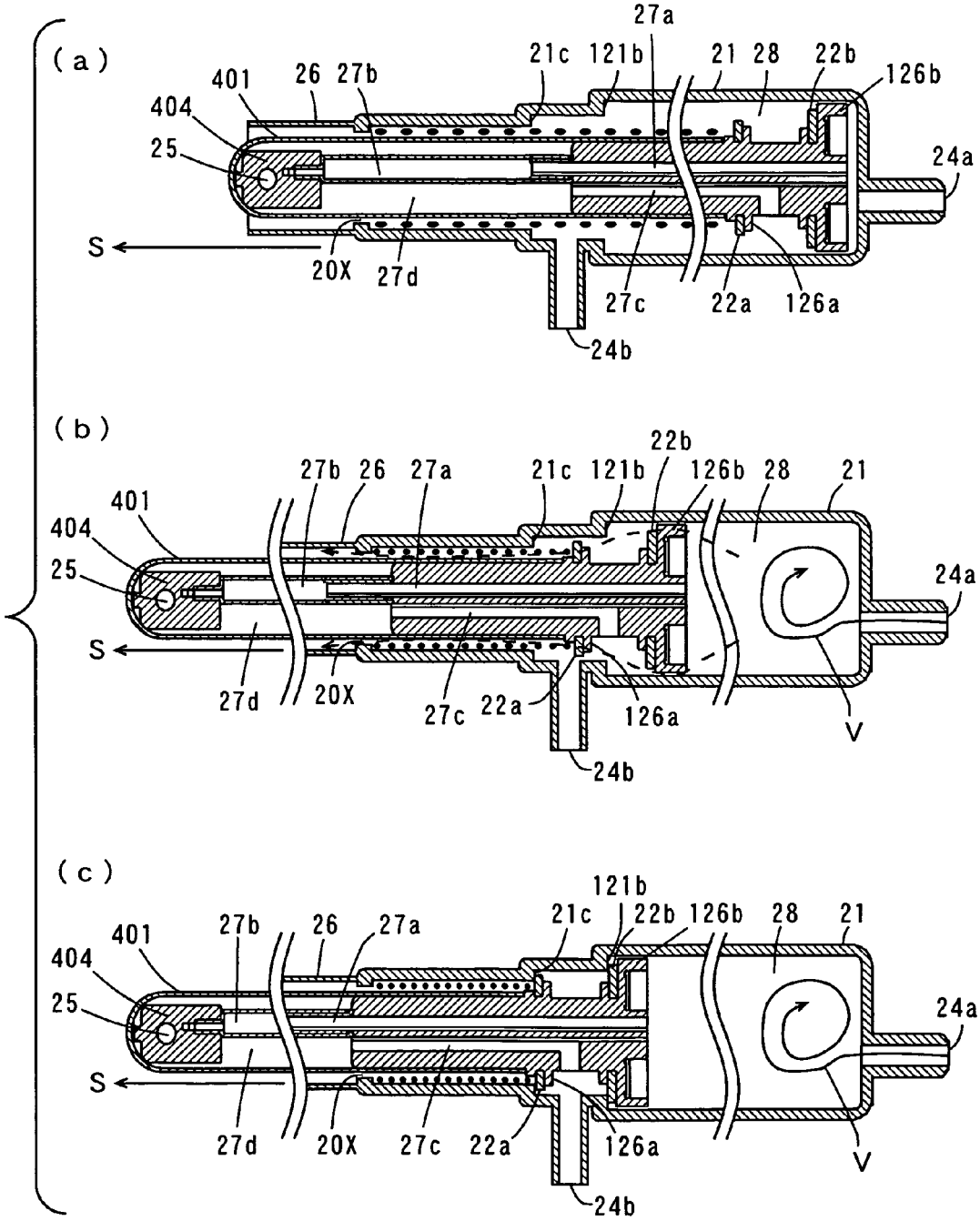
FIG. 34 is a transverse sectional view for explaining the operations of the posterior nozzle shown in FIG. 33.

Description is now made of the operations of the posterior nozzle 1 shown in FIG. 33. FIG. 34 is a transverse sectional view for explaining the operations of the posterior nozzle 1 shown in FIG. 33. Here, a cross-sectional shape of the washing water inlet 24*b* that does not appear on a transverse section is illustrated for easy description, as in FIG. 33.

First, when no washing water is supplied from the washing water inlet 24*a* and 24*b* in the cylinder 21, as shown in FIG. 34(*a*), the piston 20 retreats in the opposite direction to a direction indicated by an arrow S by the elastic force of the spring 23, and is accommodated in the cylinder 21. As a result, the piston 20 enters a state where it does not project most greatly from the opening 20X in the cylinder 21. At this time, the temperature fluctuation buffering space 28 is not formed in the cylinder 21.

Then, when the supply of washing water from the washing water inlet 24*a* in the cylinder 21 is started, as shown in FIG. 34(*b*), the piston 20 gradually advances in the direction indicated by the arrow S against the elastic force of the spring 23 by the pressure of the washing water. Consequently, the temperature fluctuation buffering space 28 is formed in the cylinder 21, and the washing water flows into the temperature fluctuation buffering space 28.

Since the washing water inlet 24*a* is provided at a position eccentric from the central axis of the cylinder 21, the washing water flowing into the temperature fluctuation buffering space 28 flows in a swirling state, as indicated by an arrow V. A part of the washing water in the temperature fluctuation buffering space 28 flows out of the micro-clearance between the outer peripheral surface of the piston 20 and the inner peripheral surface of the opening 20X in the cylinder 21 through the micro-clearance between the outer peripheral surface of the stopper 126*a* or 126*b* in the piston 20 and the inner peripheral surface of the cylinder 21, and is supplied to the flow path merger 404 through the flow paths 27*a*, 27*b*, 27*c*, and 27*d* in the piston 20, to be slightly sprayed from the orifice 25.

When the piston 20 further advances, the stoppers 126*a* and 126*b* are respectively brought into watertight contact with the stopper surfaces 121*c* and 121*b* in the cylinder 21 through the seal packings 22*a* and 22*b*, as shown in FIG. 34(*c*). Consequently, a flow path leading from the micro-clearance between the outer peripheral surface of the stopper 126*a* or 126*b* in the piston 20 and the inner peripheral surface of the cylinder 21 to the micro-clearance between the outer peripheral surface of the piston 20 and the inner peripheral surface of the opening 20X in the cylinder 21 is blocked off.

Furthermore, the washing water supplied from the washing water inlet 24*b* is supplied to the flow path merger 404 through the flow paths 27*c* and 27*d* in the piston 20. Consequently, the washing water supplied to the flow path merger 404 through the flow paths 27*a* and 27*b* is mixed with the washing water supplied thereto through the flow paths 27*c* and 27*d*, and obtained mixed washing water is sprayed from the orifice 25. Here, a spray hole 401*a* at the front end of the nozzle cover 401 has a larger inner diameter than the orifice 25. Consequently, the washing water sprayed from the orifice 25 does not strike the spray hole 401*a*, not to prevent the washing water from being sprayed.

A nozzle cover in the bidet nozzle 2 is also composed of stainless, similarly to the nozzle cover 401 in the posterior nozzle 1. The detailed configuration and operations of the bidet nozzle 2 are not repeated.

The posterior nozzle 1 is cleaned by spraying the washing water from the nozzle cleaning nozzle 3 in a state where the piston 20 is accommodated in the cylinder 21. The cleaning of the bidet nozzle 2 is also done, similarly to the cleaning of the posterior nozzle 1.

Figure 35:
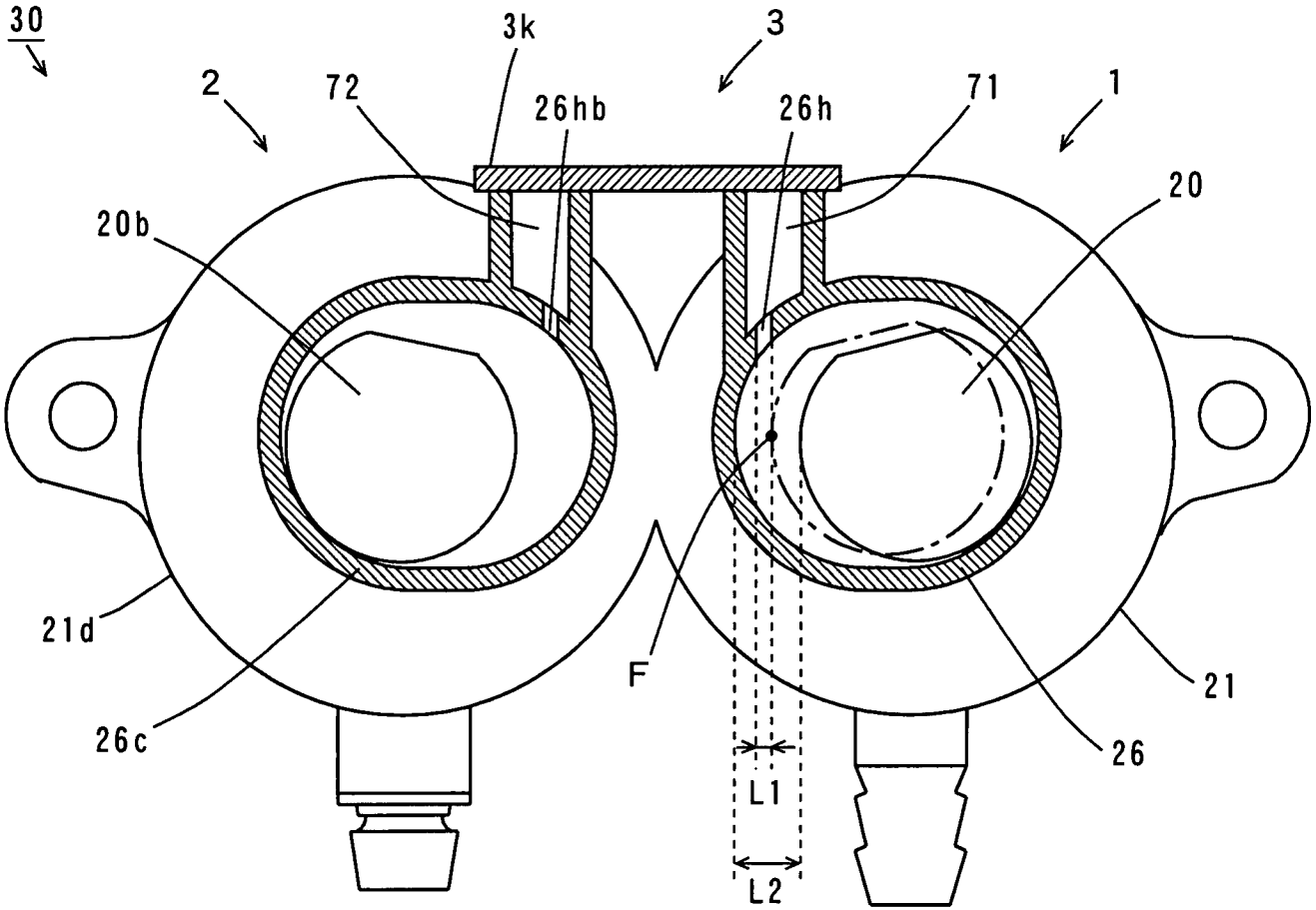
FIG. 35 is a cross-sectional view taken along a line Y-Y of a nozzle unit shown in FIG. 32.

FIG. 35 is a cross-sectional view taken along a line Y-Y of the nozzle unit 30 shown in FIG. 32. In FIG. 35, the details of the cross-sectional shapes of the piston 20 in the posterior nozzle 1 and a piston 20*b* in the bidet nozzle 2 and the appearance of the cylinder 21 in the posterior nozzle 1 and the cylinder 21*d* in the bidet nozzle 2 are omitted in order to make the cross-sectional shapes of the nozzle cleaning cylinder 26 in the posterior nozzle 1, the nozzle cleaning cylinder 26*c* in the bidet nozzle 2, and the nozzle cleaning nozzle 3 clearer.

As shown in FIG. 35, the pistons 20 and 20*b* are respectively accommodated in the nozzle cleaning cylinders 26 and 26*c*. The respective cross sections of the nozzle cleaning cylinders 26 and 26*c* are formed in a substantially circular shape, and the inner diameters of the nozzle cleaning cylinders 26 and 26*c* are larger than the outer diameters of the pistons 20 and 20*b* formed in a substantially circular shape. When the nozzle cleaning cylinders 26 and 26*c* are elliptical, the minimum inner diameter of the nozzle cleaning cylinders 26 and 26*c* is set so as to be larger than the maximum outer diameter of the pistons 20 and 20*b*.

A nozzle cleaning hole 26*h* is provided on an upper surface, on the side of the bidet nozzle 2, of the nozzle cleaning cylinder 26. A nozzle cleaning hole 26*hb* is provided on an uppers surface, on the side of the posterior nozzle, 1, of the nozzle cleaning cylinder 26*c*. The nozzle cleaning cylinders 26 and 26*c* are thus respectively provided with the nozzle cleaning holes 26*h* and 26*hb*.

Here, letting L2 be the difference between the inner diameter of the nozzle cleaning cylinder 26 and the outer diameter of the piston 20 and letting L1 be the diameter of the nozzle cleaning hole 26*h*, a relationship of L1<L2 holds between L1 and L2.

When the nozzle cleaning cylinders 26 and 26*c* are elliptical, however, the diameter L1 of the nozzle cleaning hole 26*h* is set so as to be smaller than the difference L2 between the minimum inner diameter of the nozzle cleaning cylinder 26 and the outer diameter of the piston 20.

The same relationship also holds between the difference between the inner diameter of the nozzle cleaning cylinder 26*c* and the outer diameter of the piston 20*b* and the nozzle cleaning hole 26*hb*.

The first nozzle cleaning flow path 71 and the second cleaning flow path 72 respectively communicate with inner parts of the nozzle cleaning cylinders 26 and 26*c* by the nozzle cleaning holes 26*h* and 26*hb*. The washing water introduction space 70 shown in FIG. 32 branches off into the first nozzle cleaning flow path 71 and the second nozzle cleaning flow path 72, as described above. The first nozzle cleaning flow path 71 and the second nozzle cleaning flow path 72 respectively spray washing water supplied from the washing water introduction space 70 into the nozzle cleaning cylinders 26 and 26*c* from the nozzle cleaning holes 26*h* and 26*hb*.

The pistons 20 and 20*b* are operated in the following manner inside the nozzle cleaning cylinders 26 and 26*c* by the washing water sprayed from the nozzle cleaning holes 26*h* and 26*hb*.

Before the washing water is sprayed into the nozzle cleaning cylinders 26 and 26*c* from the first nozzle cleaning flow path 71 and the second nozzle cleaning flow path 72, the pistons 20 and 20*b* are respectively positioned at places shifted from the axes of the nozzle cleaning cylinders 26 and 26*c*, as shown in FIG. 35. The pistons 20 and 20*b* are respectively accommodated in the cylinders 21 and 21*d* in a state where they have swinging properties by the opening 20X shown in FIG. 33.

Figure 36:
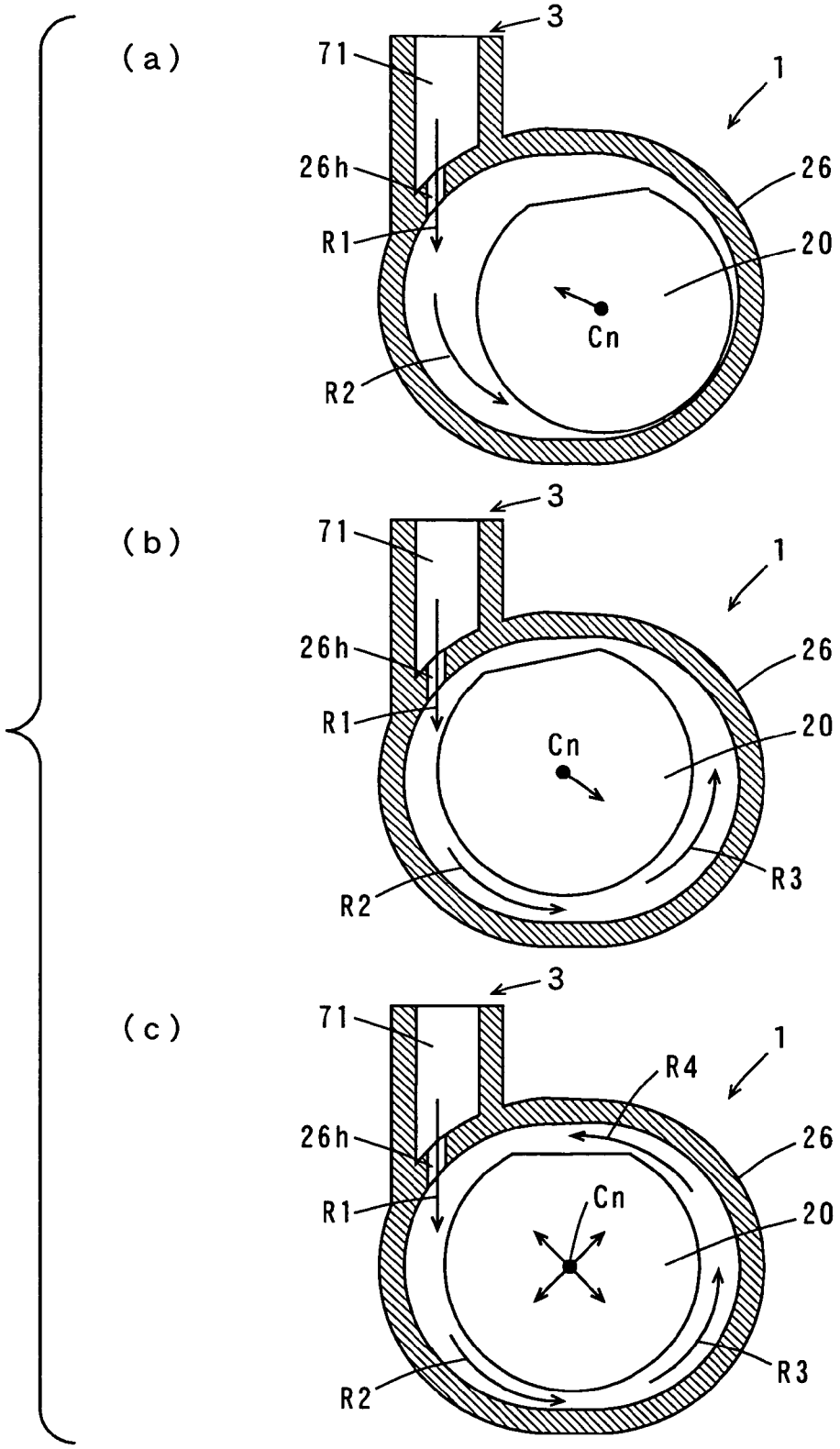
FIG. 36 is a diagram for explaining the operations of a piston in a case where washing water is sprayed into a nozzle cleaning cylinder from a first nozzle cleaning flow path shown in FIG. 32.

FIG. 36 is an explanatory view for explaining the operations of the piston 20 in a case where washing water is sprayed into the nozzle cleaning cylinder 26 from the first nozzle cleaning flow path 71 shown in FIG. 32. Description is herein made of the flow of washing water in a vertical sectional direction of the posterior nozzle 1 and the movement of the piston 20. Here, let Cn be the axis of the piston 20.

As shown in FIG. 36(*a*), washing water is sprayed into the nozzle cleaning cylinder 26 from the first nozzle cleaning flow path 71 through the nozzle cleaning hole 26*h*. In this case, the washing water flows, as indicated by arrows R1 and R2, in the nozzle cleaning cylinder 26.

When the washing water is sprayed from the nozzle cleaning hole 26*h*, the piston 20 is positioned in a lower part of the nozzle cleaning cylinder 26. The piston 20 receives pressure by the washing water that flows into an area between the piston 20 and an inner wall on the side of the lower part of the nozzle cleaning cylinder 26 (the arrow R2), to move the axis Cn.

As shown in FIG. 36(*b*), when washing water is sprayed into the nozzle cleaning cylinder 26 continuously from the state shown in FIG. 36(*a*), the washing water flows, as indicated by arrows R1, R2, and R3, in the nozzle cleaning cylinder 26.

In this case, the piston 20 that has moved to an upper part of the nozzle cleaning cylinder 26 by the movement shown in FIG. 36(*a*) receives pressure by the washing water that flows into an area between the piston 20 and an inner wall on the side of a side part of the nozzle cleaning cylinder 26 (the arrow R3), to move the axis Cn.

As shown in FIG. 36(*c*), when washing water is further sprayed into the nozzle cleaning cylinder 26 continuously from the state shown in FIG. 36(*b*), the washing water flows, as indicated by arrows R1, R2, R3, and R4, in the nozzle cleaning cylinder 26.

The axis Cn of the piston 20 repeats slight movement (vibration) in a random direction, centered around the axis of the nozzle cleaning cylinder 26 by pressure created by washing water flowing between the outer peripheral surface of the piston 20 and the inner wall of the nozzle cleaning cylinder 26. Such vibration of the piston 20 by fluid pressure inside the nozzle cleaning cylinder 26 becomes vibration generally referred to as self-excited vibration.

In order to cause such self-excited vibration, it is desirable that the nozzle cleaning hole 26*h* is provided such that washing water can be sprayed in a direction tangential to the outer peripheral surface of the piston 20 in a case where the axis of the nozzle cleaning cylinder 26 and the axis of the piston 20 coincide with each other, as indicated by a one-dot and dash line in FIG. 35. It is desirable that the piston 20 is configured so as to be lightweight.

When washing water is thus sprayed in the direction tangential to the outer peripheral surface of the piston 20 through the nozzle cleaning hole 26*h*, the washing water is efficiently swirled around the outer peripheral surface of the posterior nozzle 1 without reducing the velocity of flow thereof at the time of the spray.

In order to cause self-excited vibration, it is desirable that the diameter of the nozzle cleaning hole 26*h* is not less than about 0.7 mm nor more than about 1.0 mm.

Figure 37:
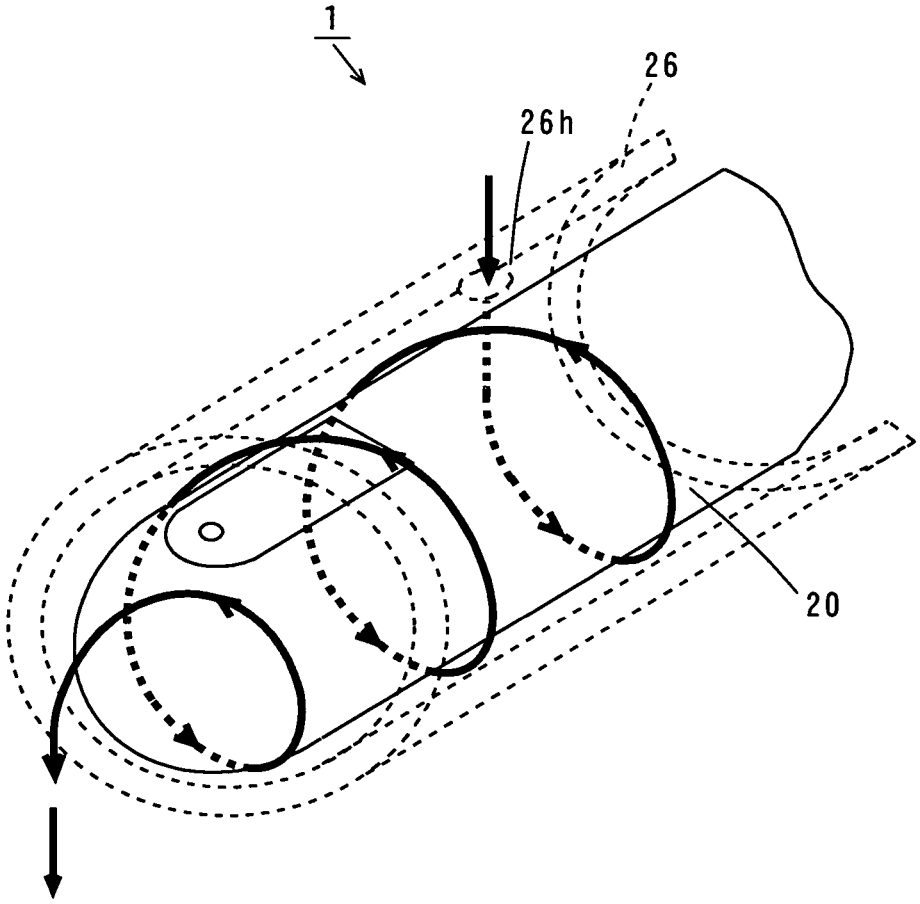
FIG. 37 is a perspective view showing the flow of washing water sprayed into a nozzle cleaning cylinder.

FIG. 37 is a perspective view showing the flow of washing water sprayed into the nozzle cleaning cylinder 26.

As shown in FIG. 37, washing water sprayed from the nozzle cleaning hole 26*h* flows out of an opening at a front end of the nozzle cleaning cylinder 26 while being spirally swirled along the outer peripheral surface of the piston 20.

This flow is produced by the washing water sprayed from the nozzle cleaning hole 26*h* moving downward while being swirled around the outer peripheral surface of the piston 20 because the main body of the nozzle unit 30 is inclined.

Here, the nozzle cleaning hole 26*h* is provided so as to be perpendicular to the length of the nozzle cleaning cylinder 26. Even when the washing water is sprayed from the nozzle cleaning hole 26*h* at a significantly high velocity of flow, therefore, the washing water does not directly flow out of the opening at the front end of the nozzle cleaning cylinder 26.

The washing water sprayed from the nozzle cleaning hole 26*h* spirally flows along the outer peripheral surface of the piston 20, whereby the washing water cleans the whole surface in the vicinity of the front end of the piston 20. Dirt that adheres to the vicinity at the front end of the piston 20 is more effectively cleaned by the self-excited vibration of the piston 20 in a case where the washing water is sprayed.

In order to swirl the washing water sprayed into the nozzle cleaning cylinder 26 along the outer peripheral surface of the piston 20, the velocity of flow of the washing water sprayed from the nozzle cleaning hole 26*h* must be adjusted so as to take not less than a predetermined value. The reason for this is that the velocity of flow of the washing water is increased so that a swirling force of the washing water is increased and a pitch in spiral flow is shortened. Consequently, the washing area of the piston 20 is enlarged. As a result, the sanitary states of the posterior nozzle 1 and the bidet nozzle 2 can be sufficiently ensured.

In the third embodiment, it is desirable that such adjustment that the velocity of flow of the washing water sprayed from the nozzle cleaning hole 26*h* is about 5 to 15 m/s. In this case, the washing water is suitably swirled around the outer peripheral surface of the piston 20. This causes the self-excited vibration of the piston 20.

As described in the foregoing, the nozzle cleaning nozzle 30 is simple in configuration because washing water is introduced into respective annular spaces between the nozzle cleaning cylinders 26 and 26*c* and the pistons 20 so that the posterior nozzle 1 and the bidet nozzle 2 are cleaned, thereby realizing space saving.

Since the inner diameters of the nozzle cleaning cylinder 26 and 26*c* are larger than the outer diameters of the pistons 20 and 20*b* formed in a substantially circular shape, the washing water introduced into the nozzle cleaning holes 26*h* and 26*hb* is efficiently swirled in the respective spaces between the nozzle cleaning cylinders 26 and 26*c* and the pistons 20 and 20*b*. As a result, the outer peripheral surfaces of the posterior nozzle 1 and the bidet nozzle 2 can be evenly cleaned.

Although in the foregoing, it is desirable that the diameter of the nozzle cleaning hole 26*h* is not less than about 0.7 mm nor more than about 1.0 mm in order to cause self-excited vibration, a sufficient cleaning effect can be obtained at a high velocity of flow even when the washing flow rate is as low as about 0.5 L/min by setting the diameter of the nozzle cleaning hole 26*h* to not less than about 0.7 mm nor more than about 1.0 mm.

Figure 38:
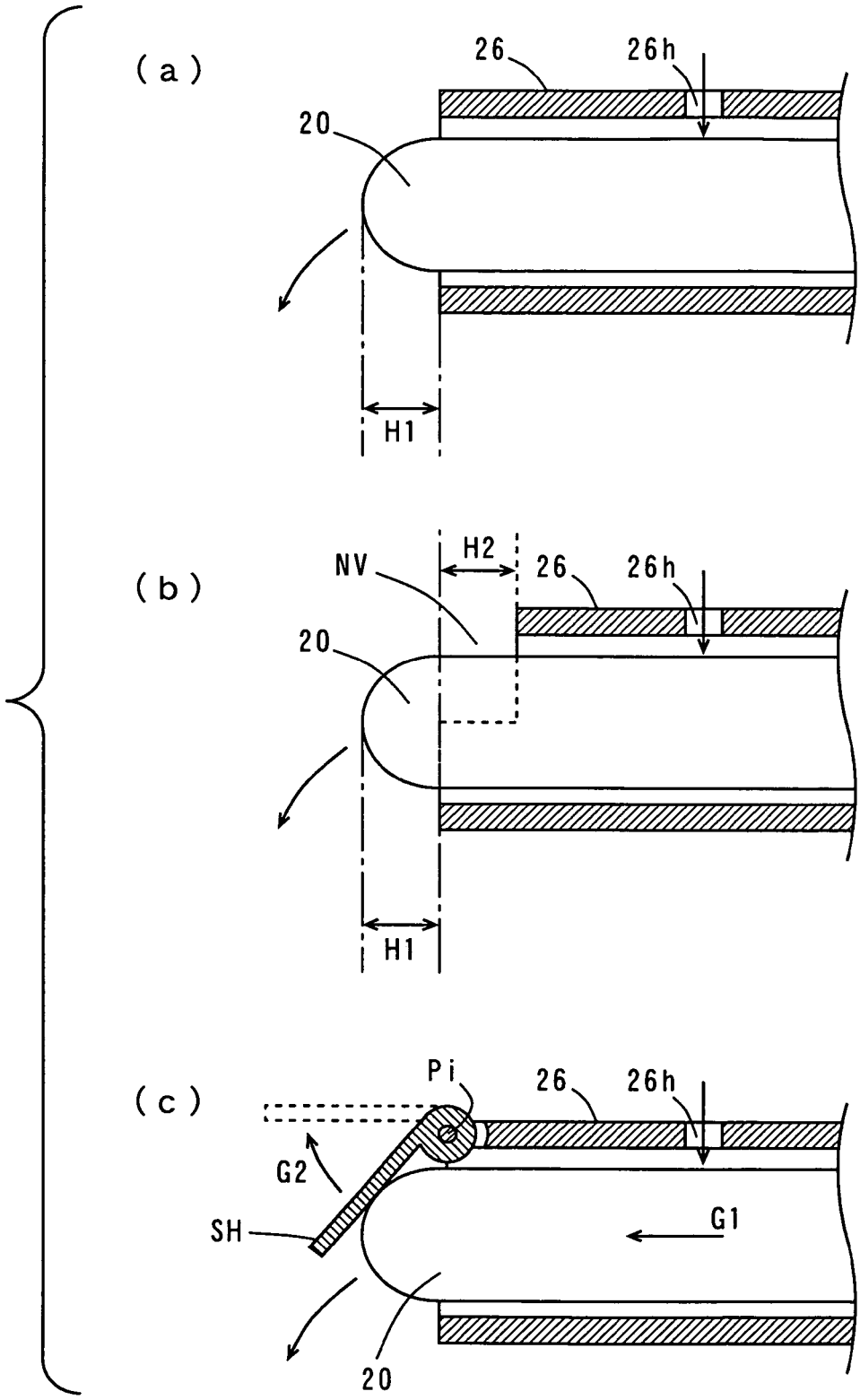
FIG. 38 is a schematic view for explaining the configuration at respective front ends of a nozzle cleaning cylinder and a piston.

FIG. 38 is a schematic view for explaining the configuration of respective front ends of the nozzle cleaning cylinder 26 and the piston 20.

As shown in FIG. 38(*a*), the front end of the piston 20 slightly projects from the front end of the nozzle cleaning cylinder 26 when the piston 20 is accommodated in the cylinder 21 (a range indicated by an arrow H1).

The front end of the piston 20 thus projects from the front end of the nozzle cleaning cylinder 26, thereby preventing the washing water sprayed into the nozzle cleaning cylinder 26 from being scattered toward the upper surface of the nozzle cleaning cylinder 26 when it flows out of the front end. This phenomenon is due to a Coanda effect.

The Coanda effect means the nature of a fluid attempting to flow, when an object is placed in flow, along the object. That is, the washing water flowing out of the front end of the nozzle cleaning cylinder 26 while being spirally swirled around the outer peripheral surface of the piston 20 flows out along the front end of the piston 20 without being scattered toward the upper surface of the nozzle cleaning cylinder 26 because the front end in a substantially hemispherical shape of the piston 20 projects from the front end of the nozzle cleaning cylinder 26.

The respective front ends of the nozzle cleaning cylinder 26 and the piston 20 may have a configuration shown in FIG. 38(*b*). In FIG. 38(*b*), a notch NV having a predetermined length (an arrow H2) is provided on an upper surface at the front end of the nozzle cleaning cylinder 26. The front end of the piston 20 slightly projects from the front end of the nozzle cleaning cylinder 26 having no notch NV (a range indicated by an arrow H1).

In this case, the washing water sprayed from the nozzle cleaning hole 26*h* flows out from below the front end of the nozzle cleaning cylinder 26 more effectively by the flow of the washing water that attempts to flow along the front end of the piston 20 and the flow of the washing water that attempts to flow along the inner wall of the nozzle cleaning cylinder 26. Consequently, the washing water can be reliably prevented from being scattered toward the upper surface of the nozzle cleaning cylinder 26 when it flows out of the front end of the nozzle cleaning cylinder 26. It is desirable that the length in the circumferential direction of the notch NV provided on the upper surface at the front end of the nozzle cleaning cylinder 26 is approximately half of the circumference of the nozzle cleaning cylinder 26.

Furthermore, the respective front ends of the nozzle cleaning cylinder 26 and the piston 20 may have a configuration shown in FIG. 38(*c*).

In FIG. 38(*c*), a shutter SH is attached to the upper surface at the front end of the nozzle cleaning cylinder 26 so as to be rotatable upward and downward through a pin Pi. The shutter SH is rotated in a direction indicated by an arrow G2 when the piston 20 projects in a direction indicated by an arrow G1.

According to the shutter SH, even when the washing water flowing out of the front end of the nozzle cleaning cylinder 26 is scattered toward the upper surface at the front end of the nozzle cleaning cylinder 26, the scattered washing water adheres to the shutter SH to drop out. Consequently, the washing water flowing out of the front end of the nozzle cleaning cylinder 26 is reliably prevented from being scattered toward the upper surface at the front end of the nozzle cleaning cylinder 26.

Although description was herein made of the shutter SH, the present invention is not limited to the same. A scatter preventing wall such as a plate may be provided on an upper surface of or above the nozzle cleaning cylinder 26 in place of the shutter SH, provided that it prevents the washing water flowing out of the front end of the nozzle cleaning cylinder 26 from being scattered.

Although description was made of the shapes of the nozzle cleaning cylinder 26 and the nozzle cleaning hole 26*h* as well as the self-excited vibration of the piston 20 in the posterior nozzle 1 on the basis of FIGS. 36 to 38, the nozzle cleaning cylinder 26*c* and the nozzle cleaning hole 26*hb* also have the same shape and the piston 20*b* causes the same self-excited vibration in the bidet nozzle 2.

Figure 39:
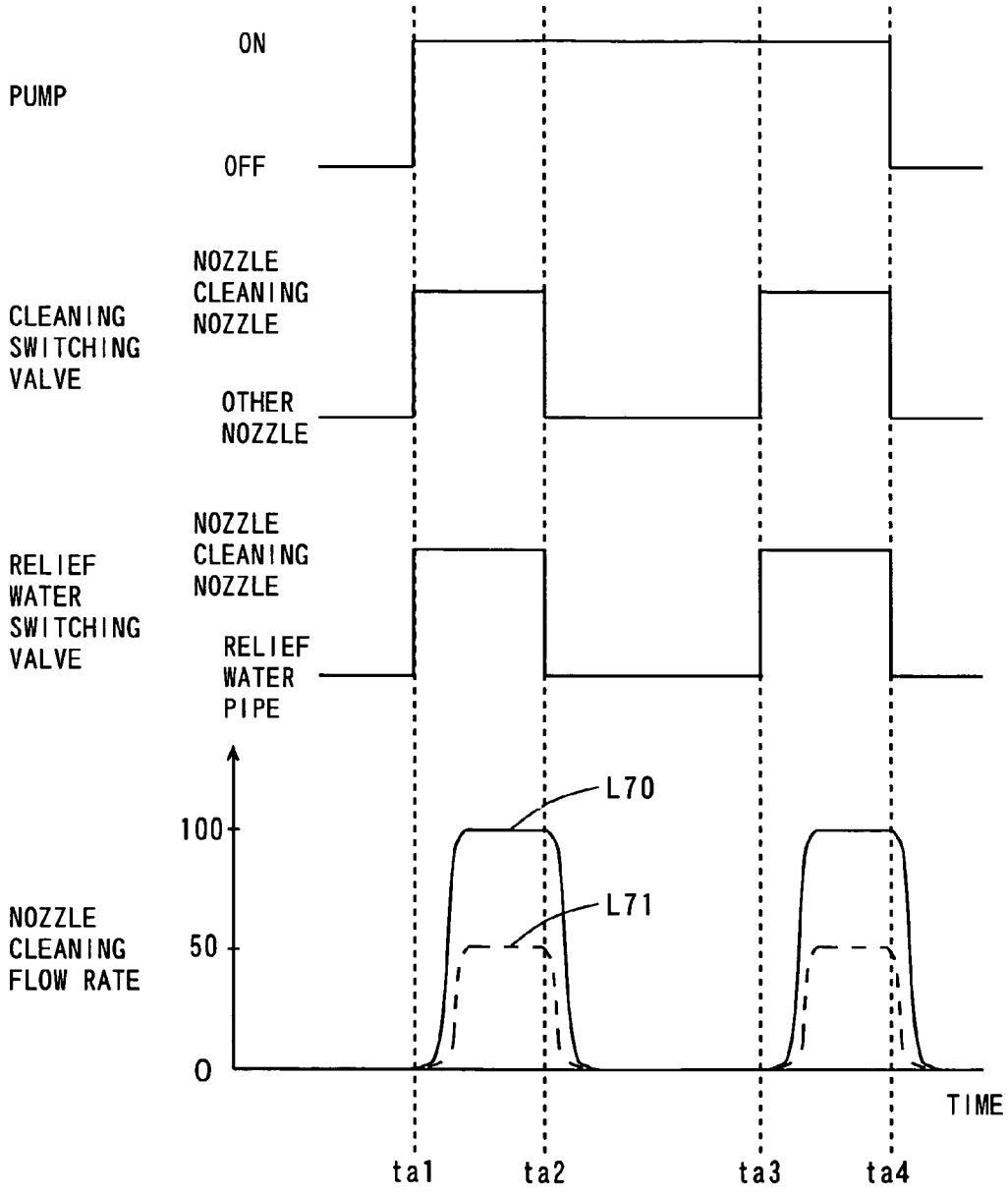
FIG. 39 is a diagram showing the operating states of a pump, a switching valve, and a relief waster switching valve shown in FIG. 30 in a case where a user presses a posterior switch and a stop switch shown in FIG. 29 and the change in the flow rate of washing water sprayed from a nozzle cleaning nozzle shown in FIG. 30 to a posterior nozzle and a bidet nozzle.

FIG. 39 is a diagram showing the operating states of the pump 13, the switching valve 14, and the relief waster switching valve 14B shown in FIG. 30 in a case where the user presses the posterior switch 303 and the stop switch 305 shown in FIG. 29 and the change in the flow rate of washing water sprayed from the nozzle cleaning nozzle 3 shown in FIG. 30 to the posterior nozzle 1 and the bidet nozzle 2.

In a graph showing the nozzle cleaning flow rate in FIG. 39, the vertical axis indicates the ratio of the flow rate of washing water sprayed to the posterior nozzle 1 and the bidet nozzle 2 to the flow rate of washing water passing through the stop solenoid valve 9 shown in FIG. 30, and the horizontal axis indicates time. In the graph, a solid line L70 indicates the flow rate of washing water introduced into the washing water introduction space 70 shown in FIG. 32, and a broken line L71 indicates the flow rate of washing water sprayed into the posterior nozzle 1 from the first nozzle cleaning flow path 71 shown in FIG. 32.

In the following description, the operations of the pump 13, the switching valve 14A, and the relief water switching valve 14B are controlled by the controller 4 shown in FIG. 30.

At a time point ta1, the user presses the posterior switch 303 so that the pump 13 is turned on. On the other hand, the motor M1 is rotated such that the switching valve 14A supplies the washing water fed by pressure from the pump 13 to the nozzle cleaning nozzle 3. On the other hand, the motor M2 shown in FIG. 30 is rotated such that the relief water switching valve 14B supplies the washing water flowing from the branched pipe 205 shown in FIG. 30 to the nozzle cleaning nozzle 3.

Consequently, the washing water from the pump 13 and the washing water from the branched pipe 205 are supplied to the washing water introduction space 70 shown in FIG. 32. In this case, the washing water is supplied to the washing water introduction space 70 at a flow rate of 100%, as indicted by the solid line L70 in the graph.

The washing water supplied to the washing water introduction space 70 cleans the piston 20 in the posterior nozzle 1 through the first nozzle cleaning flow path 71 and the nozzle cleaning hole 26*h* shown in FIG. 35, and cleans the piston 20*b* in the bidet nozzle 2 shown in FIG. 35 through the second nozzle cleaning flow path 72 and the nozzle cleaning hole 26*hb*.

In this case, the flow rate of the washing water sprayed to each of the posterior nozzle 1 and the bidet nozzle 2 is one-second the flow rate of the washing water supplied to the washing water introduction space 70, as indicated by the broken line L71 in the graph.

At a time point ta2, the pump 13 remains turned on. On the other hand, the motor M1 is rotated such that the switching valve 14A supplies the washing water fed by pressure from the pump 13 to the posterior nozzle 1. On the other hand, the motor M2 shown in FIG. 30 is rotated such that the relief water switching valve 14B supplies the washing water flowing from the branched pipe 205 shown in FIG. 30 to the relief water path 207.

Consequently, the supply of the washing water to the washing water introduction space 70 shown in FIG. 32 is stopped, and the washing water is supplied to the posterior nozzle 1 so that the private parts of the human body are washed. The user presses the stop switch 305 shown in FIG. 29 when he or she desires that the washing by the posterior nozzle 1 is terminated.

At a time point ta3, the user presses the stop switch 305 so that the pump 13, the switching valve 14A, and the relief water switching valve 14B perform the same operations as those at the foregoing time point ta1. Consequently, the washing water from the pump 13 and the washing water from the branched pipe 205 are supplied to the washing water introduction space 70 shown in FIG. 32. In this case, the washing water is supplied to the washing water introduction space 70 at a flow rate of 100%, as indicted by the solid line L70 in the graph.

The washing water supplied to the washing water introduction space 70 cleans the piston 20 in the posterior nozzle 1 through the first nozzle cleaning flow path 71 and the nozzle cleaning hole 26*h* shown in FIG. 35, and cleans the piston 20 in the bidet nozzle 2 through the second nozzle cleaning flow path 72 and the nozzle cleaning hole 26*hb*.

In this case, the flow rate of the washing water sprayed to each of the posterior nozzle 1 and the bidet nozzle 2 is also one-second the flow rate of the washing water supplied to the washing water introduction space 70, as in the foregoing.

At a time point ta4, the operations of the switching valve 14A and the relief water switching valve 14B are the same as those at the time point ta2 except that the pump 13 is turned off. Consequently, the cleaning of the posterior nozzle 1 after the washing of the private parts of the human body is terminated.

Although a time period from the time point ta1 to the time point ta2 and a time period from the time point ta3 to the time point ta4 can be freely set, it is preferable that the time periods are within a range of about one second to ten seconds.

The pump 13, the switching valve 14A, and the relief water switching valve 14B also perform the same operations in a case where the user presses the bidet switch 306 shown in FIG. 2.

In a case where the user thus presses the posterior switch 303 or the bidet switch 306, nozzle cleaning is done before the piston 20 or 20*b* in the posterior nozzle 1 or the bidet nozzle 2 project. After posterior washing or bidet washing is terminated, nozzle cleaning is done after the piston 20 or 20*b* in the posterior nozzle 1 or the bidet nozzle 2 is accommodated.

Consequently, the posterior nozzle 1 and the bidet nozzle 2 are always kept clean. Further, the user can know the state of the nozzle cleaning by a cleaning sound or the like, so that he or she obtains such a feeling of safety that the posterior nozzle 1 and the bidet nozzle 2 are always clean.

At the time points ta1 and ta3, the motor M2 in the relief water switching valve 14B is rotated, so that the washing water from the branched pipe 205 is supplied to the nozzle cleaning nozzle 3. Consequently, the flow rate of the washing water used for the nozzle cleaning is sufficiently ensured, so that the posterior nozzle 1 and the bidet nozzle 2 are efficiently cleaned.

The flow rate of the washing water supplied through the switching valve 14A may be increased by enhancing the driving capability of the pump 13 instead of supplying the washing water from the branched pipe 205 to the nozzle cleaning nozzle 3 at the time of the nozzle cleaning.

The user presses the nozzle cleaning switch 309 when he or she desires to clean only the posterior nozzle 1 and the bidet nozzle 2.

Figure 40:
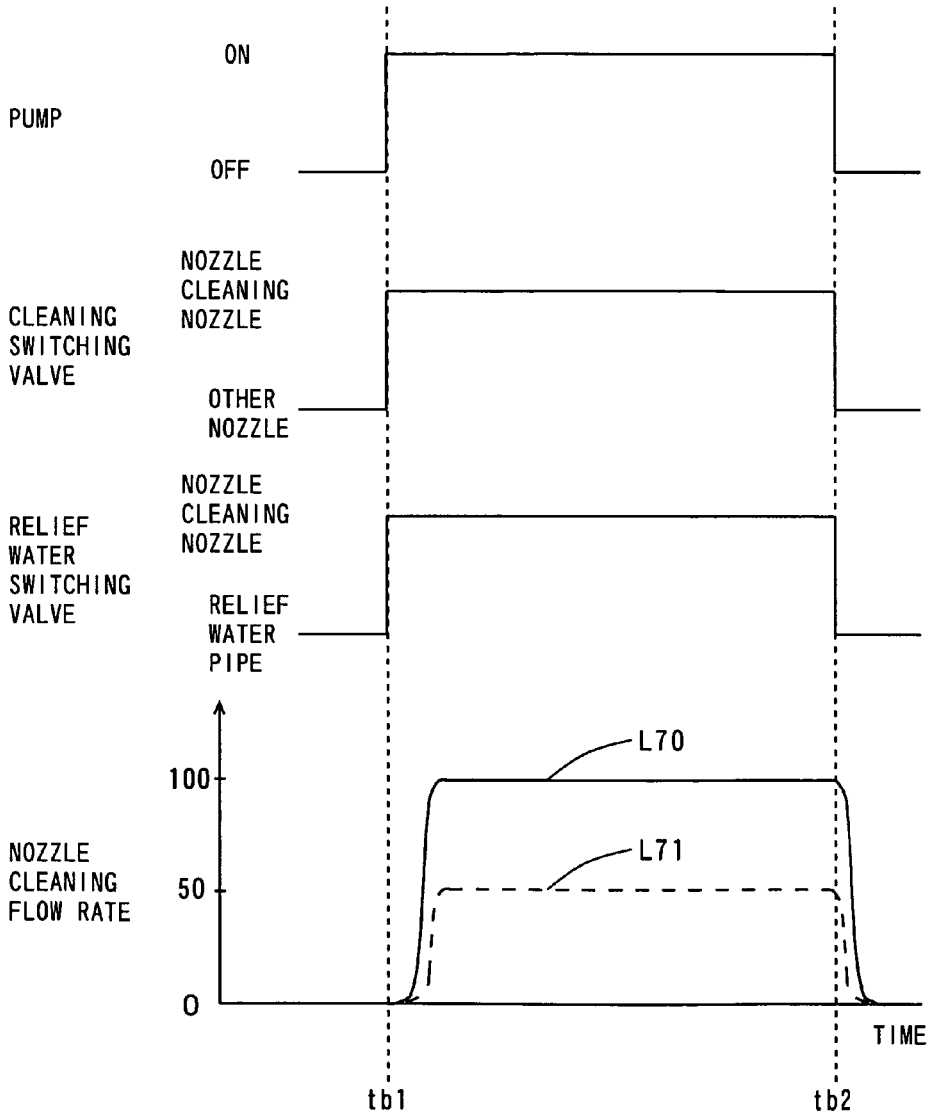
FIG. 40 is a diagram showing the operating states of a pump, a switching valve, and a relief waster switching valve shown in FIG. 30 in a case where a user presses a nozzle cleaning switch shown in FIG. 29 and the change in the flow rate of washing water sprayed from a nozzle cleaning nozzle shown in FIG. 30 to a posterior nozzle and a bidet nozzle.

FIG. 40 is a diagram showing the operating states of the pump 13, the switching valve 14A, and the relief waster switching valve 14B shown in FIG. 30 in a case where the user presses the nozzle cleaning switch 309 shown in FIG. 29 and the change in the flow rate of the washing water sprayed from the nozzle cleaning nozzle 3 shown in FIG. 30 to the posterior nozzle 1 and the bidet nozzle 2.

In a graph showing the nozzle cleaning flow rate in FIG. 40, the vertical axis and the horizontal axis indicate the same contents as those in the graph showing the nozzle cleaning flow rate in FIG. 39, and a solid line L70 and a broken line L71 indicate the same contents as those in the graph shown in FIG. 39.

In the following description, the operations of the pump 13, the switching valve 14A, and the relief water switching valve 14B are controlled by the controller 4 shown in FIG. 30.

At a time point tb1, the user presses the nozzle cleaning switch 309 so that the pump 13 is turned on. On the other hand, the motor M1 is rotated such that the switching valve 14A supplies the washing water fed by pressure from the pump 13 to the nozzle cleaning nozzle 3. On the other hand, the motor M2 shown in FIG. 30 is rotated such that the relief water switching valve 14B supplies the washing water flowing from the branched pipe 205 shown in FIG. 30 to the nozzle cleaning nozzle 3.

Consequently, the washing water from the pump 13 and the washing water from the branched pipe 205 are supplied to the washing water introduction space 70 shown in FIG. 32. In this case, the washing water is supplied to the washing water introduction space 70 at a flow rate of 100%, as indicted by the solid line L70 in the graph.

The washing water supplied to the washing water introduction space 70 cleans the piston 20 in the posterior nozzle 1 through the first nozzle cleaning flow path 71 and the nozzle cleaning hole 26*h* shown in FIG. 35, and cleans the piston 20*b* in the bidet nozzle 2 shown in FIG. 35 through the second nozzle cleaning flow path 72 and the nozzle cleaning hole 26*hb*.

In this case, the flow rate of the washing water sprayed to each of the posterior nozzle 1 and the bidet nozzle 2 is one-second the flow rate of the washing water supplied to the washing water introduction space 70, as indicated by the broken line L71 in the graph.

At a time point tb2, the pump 13 is turned off. On the other hand, the motor M1 in the switching valve 14A is rotated to a predetermined position in a case where various types of cleaning operations are not performed. On the other hand, the motor M2 shown in FIG. 30 is rotated such that the relief water switching valve 14B supplies the washing water flowing from the branched pipe 205 shown in FIG. 30 to the relief water path 207. Consequently, the supply of the washing water to the washing water introduction space 70 shown in FIG. 32 is stopped.

The user then presses the nozzle cleaning switch 309 so that only the nozzle cleaning can be done. Consequently, the posterior nozzle 1 and the bidet nozzle 2 are subjected to higher-frequency cleaning depending on a user's intension. Consequently, the user can obtain such a feeling of safety that the posterior nozzle 1 and the bidet nozzle 2 are clean by pressing the nozzle cleaning switch 309.

At the time point tb1, the motor M2 in the relief water switching valve 14B is rotated so that the washing water from the branched pipe 205 is supplied to the nozzle cleaning nozzle 3. Consequently, the flow rate of the washing water used for the nozzle cleaning is sufficiently ensured, so that the posterior nozzle 1 and the bidet nozzle 2 are more efficiently cleaned.

The flow rate of the washing water supplied through the switching valve 14A may be increased by enhancing the driving capability of the pump 13 instead of supplying the washing water from the branched pipe 205 to the nozzle cleaning nozzle 3 at the time of the nozzle cleaning.

In the foregoing, a time period from the time point tb1 to the time point tb2 can be freely set. In a case where a feeling of safety corresponding to the cleaned state in the nozzle cleaning by the user is considered, however, it is preferable that the time period is reduced to at least not less than one minute. Timing at the time point tb2 may be determined by the user pressing the stop switch 305.

The user presses the high-temperature nozzle cleaning switch 310 when he or she desires to subject the posterior nozzle 1 and the bidet nozzle 2 to cleaning having a higher cleaning effect such as bacteria elimination.

Figure 41:
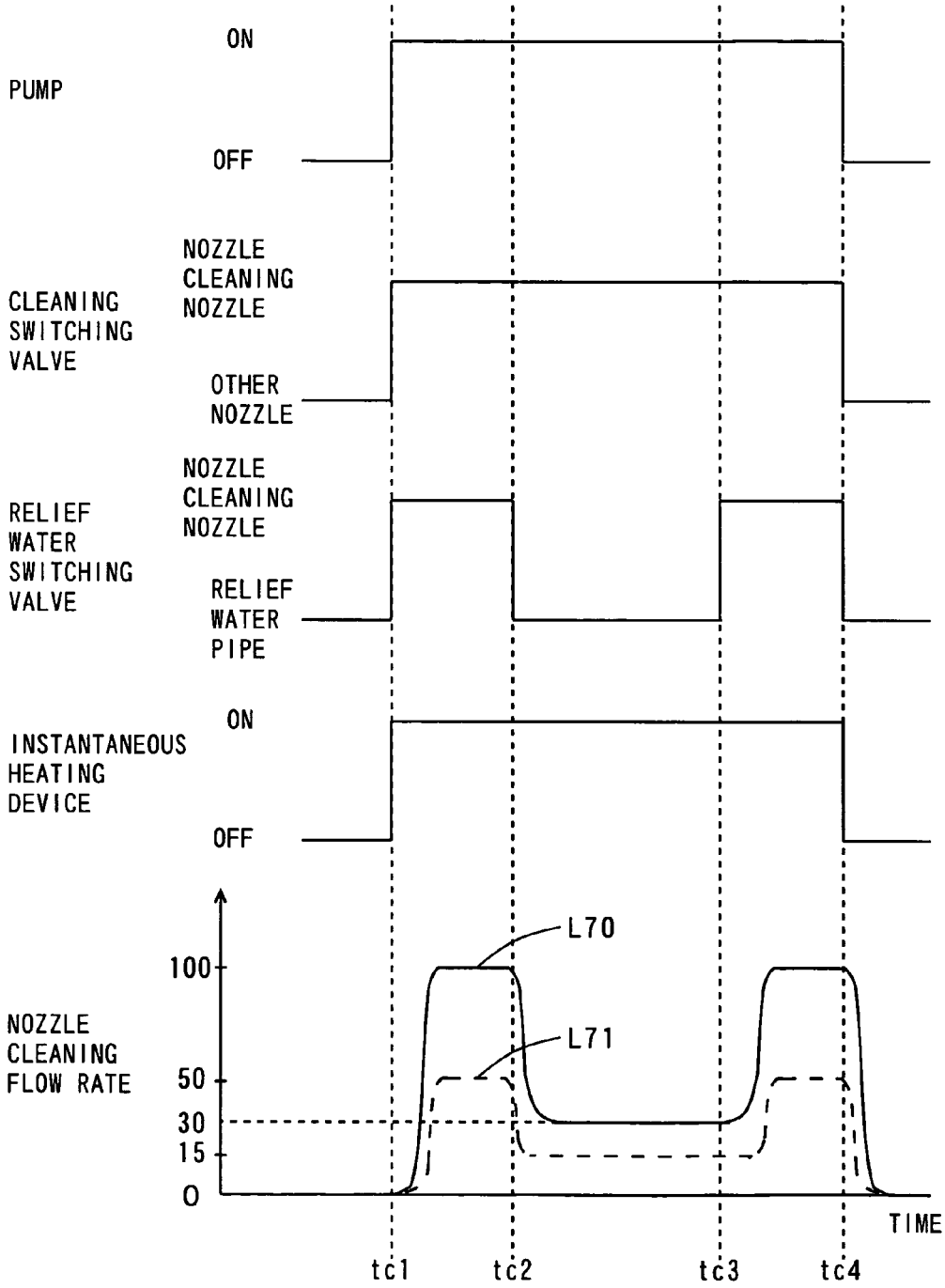
FIG. 41 is a diagram showing the operating states of a pump, a switching valve, and a relief waster switching valve shown in FIG. 30 in a case where a user presses a high-temperature nozzle cleaning switch shown in FIG. 29 and the change in the flow rate of washing water sprayed from a nozzle cleaning nozzle shown in FIG. 30 to a posterior nozzle and a bidet nozzle.

FIG. 41 is a diagram showing the operating states of the pump 13, the switching valve 14A, the relief waster switching valve 14B, and the heat exchanger 11 shown in FIG. 30 in a case where the user presses the high-temperature nozzle cleaning switch 310 shown in FIG. 29 and the change in the flow rate of the washing water sprayed from the nozzle cleaning nozzle 3 shown in FIG. 30 to the posterior nozzle 1 and the bidet nozzle 2.

In a graph showing the nozzle cleaning flow rate in FIG. 41, the vertical axis and the horizontal axis indicate the same contents as those in the graph showing the nozzle cleaning flow rate in FIG. 39, and a solid line L70 and a broken line L71 indicate the same contents as those in the graph shown in FIG. 39.

In the following description, the operations of the pump 13, the switching valve 14A, the relief water switching valve 14B, and the heat exchanger 11 are controlled by the controller 4 shown in FIG. 30.

At a time point tc1, the user presses the high-temperature nozzle cleaning switch 310 so that the pump 13 and the heat exchanger 11 are turned on. On the other hand, the motor M1 is rotated such that the switching valve 14A supplies the washing water fed by pressure from the pump 13 to the nozzle cleaning nozzle 3. On the other hand, the motor M2 shown in FIG. 30 is rotated such that the relief water switching valve 14B supplies the washing water flowing from the branched pipe 205 shown in FIG. 30 to the nozzle cleaning nozzle 3.

Consequently, the washing water from the pump 13 and the washing water from the branched pipe 205 are supplied to the washing water introduction space 70 shown in FIG. 32. In this case, the washing water is supplied to the washing water introduction space 70 at a flow rate of 100%, as indicted by the solid line L70 in the graph.

The washing water supplied to the washing water introduction space 70 cleans the piston 20 in the posterior nozzle 1 through the first nozzle cleaning flow path 71 and the nozzle cleaning hole 26*h* shown in FIG. 35, and cleans the piston 20*b* in the bidet nozzle 2 shown in FIG. 35 through the second nozzle cleaning flow path 72 and the nozzle cleaning hole 26*hb*.

In this case, the flow rate of the washing water sprayed to each of the posterior nozzle 1 and the bidet nozzle 2 is one-second the flow rate of the washing water supplied to the washing water introduction space 70, as indicated by the broken line L71 in the graph.

At a time point tc2, the pump 13 and the heat exchanger 11 remain turned on. Further, the switching valve 14A is held in a state where the motor M1 is rotated so as to supply the washing water fed by pressure from the pump 13 to the nozzle cleaning nozzle 3. On the other hand, the motor M2 shown in FIG. 30 is rotated such that the relief water switching valve 14B supplies the washing water flowing from the branched pipe 205 shown in FIG. 30 to the relief water path 207.

Here, the driving capability of the pump 13 is deteriorated. Consequently, the temperature of the washing water to be heated by the heat exchanger 11 is raised. For example, a heat exchanger 11 of about one kilowatt is assumed. In a case where washing water at a temperature of about 20° C. is passed through the heat exchanger 11 at a flow rate of 0.3 L/min, the temperature of the washing water is raised by about 40° C. As a result, washing water at a temperature of about 60° C. is obtained.

By the operations of the pump 13, the switching valve 14A, the relief water switching valve 14B, and the heat exchanger 11, only high-temperature washing water is supplied to the washing water introduction space 70 shown in FIG. 32 through the heat exchanger 11, the pump 13, and the switching valve 14A.

In this case, the high-temperature washing water is supplied to the washing water introduction space 70 at a flow rate of 30%, as indicted by the solid line L70 in the graph shown in FIG. 41.

The washing water supplied to the washing water introduction space 70 cleans the piston 20 in the posterior nozzle 1 through the first nozzle cleaning flow path 71 and the nozzle cleaning hole 26*h* shown in FIG. 35, and cleans the piston 20 in the bidet nozzle 2 through the second nozzle cleaning flow path 72 and the nozzle cleaning hole 26*hb*.

The flow rate of the washing water sprayed to each of the posterior nozzle 1 and the bidet nozzle 2 is one-second the flow rate of the washing water supplied to the washing water introduction space 70, as indicated by the broken line L71 in the graph.

At a time point tc3, the pump 13, the switching valve 14A, the relief water switching valve 14B, and the heat exchange 11 perform the same operations as those at the foregoing time point tc1. Consequently, the washing water from the pump 13 and the washing water from the branched pipe 205 are supplied to the washing water introduction space 70 shown in FIG. 32. In this case, the washing water is supplied to the washing water introduction space 70 at a flow rate of 100%, as indicted by the solid line L70 in the graph.

The washing water supplied to the washing water introduction space 70 cleans the piston 20 in the posterior nozzle 1 through the first nozzle cleaning flow path 71 and the nozzle cleaning hole 26*h* shown in FIG. 35, and cleans the piston 20 in the bidet nozzle 2 through the second nozzle cleaning flow path 72 and the nozzle cleaning hole 26*hb*.

In this case, the flow rate of the washing water sprayed to each of the posterior nozzle 1 and the bidet nozzle 2 is also one-second the flow rate of the washing water supplied to the washing water introduction space 70, as in the foregoing.

At a time point tc4, the pump 13 and the heat exchanger 11 are turned off. Further, the motor M1 in the switching valve 14A is rotated to a predetermined position where various types of washing operations are not performed. On the other hand, the motor M2 shown in FIG. 30 is rotated such that the relief water switching valve 14B supplies the washing water flowing from the branched pipe 205 shown in FIG. 30 to the relief water path 207. Consequently, the supply of the washing water to the washing water introduction space 70 shown in FIG. 32 is stopped.

Although a time period from the time point tc1 to the time point tc2 and a time period from the time point tc3 to the time point tc4 can be freely set, it is preferable that the time periods are within a range of about one second to ten seconds. Although an interval between the time point tc2 and the time point tc3 can be freely set, it is preferable that the interval is within a range of about one minute to three minutes in order to give more effective cleaning of the posterior nozzle 1 and the bidet nozzle 2

In a case where the user thus presses the high-temperature nozzle cleaning switch 310, nozzle cleaning using a large amount of washing water is first done, nozzle cleaning using high-temperature washing water is then done, and nozzle cleaning using a large amount of washing water is finally done again. Consequently, dirt that adheres to the posterior nozzle 1 and the bidet nozzle 2 is reliably removed.

The high-temperature washing water is sprayed to the posterior nozzle 1 and the bidet nozzle 2 composed of stainless, thereby obtaining the effect of reducing, eliminating or killing bacteria.

The posterior nozzle 1 and the bidet nozzle 2 composed of thin-walled stainless allow a sufficient sterilizing effect to be obtained when the temperature of the washing water is in a range of not less than about 60° C. because stainless has a higher thermal conductivity than resin or the like. Consequently, a sufficient sterilizing effect is obtained even if the washing water is not heated to 70 to 100° C. As a result, energy saving is realized.

The user can obtain such a feeling of safety that the posterior nozzle 1 and the bidet nozzle 2 are clean because they are subjected to bacteria reduction, elimination or killing using the high-temperature washing water.

The flow rate of the washing water supplied through the switching valve 14A may be increased by enhancing the driving capability of the pump 13 instead of supplying the washing water from the branched pipe 205 to the nozzle cleaning nozzle 3 in the time period from the time point tc1 to the time point tc2 and the time period from the time point tc3 to the time point tc4.

The above-mentioned nozzle cleaning using the high-temperature washing water is not operated in a case where the seating sensor 51 detects the human body on the toilet seat 400. In a case where the user erroneously presses the high-temperature nozzle cleaning switch 310 when he or she sits on the toilet seat 400, for example, the controller 4 shown in FIG. 30 nullifies a nozzle cleaning operation using high-temperature washing water on the basis of the signal, representing the presence or absence of a user on the toilet seat 400, inputted from the seating sensor 51.

Even in a case where the user erroneously presses the high-temperature nozzle cleaning switch 310 in a state where the user himself or herself sits on the toilet seat 400, the high-temperature washing water is prevented from being scattered.

As described in the foregoing, application of the shapes and the configurations of the respective pistons 20 and 20*b* and the respective cylinders 21 and 21*d* in the posterior nozzle 1 and the bidet nozzle 2, the flow rate of the washing water at the time of nozzle cleaning and the high-temperature washing water at the time of nozzle cleaning allows the sanitary state of the human body washing nozzle to be sufficiently ensured in a simple configuration.

Fourth Embodiment

The sanitary washing apparatus 100 according to the third embodiment may use another instantaneous heating device in order to obtain high-temperature washing water, as described below.

Figure 42:
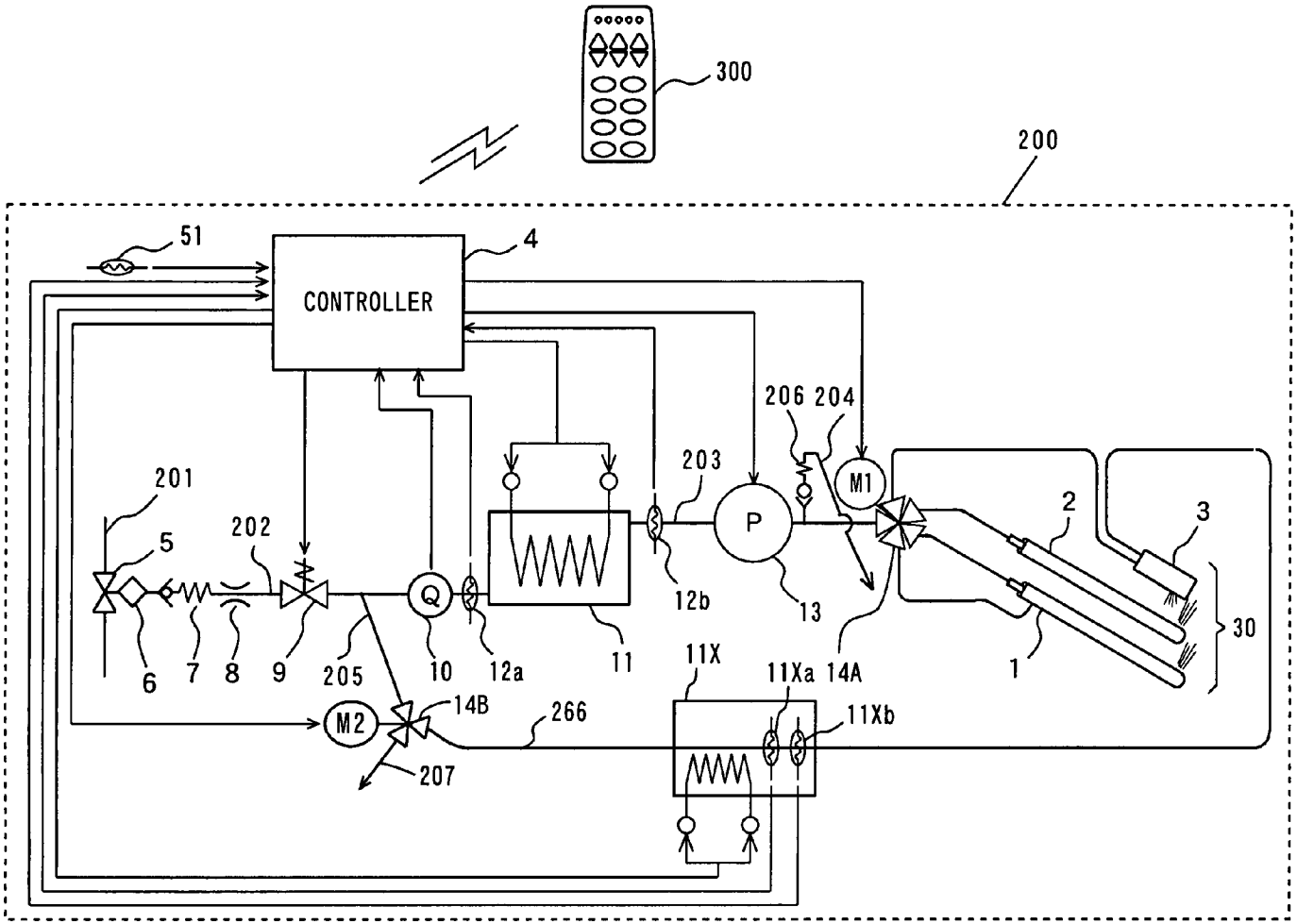
FIG. 42 is a schematic view showing the configuration of a main body in a sanitary washing apparatus according to a third embodiment in a case where another instantaneous heating device is used.

FIG. 42 is a schematic view showing the configuration of a main body 200 in the sanitary washing apparatus 100 according to the third embodiment in which another instantaneous heating device is used.

The main body 200 shown in FIG. 42 has the same configuration and operations as those of the main body 200 shown in FIG. 30 in the third embodiment except for the following points.

In a fourth embodiment, an instantaneous heating device 11X is mounted on a supply pipe 266 for connecting a relief water switching valve 14B and a nozzle cleaning nozzle 3. A controller 4 controls the operations of the instantaneous heating device 11X on the basis of signals respectively inputted from a thermistor 11Xa and a thermostat 11Xb.

The controller 4 shown in FIG. 42 performs the following operations, for example, in the foregoing configuration.

The controller 4 controls the operations of a stop solenoid valve 9, a relief water switching valve 14B, and an instantaneous heating device 11X as a user presses the high-temperature nozzle cleaning switch 310 in the remote control device 300 shown in FIG. 29.

First, the controller 4 opens the stop solenoid valve 9. In this case, the stop solenoid valve 9 is opened so that washing water is supplied to a branched pipe 205. Simultaneously, the controller 4 rotates a motor M2 in the relief water switching valve 14B such that the washing water in the branched pipe 205 can be supplied to a supply water path 266. Consequently, washing water is supplied to the supply water path 266.

Here, in the relief water switching valve 14B, a destination of supply of the washing water from the branched pipe 205 is switched to a relief water path 207 or the supply water path 266, and the ratio of washing water respectively supplied to the pipes is adjusted. Consequently, a predetermined amount of washing water is supplied to the supply water path 266.

The controller 4 turns the instantaneous heating device 11X on. Consequently, the washing water supplied to the supply water path 266 is changed into high-temperature water (about 80 to 100° C.: referred to as superheated water) or vapor upon being heated by the operations of the instantaneous heating device 11X, described later.

The washing water heated by the instantaneous heating device 11X is supplied to the nozzle cleaning nozzle 3 so that nozzle cleaning is done. Consequently, dirt that has adhered to a posterior nozzle 1 and a bidet nozzle 2 is stripped by the superheated water or the vapor, to flow into the toilet bowl 600 shown in FIG. 1. As a result, the peripheries of respective spray holes in the posterior nozzle 1 and the bidet nozzle 2 are subjected to bacteria elimination or killing, cleaning, and so forth.

Figure 43:
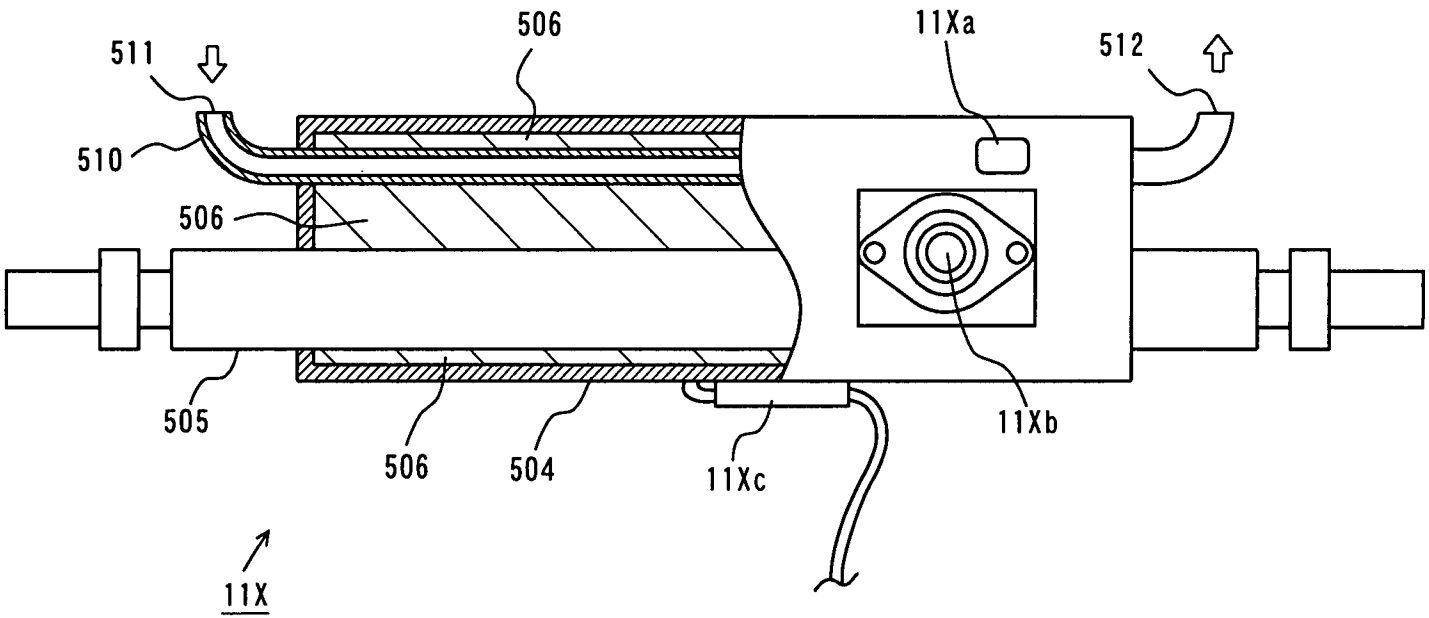
FIG. 43 is a partially cutaway sectional view showing the configuration of an instantaneous heating device.

The details of the instantaneous heating device 11X will be herein described. FIG. 43 is a partially cutaway sectional view showing the configuration of the instantaneous heating device 11X. In FIG. 43, the instantaneous heating device 11X comprises a casing 504, a sheath heater 505, a heat conductor 506, a pipe 510, a thermistor 11Xa, a thermostat 11Xb, and a temperature fuse 11Xc. Here, the pipe 510 is attached to the supply water path 266 shown in FIG. 42 through a supply port 511 and a discharge port 512.

The casing 504 has a substantially rectangular parallelepiped shape. The pipe 510 and the sheath heater 505 are provided side by side with predetermined spacing so as to extend in the longitudinal direction within the casing 504, and both ends of each of the pipe 510 and the sheath heater 505 respectively project outward from both end surfaces of the casing 504.

The pipe 510 and the sheath heater 505 are covered with the heat conductor 506 within the casing 504. The sheath heater 505 contains an electrically-heated wire and is supplied with power to generate heat.

At the time of the above-mentioned nozzle cleaning, the washing water supplied from the washing water outlet 143*e* in the switching valve 14A is introduced into the pipe 510 from the supply port 511.

When the sheath heater 505 is supplied with the power, the heat generated by the sheath heater 505 is transmitted to the pipe 510 through the heat conductor 506. Consequently, the washing water introduced into the pipe 510 is heated, so that the superheated water or the vapor is discharged from the discharge port 512.

Assuming herein that the supply port 511 and the discharge port 512 in the pipe 510 are respectively on the upstream side and the downstream side of the instantaneous heating device 11X, the thermistor 11Xa and the thermostat 11Xb are provided on the downstream side of the instantaneous heating device 11X. Further, the temperature fuse 11Xc is provided on a side surface of the casing 504.

The thermistor 11Xa, the thermostat 11Xb, and the temperature fuse 11Xc differ in reference operation temperatures. Consequently, overheating prevention in three stages can be adjusted. Further, even if any one of the thermistor 11Xa, the thermostat 11Xb, and the temperature fuse 11Xc develops a fault, overheating is prevented by the remaining two of them.

The thermistor 11Xa is attached to the sheath heater 505, to detect the temperature of the sheath heater 505. The controller 4 determines the temperature of the sheath heater 505 that is given from the thermistor 11Xa, to carry out control such that the temperature of the sheath heater 505 is lowered when the sheath heater 505 is in an overheated state.

The thermostat 11Xb is mounted such that the temperature of washing water flowing in the pipe 510 is detectable. When the temperature of the washing water flowing in the pipe 510 exceeds the reference operation temperature of the thermostat 11Xb, the thermostat 11Xb is operated so as to block off the supply of power by the sheath heater 505.

Finally, the temperature fuse 11Xc is made to adhere and fixed to the casing 504. When the temperature of the casing 504 exceeds the reference operation temperature of the temperature fuse 11Xc, the temperature fuse 11Xc is fused so that the supply of power to the sheath heater 505 is blocked off.

The foregoing functions of the thermistor 11Xa, the thermostat 11Xb, and the temperature fuse 11Xc prevent overheating of the washing water by the sheath heater 505 and overheating of the sheath heater 505 itself.

Although the sheath heater 505 is used as washing water heating means for the instantaneous heating device 11X according to the present embodiment, the present invention is not limited to the same. A mica heater, a ceramic heater, a print heater, or the like may be used.

Furthermore, although each of the thermistor 11Xa, the thermostat 11Xb, and the temperature fuse 11Xc prevents overheating of the instantaneous heating device 11X, the controller 4 may control the temperature of the sheath heater 505 by feedback control or feed forward control on the basis of the measured temperature value of the thermistor 11Xa or the thermostat 11Xb by connecting the thermistor 11Xa or the thermostat 11Xb to the controller 4.

In the present embodiment, it is desirable that the nozzle cleaning by the superheated water or the vapor is set so as not to be operated when the seating sensor 51 detects the human body on the toilet seat 400, as in the main body 200 shown in FIG. 30. Such setting prevent scattering of the superheated water and leakage of the vapor even when the user erroneously presses the high-temperature nozzle cleaning switch 310 in a state where the user himself or herself sits on the toilet seat 400.

Furthermore, in this example, the flow rate of the washing water to be supplied to the nozzle cleaning nozzle 3 may be increased, as in the main body 200 shown in FIG. 3, by switching the turn-on and turn-off of the instantaneous heating device 11X. In this case, the flow rate of the washing water to be supplied to the nozzle cleaning nozzle 3 can be increased as required, so that dirt can be caused to flow using a large amount of washing water at the time of the nozzle cleaning.

Fifth Embodiment

A sanitary washing apparatus 100 according to a fifth embodiment has the same configuration and operations as those of the sanitary washing apparatus 100 according to the third embodiment except for the following points.

Figure 44:
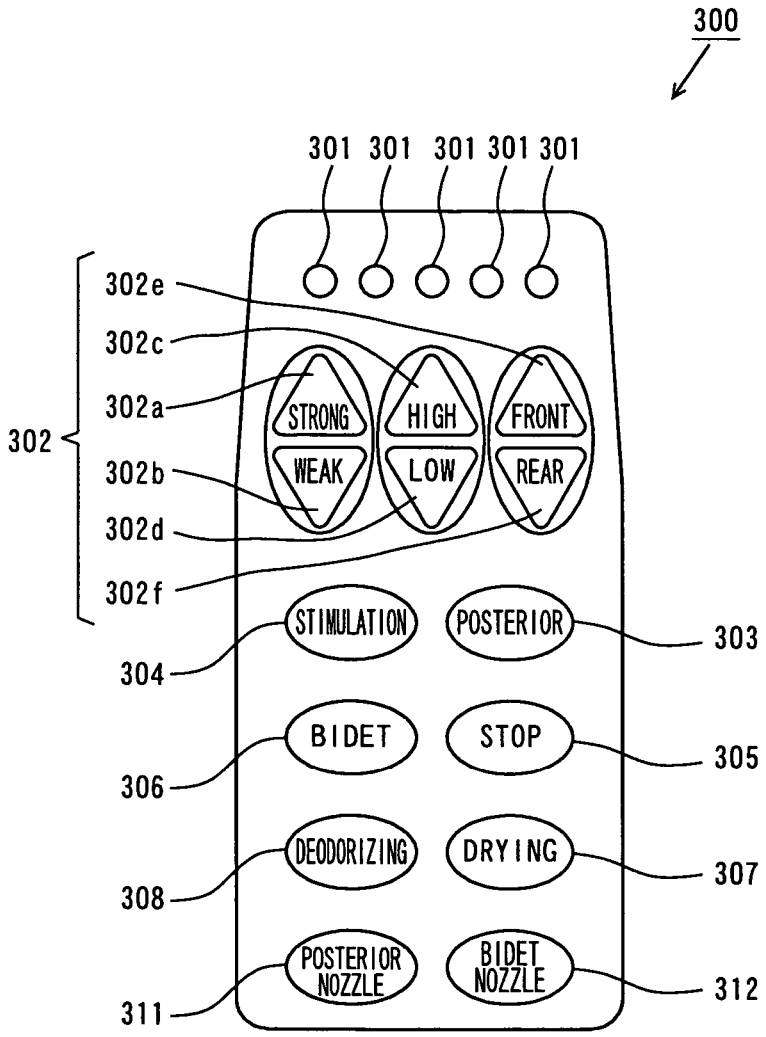
FIG. 44 is a schematic view showing an example of a remote control device according to a fifth embodiment.

FIG. 44 is a schematic view showing an example of a remote control device 300 according to the fifth embodiment.

As shown in FIG. 44, the remote control device 300 according to the fifth embodiment comprises a posterior nozzle cleaning switch 311 and a bidet nozzle cleaning switch 312 in place of the nozzle cleaning switch 309 and the high-temperature nozzle cleaning switch 310 shown in FIG. 29 according to the third embodiment.

A user presses the posterior nozzle cleaning switch 311 and the bidet nozzle cleaning switch 312. Consequently, the remote control device 300 transmits by radio a predetermined signal to a controller provided in a main body 200 in a sanitary washing apparatus 100, as described later. The controller in the main body 200 receives the predetermined signal transmitted by radio from the remote control device 300, to control a washing water supply mechanism or the like.

For example, the user presses the nozzle cleaning switch 311 so that a posterior nozzle provided in a nozzle unit 30 is cleaned using washing water, while pressing the bidet nozzle cleaning switch 312 so that a bidet nozzle provided in the nozzle unit 30 is cleaned using washing water. The details of the cleaning operation of the nozzle unit 30 by pressing the posterior nozzle cleaning switch 311 and the bidet nozzle cleaning switch 312 will be described later.

The main body 200 in the sanitary washing apparatus 100 according to the fifth embodiment of the present invention will be described.

Figure 45:
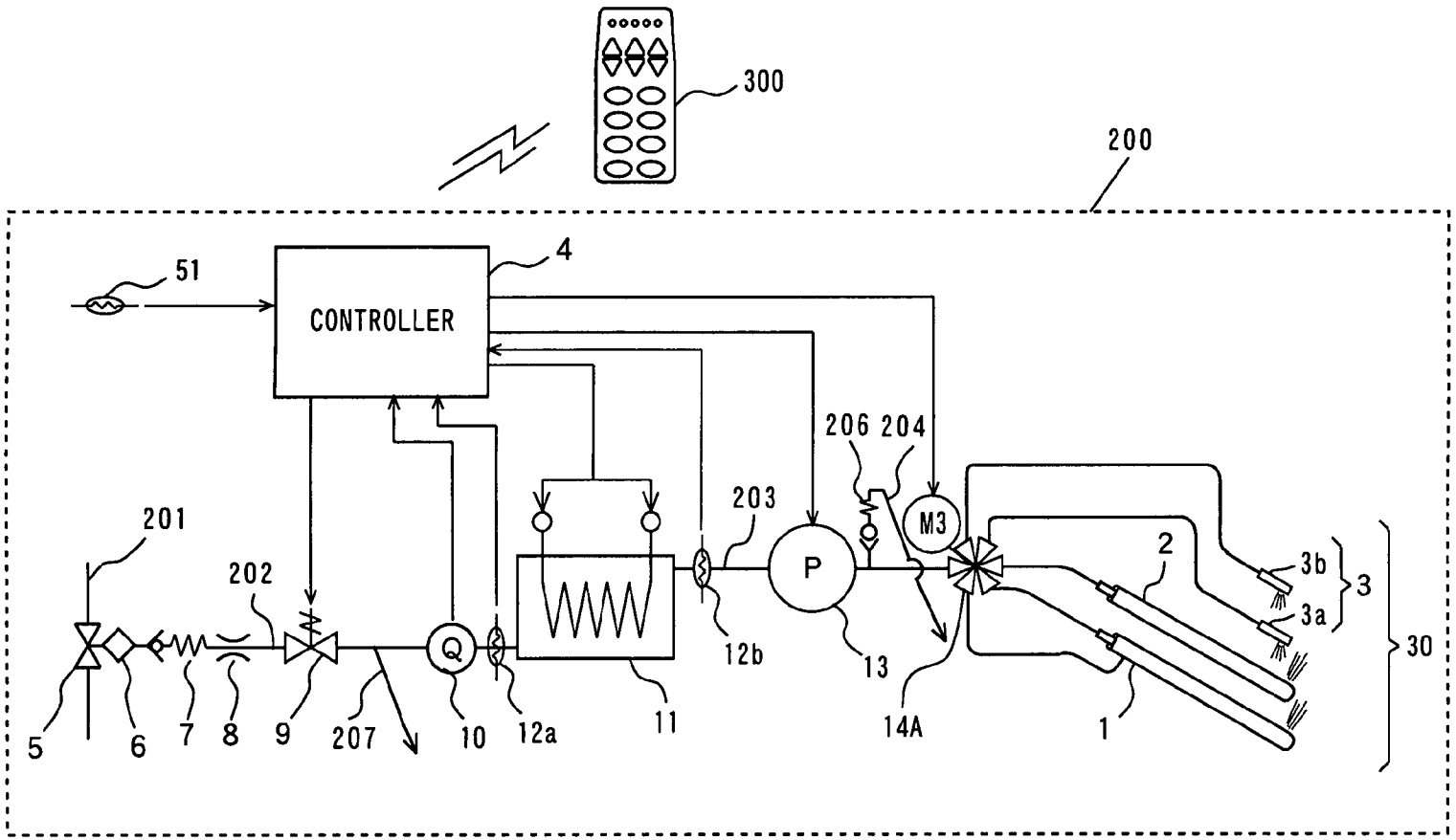
FIG. 45 is a schematic view showing the configuration of a main body in a sanitary washing apparatus according to a fifth embodiment of the present invention.

FIG. 45 is a schematic view showing the configuration of the main body 200 in the sanitary washing apparatus 100 according to the fifth embodiment of the present invention.

In the main body 200 shown in FIG. 45, a relief water path 207 is directly provided on the downstream side of a stop solenoid valve 9 in a pipe 202. A nozzle cleaning nozzle 3 comprises a first cleaning nozzle 3*a* and a second cleaning nozzle 3*b*. A switching valve 14A is so configured that washing water supplied from a pump 13 can be supplied to any one of a posterior nozzle 1, a bidet nozzle 2, the first cleaning nozzle 3*a*, and the second cleaning nozzle 3*b*. The switching valve 14A comprises a motor M3.

Figure 46:
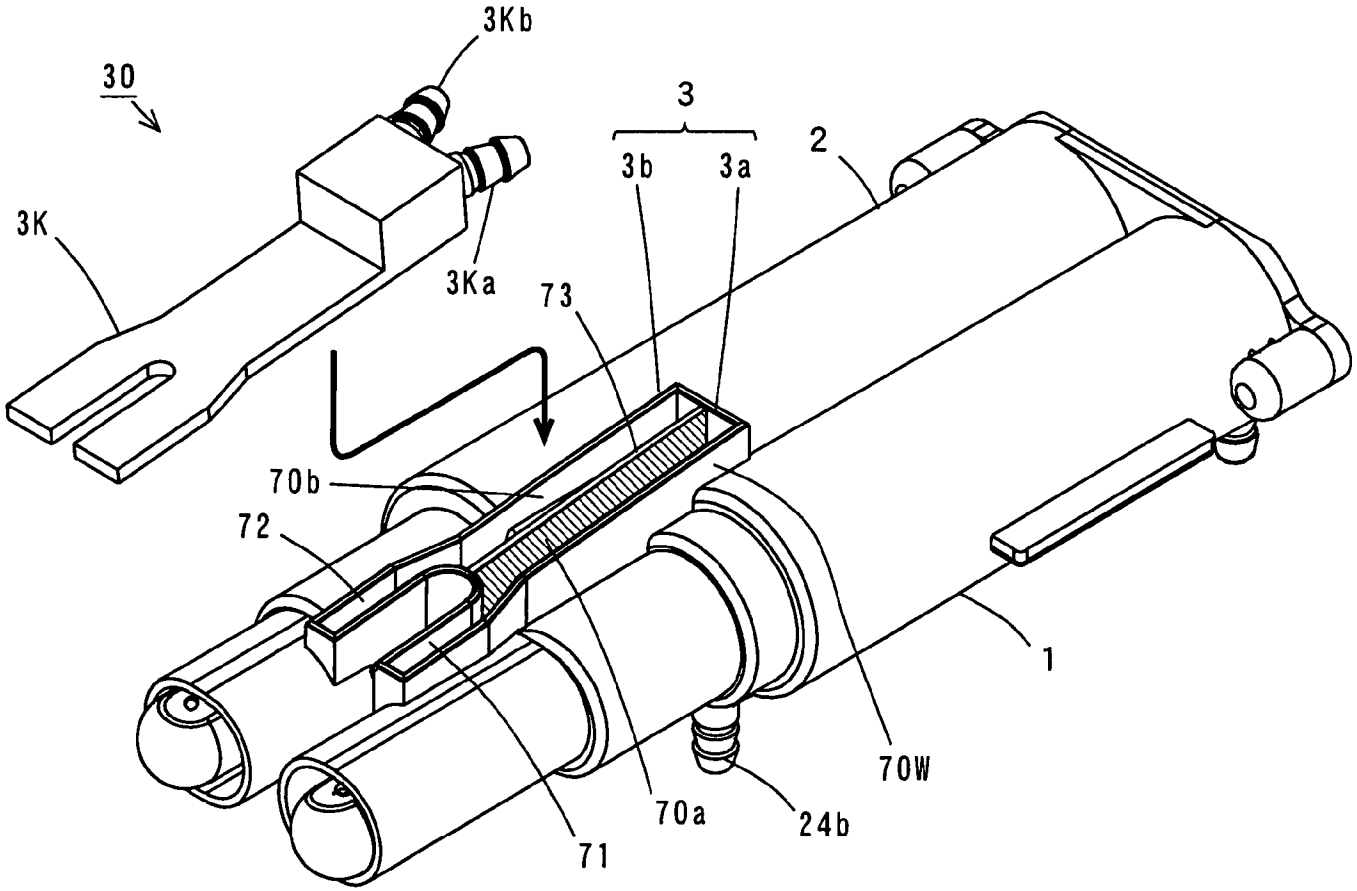
FIG. 46 is a perspective view showing the appearance of a nozzle unit in the fifth embodiment.

Here, the details of the first cleaning nozzle 3*a* and the second cleaning nozzle 3*b* shown in FIG. 45 will be described. FIG. 46 is a perspective view showing the appearance of the nozzle unit 30 in the fifth embodiment.

Although in FIG. 46, the nozzle unit 30 according to the fifth embodiment has approximately the same configuration as the nozzle unit 30 shown in FIG. 32 according to the third embodiment, the nozzle cleaning nozzle 3 comprises the first cleaning nozzle 3*a* and the second cleaning nozzle 3*b*.

The first cleaning nozzle 3*a* comprises a sidewall 70W formed integrally with the posterior nozzle 1, a boundary member 73, and a sealing member 3K. The second cleaning nozzle 3*b* comprises a sidewall 70W formed integrally with the bidet nozzle 2, the boundary member 73, and the sealing member 3K. The first cleaning nozzle 3*a* and the second cleaning nozzle 3*b* are integrally formed through the boundary member 73.

The sealing member 3K is mounted on an upper surface of the sidewall 70W and the boundary member 73 (an arrow E in FIG. 32), so that a first washing water introduction space 70*a*, a second washing water introduction space 70*b*, a first nozzle cleaning flow path 71, and a second nozzle cleaning flow path 72 are formed.

The first washing water introduction space 70*a* communicates with the exterior through a through-hole provided in a washing water introduction member 3Ka positioned at a rear end of the sealing member 3K. The second washing water introduction space 70*b* communicates with the exterior through a through-hole provided in a washing water introduction member 3Kb positioned at the rear end of the sealing member 3K.

The first nozzle cleaning flow path 71 formed so as to extend from the first washing water introduction space 70*a* is positioned on the upper surface on the side of the posterior nozzle 1. The second nozzle cleaning flow path 72 formed so as to extend from the second washing water introduction space 70*b* is positioned on the upper surface on the side of the bidet nozzle 2.

Tubes (not shown) or the like are respectively attached to the washing water introduction members 3Ka and 3Kb in the sealing member 3K. The washing water introduction members 3Ka and 3Kb are respectively connected to arbitrary washing water outlets in the switching valve 14A through the tubes. Consequently, the washing water is supplied to the first cleaning nozzle 3*a* and the second cleaning nozzle 3*b* through the tubes.

Description is now made of the operations of the main body 200 in a case where the user presses the posterior nozzle cleaning switch 311 or the bidet nozzle cleaning switch 312 on the basis of FIG. 45.

When the user presses the posterior nozzle cleaning switch 311, the controller 4 shown in FIG. 45 performs the following operations, for example.

The controller 4 receives a signal of the nozzle cleaning switch 311 that is fed from the remote control device 300 to drive the pump 13, to control the temperature of the ceramic heater 505 in the heat exchanger 11 shown in FIG. 4. Washing water is supplied to the first cleaning nozzle 3*a* from the pump 13 by rotating the motor M3 in the switching valve 14A. Consequently, the washing water is sprayed from the first cleaning nozzle 3*a* to the posterior nozzle 1, so that the posterior nozzle 1 is subjected to nozzle cleaning.

The foregoing series of operations are also performed in a case where the user presses the bidet nozzle cleaning switch 312. In this case, washing water supplied to the second cleaning nozzle 3*b* from the pump 13 is sprayed to the bidet nozzle 2, so that the bidet nozzle 2 is subjected to nozzle cleaning.

The posterior nozzle 1 and the bidet nozzle 2 can be thus individually subjected to nozzle cleaning. Even when the flow rate of the washing water obtained by driving the pump 13 is low, therefore, all the washing water supplied from the pump 13 is used for individual nozzle cleaning, so that nozzle cleaning can be done at a sufficient flow rate. As a result, each of the posterior nozzle 1 and the bidet nozzle 2 is kept clean by doing nozzle cleaning.

In the operations of the controller 4, the controller 4 may make the driving capability of the pump 13 low when the pump 13 is driven. In this case, the driving capability of the pump 13 is made low so that the temperature of washing water to be heated by the heat exchanger 11 rises. Consequently, high-temperature washing water is supplied to the first cleaning nozzle 3*a*, so that the posterior nozzle 1 is cleaned using the high-temperature washing water. As a result, a superior cleaning effect and sterilizing effect can be obtained at the time of nozzle cleaning by setting the temperature of the washing water to about 60° C.

Although the flow rate of the washing water supplied to the first cleaning nozzle 3*a* from the pump 13 is reduced in this case, all the washing water discharged from the pump 13 is not distributed but is supplied only to the first cleaning nozzle 3*a*. Therefore, the flow rate of the washing water at the time of the nozzle cleaning can be made higher, as compared with that in a configuration in which washing water discharged by the pump 13 is distributed to clean the posterior nozzle 1 and the bidet nozzle 2 at one time, as in the third embodiment.

The temperature of the washing water may be adjusted by adjusting power to the heat exchanger 11.

When nozzle cleaning is done using the high-temperature washing water, the controller 4 does not perform a nozzle cleaning operation when the seating sensor 51 detects the human body on the toilet seat 400, as in the third embodiment.

In the third, fourth and fifth embodiments, the posterior nozzle 1 and the bidet nozzle 2 correspond to a human body washing nozzle, the spray hole 401*a* corresponds to a spray hole, the nozzle cleaning cylinders 26 and 26*c* correspond to a nozzle cleaning member, the nozzle cleaning holes 26*h* and 26*hb* correspond to a washing water introduction hole, the cylinders 21 and 21*d* correspond to a cylinder, the pistons 20 and 20*b* correspond to a piston, the one-flow path pipe 403 corresponds to a pipe, the nozzle cover 401 corresponds to a cover member, the orifice 25 corresponds to a hole, and the flow path merger 404 corresponds to a spray member.

Furthermore, the switching valve 14A and the pump 13 correspond to first washing water supply means, the switching valve 14A, the relief water switching valve 14B, the supply water path 266, and the pump 13 correspond to second washing water supply means, the heat exchanger 11 and the instantaneous heating device 11X correspond to a heating device, the seating sensor 51 corresponds to a human body detection sensor, the branched pipe 205 corresponds to a branched pipe, and the controller 4 corresponds to a controller.

Sixth Embodiment

A sanitary washing apparatus 100 according to a sixth embodiment has the same configuration and operations as those of the sanitary washing apparatus 100 according to the first embodiment except for the following points.

Figure 47:
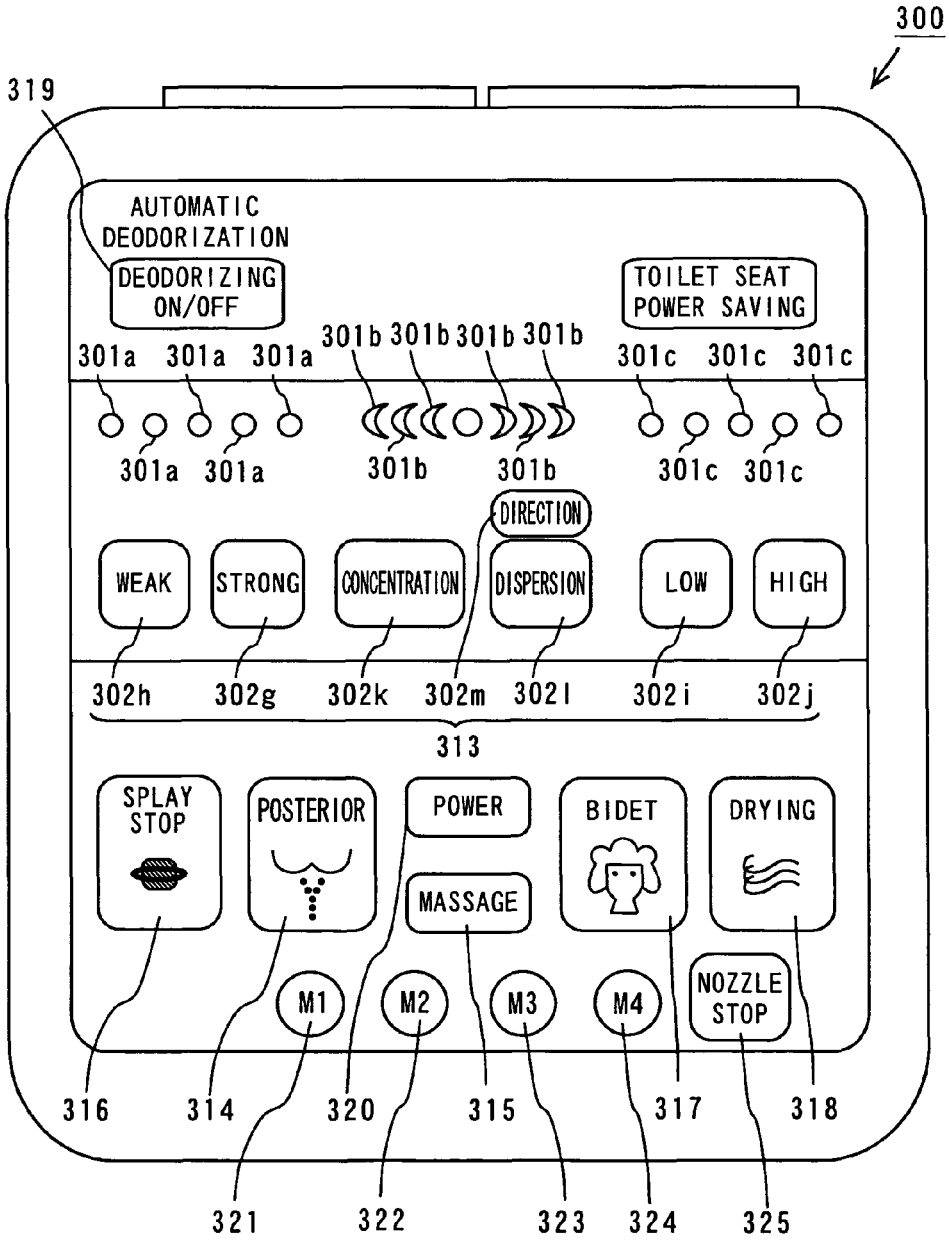
FIG. 47 is a schematic view showing an example of a remote control device according to a sixth embodiment.

FIG. 47 is a schematic view showing an example of a remote control device 300 according to the sixth embodiment.

As shown in FIG. 47, the remote control device 300 comprises a plurality of LEDs (Light Emitting Diodes) 301*a*, 301*b*, and 301*c*, a plurality of adjustment switches 313, a posterior switch 314, a massage switch 315, a spray stop switch 316, a bidet switch 317, a drying switch 318, a deodorizing switch 319, a power switch 320, mode switches 321 to 324, and a nozzle stop switch 325.

The adjustment switch 313, the posterior switch 314, the massage switch 315, the spray stop switch 316, the bidet switch 317, the drying switch 318, the deodorizing switch 319, the power switch 320, the mode switches 321 to 324, and the nozzle stop switch 325 are pressed by a user. Consequently, the remote control device 300 transmits by radio a predetermined signal to a controller provided in a main body 200 in a sanitary washing apparatus 100, described later. The controller in the main body 200 receives the predetermined signal transmitted by radio from the remote control device 300, to control a washing water supply mechanism or the like.

When the user presses any one of the mode switches 321 to 324, for example, washing water is sprayed in a predetermined spray form from a nozzle unit 30 while the nozzle unit 30 is moving. When the user presses the nozzle stop switch 325, the movement of the nozzle unit 30 is stopped. The spray form of the washing water in a case where each of the mode switches 321 to 324 is pressed will be described later.

The user presses the posterior switch 314 or the bidet switch 317, whereby the nozzle unit 30 shown in FIG. 1 moves so that washing water is sprayed. The massage switch 315 is pressed, whereby washing water for stimulating the private parts of the human body is sprayed from the nozzle unit 30 shown in FIG. 1. The power switch 320 is pressed, whereby a large amount of washing water is sprayed from the nozzle unit 30. The spray stop switch 316 is pressed, whereby the spray of the washing water from the nozzle unit 30 is stopped.

The drying switch 318 is pressed, whereby warm air is blown by a warm air supply device (not shown) in the sanitary washing apparatus 100 on the private parts of the human body. The deodorizing switch 319 is pressed, whereby a deodorizing device (not shown) in the sanitary washing apparatus 100 removes an odor from its surroundings.

The adjustment switch 313 comprises a water power strong adjustment switch 302*g*, a water power weak adjustment switch 302*h*, a temperature low adjustment switch 302*i*, a temperature high adjustment switch 302*j*, a spray form concentration adjustment switch 302*k*, a spray form dispersion adjustment switch 302*l*, and a spray form direction adjustment switch 302*m*.

The user presses the spray form concentration adjustment switch 302*k* and the spray form dispersion adjustment switch 302*l*, whereby the spray form of the washing water sprayed from the nozzle unit 30 shown in FIG. 1 is changed. The user presses the spray form direction adjustment switch 302*m*, whereby the direction of swirling of the washing water sprayed from the nozzle unit 30 is changed. The user presses the temperature low adjustment switch 302*i* and the temperature high adjustment switch 302*j*, whereby the temperature of the washing water sprayed from the nozzle unit 30 is changed.

Furthermore, the water power strong adjustment switch 302*g* and the water power weak adjustment switch 302*h* are pressed, whereby the water power (pressure) of the washing water sprayed from the nozzle unit 30 is changed. The change in the spray form of the washing water by pressing the spray form concentration adjustment switch 302*k* and the spray form dispersion adjustment switch 321 will be described later.

The plurality of LEDs (Light Emitting Diodes) 301*a* light up on as the water power strong adjustment switch 302*g* is pressed, while going out as the water power weak adjustment switch 302*h* is pressed. The plurality of LEDs (Light Emitting Diodes) 301*c* light up as the temperature high adjustment switch 302*j* is pressed, while going out as the temperature low adjustment switch 302*i* is pressed. The plurality of LEDs (Light Emitting Diodes) 301*b* light up as the spray form dispersion adjustment switch 302*l* is pressed, while going out as the spray form concentration adjustment switch 302*k* is pressed.

The main body 200 in the sanitary washing apparatus 100 according to the sixth embodiment will be described.

Figure 48:
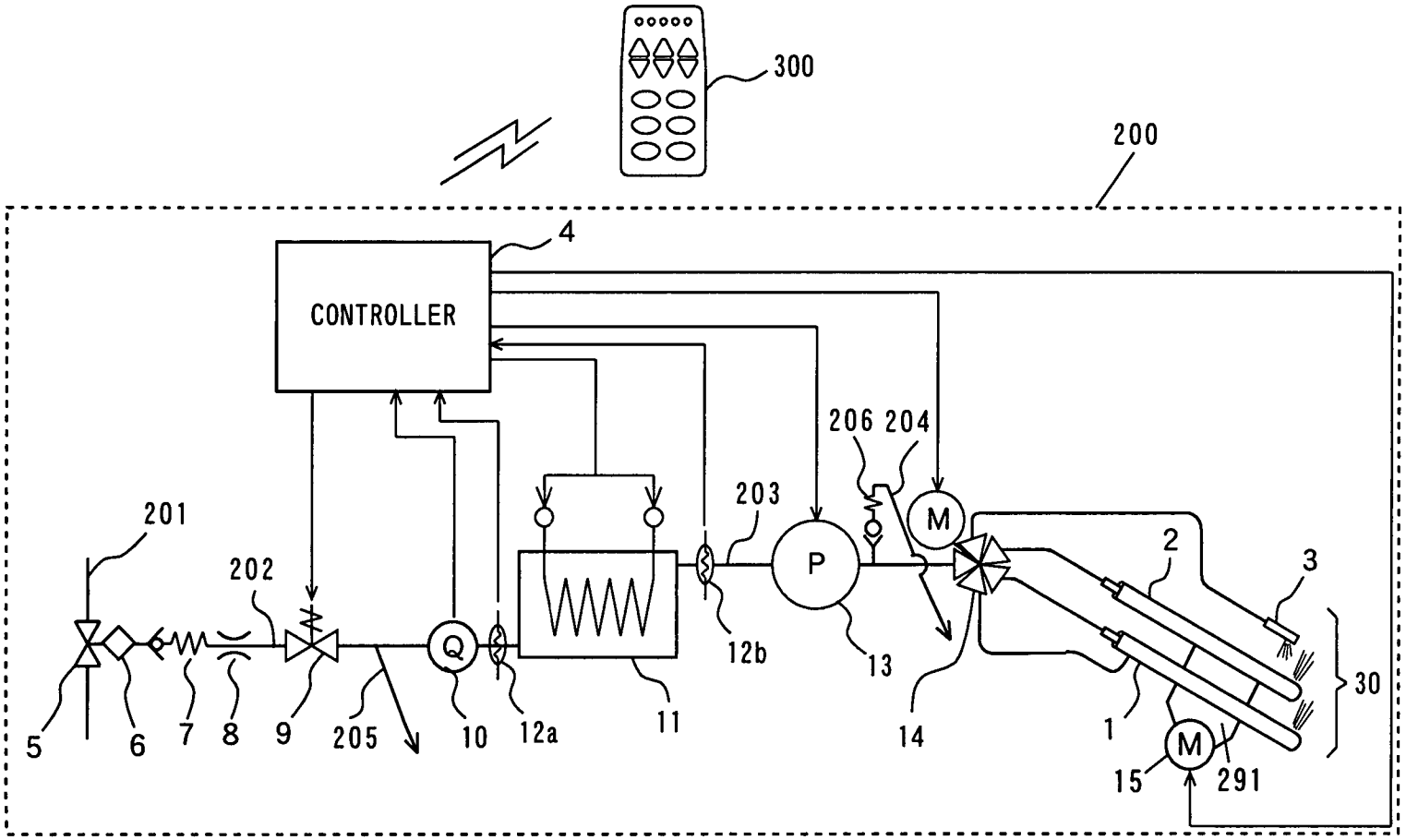
FIG. 48 is a schematic view showing the configuration of a main body in a sanitary washing apparatus according to the sixth embodiment.

FIG. 48 is a schematic view showing the configuration of the main body 200 in the sanitary washing apparatus 100 according to the sixth embodiment.

The main body 200 according to the sixth embodiment differs from the main body 200 shown in FIG. 3 according to the first embodiment in that a motor 15 for advancing or retreating and a holding stand 291 are further provided.

A controller 4 further feeds a control signal to the motor 15 for advancing or retreating on the basis of a signal transmitted by radio from the remote control device 300 shown in FIG. 1, a measured flow rate value given from a flow sensor 10, and measured temperature values respectively fed from temperature sensors 12*a* and 12*b*.

The control signal is fed to the motor 15 for advancing or retreating from the controller 4 so that the motor 15 for advancing or retreating is rotated, to perform an advancing or retreating operation of a posterior nozzle 1 and a bidet nozzle 2 that are held in the holding stand 291.

Figure 49:
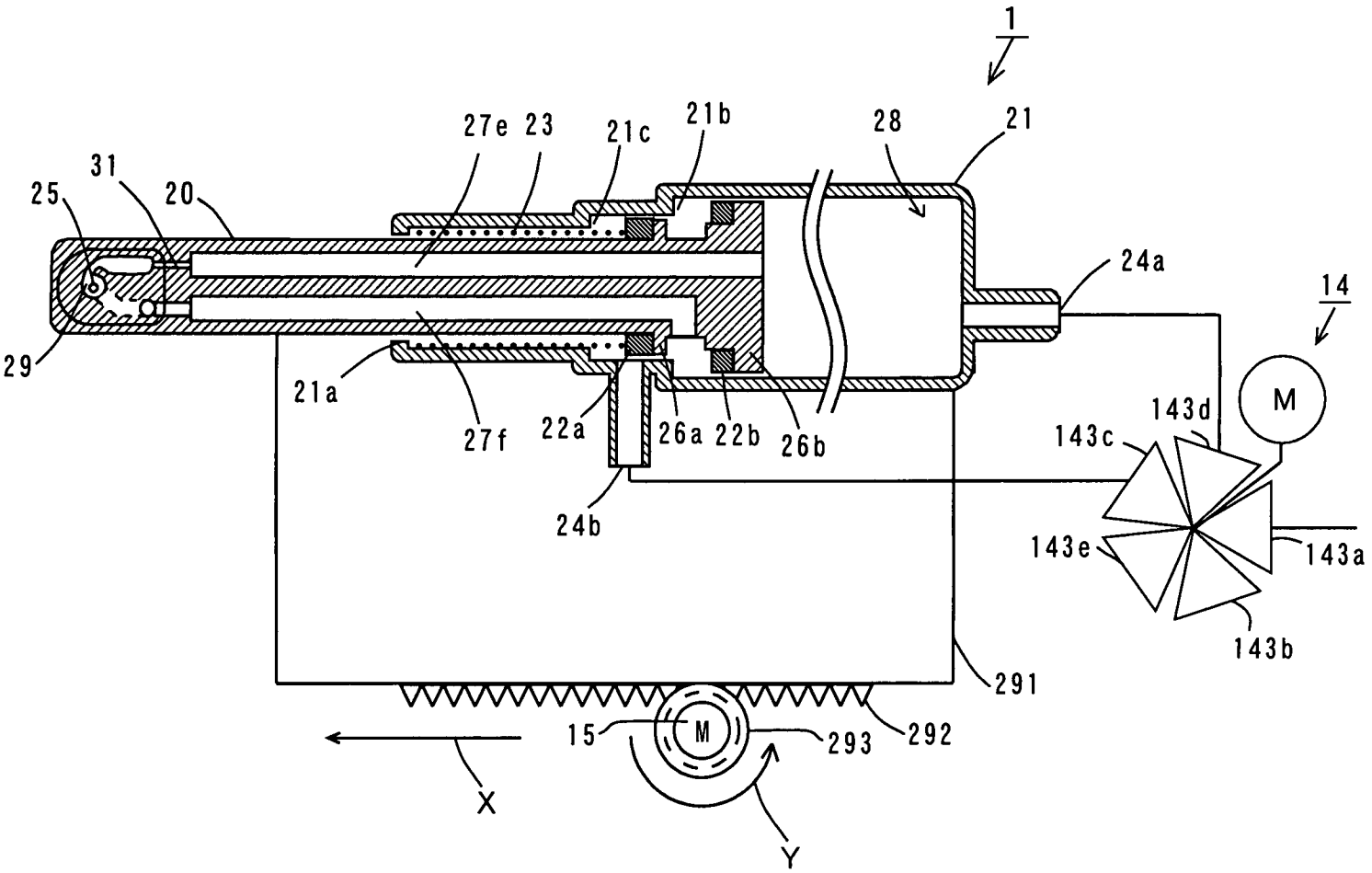
FIG. 49 is a schematic sectional view of a posterior nozzle and a switching valve shown in FIG. 48.

The posterior nozzle 1 in the nozzle unit 30 shown in FIG. 48 will be then described. FIG. 49 is a schematic sectional view of the posterior nozzle 1 and a switching valve 14 shown in FIG. 48. The configuration and the operations of the bidet nozzle 2 in the nozzle unit 30 are the same as those of the posterior nozzle 1 shown in FIG. 49. In FIG. 49, the bidet nozzle 2 and a nozzle cleaning nozzle 3 are not illustrated.

As shown in FIG. 49, the posterior nozzle 1 comprises a cylindrical piston 20, a cylindrical cylinder 21, seal packings 22*a* and 22*b*, and a spring 23.

A spray hole 25 for spraying washing water is formed in the vicinity of a front end of the piston 20. Flange-shaped stoppers 26*a* and 26*b* are provided at a rear end of the piston 20. Further, the seal packings 22*a* and 22*b* are respectively mounted on the stoppers 26*a* and 26*b*. Inside the piston 20, a first flow path 27*e* communicating with the spray hole 25 from its rear end is formed, and a second flow path 27*f* communicating with the spray hole 25 from a peripheral surface of the piston 20 between the stopper 26*a* and the stopper 26*b* is formed. Further, a cylindrical swirl chamber 29 is formed around the spray hole 25, and a flow-contracting portion 31 is inserted between the first flow path 27*e* and the cylindrical swirl chamber 29. The details of the configuration at the front end of the piston 20 will be described later.

On the other hand, the cylinder 21 comprises a small diameter portion at its front end, an intermediate portion having an intermediate diameter, and a large diameter portion at its rear end. Consequently, a stopper surface 21*c* against which the stopper 26*a* in the piston 20 can abut through the seal packing 22*a* is formed between the small diameter portion and the intermediate portion, and a stopper surface 21*b* against which the stopper 26*b* in the piston 20 can abut through the sealing packing 22*b* is formed between the intermediate portion and the large diameter portion. A washing water inlet 24*a* is provided on a rear end surface of the cylinder 21, a washing water inlet 24*b* is provided on a peripheral surface of the intermediate portion of the cylinder 21, and an opening 21*a* is provided on a front end surface of the cylinder 21. An inner space of the cylinder 21 is a temperature fluctuation buffering space 28. The washing water inlet 24*a* is provided eccentrically at a position different from the central axis of the cylinder 21. The washing water inlet 24*a* is connected to the washing water outlet 143*c* in the switching valve 14 shown in FIG. 8, and the washing water inlet 24*b* is connected to the washing water outlet 143*d* in the switching valve 14 shown in FIG. 8. When the piston 20 projects most greatly from the cylinder 21, the washing water inlet 24*b* communicates with the second flow path 27*f*. The details of the connection of the washing water inlet 24*b* to the second flow path 27*f* will be described later.

The piston 20 is inserted into the cylinder 21 so as to be movable such that the stopper 26*b* is positioned in the temperature fluctuation buffering space 28 and the front end projects from the opening 21*a*.

Furthermore, the spring 23 is disposed between the stopper 26*a* in the piston 20 and a peripheral edge of the opening 21*a* in the cylinder 21, to urge the piston 20 toward the rear end of the cylinder 21.

A micro-clearance is formed between an outer peripheral surface of the stopper 26*a* or 26*b* in the piston 20 and an inner peripheral surface of the cylinder 21, and a micro-clearance is formed between an outer peripheral surface of the piston 20 and an inner peripheral surface of the opening 21*a* in the cylinder 21.

The posterior nozzle 1 is fixed on a holding stand 291. A gear 292 is provided at one end of the holding stand 291 in the posterior nozzle 1. The gear 299 is engaged with a gear 293 fixed to the axis of rotation of a motor 15 for advancing or retreating. The motor 15 for advancing or retreating is rotated in a direction indicated by an arrow Y and an opposite direction to the direction indicated by the arrow Y in response to the control signal from the controller 4 so that the gear 293 fixed to the axis of rotation of the motor 15 for advancing or retreating is rotated, and is meshed with the gear 292 provided at one end of the nozzle holding stand 291. Accordingly, the nozzle holding stand 291 moves in a direction indicated by an arrow X and a direction opposite thereto. Thus, the posterior nozzle 1 performs an advancing or retreating operation while spraying washing water from the spray hole 25.

Consequently, a surface to be washed in a wide range can be washed, and a massage effect can be obtained.

Figure 50:
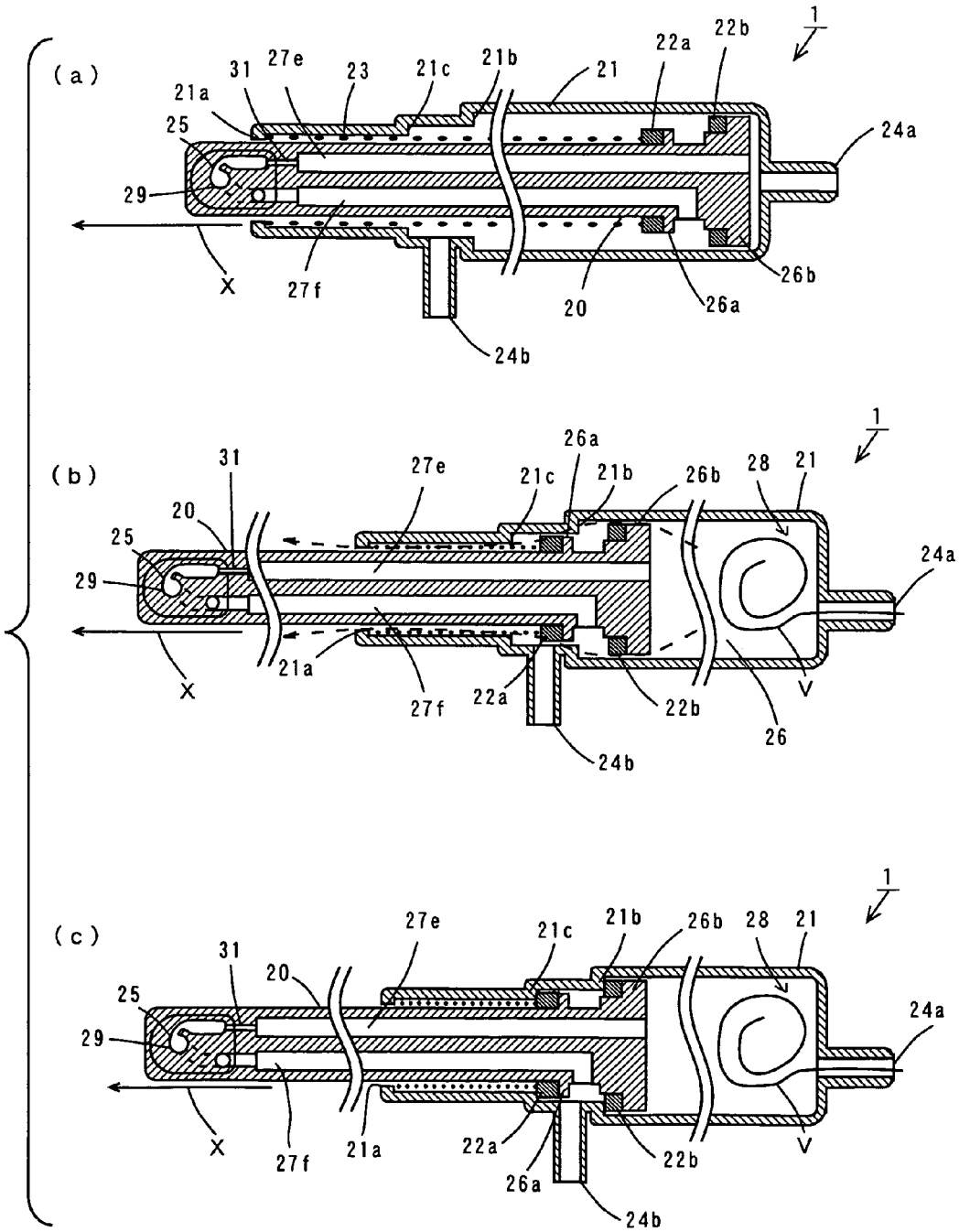
FIG. 50 is a cross-sectional view for explaining the operations of the posterior nozzle shown in FIG. 49.

Description is now made of the operations of the posterior nozzle 1 shown in FIG. 49. FIG. 50 is a cross-sectional view for explaining the operations of the posterior nozzle 1 shown in FIG. 49.

When no washing water is supplied from the washing water inlets 24*a* and 24*b* in the cylinder 21, as shown in FIG. 50(*a*), the piston 20 retreats in the opposite direction to the direction indicated by the arrow X by the elastic force of the spring 23, and is accommodated in the cylinder 21. As a result, the piston 20 enters a state where it does not project most greatly from the opening 21*a* in the cylinder 21. At this time, the temperature fluctuation buffering space 28 is not formed in the cylinder 21.

When the supply of washing water from the washing water inlet 24*a* in the cylinder 21 is then started, as shown in FIG. 50(*b*), the piston 20 gradually advances in the direction indicated by the arrow X against the elastic force of the spring 23 by the pressure of the washing water. Consequently, the temperature fluctuation buffering space 28 is formed in the cylinder 21, and the washing water flows into the temperature fluctuation buffering space 28.

Since the washing water inlet 24*a* is provided at a position eccentric from the central axis of the cylinder 21, the washing water flowing into the temperature fluctuation buffering space 28 flows in a swirling state, as indicated by an arrow V. A part of the washing water in the temperature fluctuation buffering space 28 flows out of the micro-clearance between the outer peripheral surface of the piston 20 and the inner peripheral surface of the opening 21*a* in the cylinder 21 through the micro-clearance between the outer peripheral surface of the stopper 26*a* or 26*b* in the piston 20 and the inner peripheral surface of the cylinder 21, and is supplied to the cylindrical swirl chamber 29 through the first flow path 27*a* in the piston 20, to be slightly sprayed from the spray hole 25. The details of the cylindrical swirl chamber 29 will be described later.

When the piston 20 further advances, the stoppers 26*a* and 26*b* are respectively brought into watertight contact with the stopper surfaces 21*c* and 21*b* in the cylinder 21 through the seal packings 22*a* and 22*b*, as shown in FIG. 50(*c*). Consequently, a flow path leading from the micro-clearance between the outer peripheral surface of the stopper 26*a* or 26*b* in the piston 20 and the inner peripheral surface of the cylinder 21 to the micro-clearance between the outer peripheral surface of the piston 20 and the inner peripheral surface of the opening 21*a* in the cylinder 21 is blocked off. Further, the washing water supplied from the washing water inlet 26*b* is supplied to the cylindrical swirl chamber 29 through the second flow path 27*b* in the piston 20. Consequently, the washing water supplied to the cylindrical swirl chamber 29 through the second flow path 27*f* in the piston 20 is mixed with the washing water supplied thereto through the first flow path 27*e* in the piston 20, and obtained mixed washing water is sprayed from the spray hole 25.

The washing water supplied from the washing water outlet 143*c* and the washing water supplied from the washing water outlet 143*d* in the switching valve 14 are thus introduced into the cylindrical swirl chamber 29 after respectively passing through the washing water inlets 24*a* and 24*b* in the cylinder 21 and the first flow path 27*e* and the second flow path 27*f* in the piston 20, and is sprayed from the spray hole 25 through the cylindrical swirl chamber 29.

Figure 51:
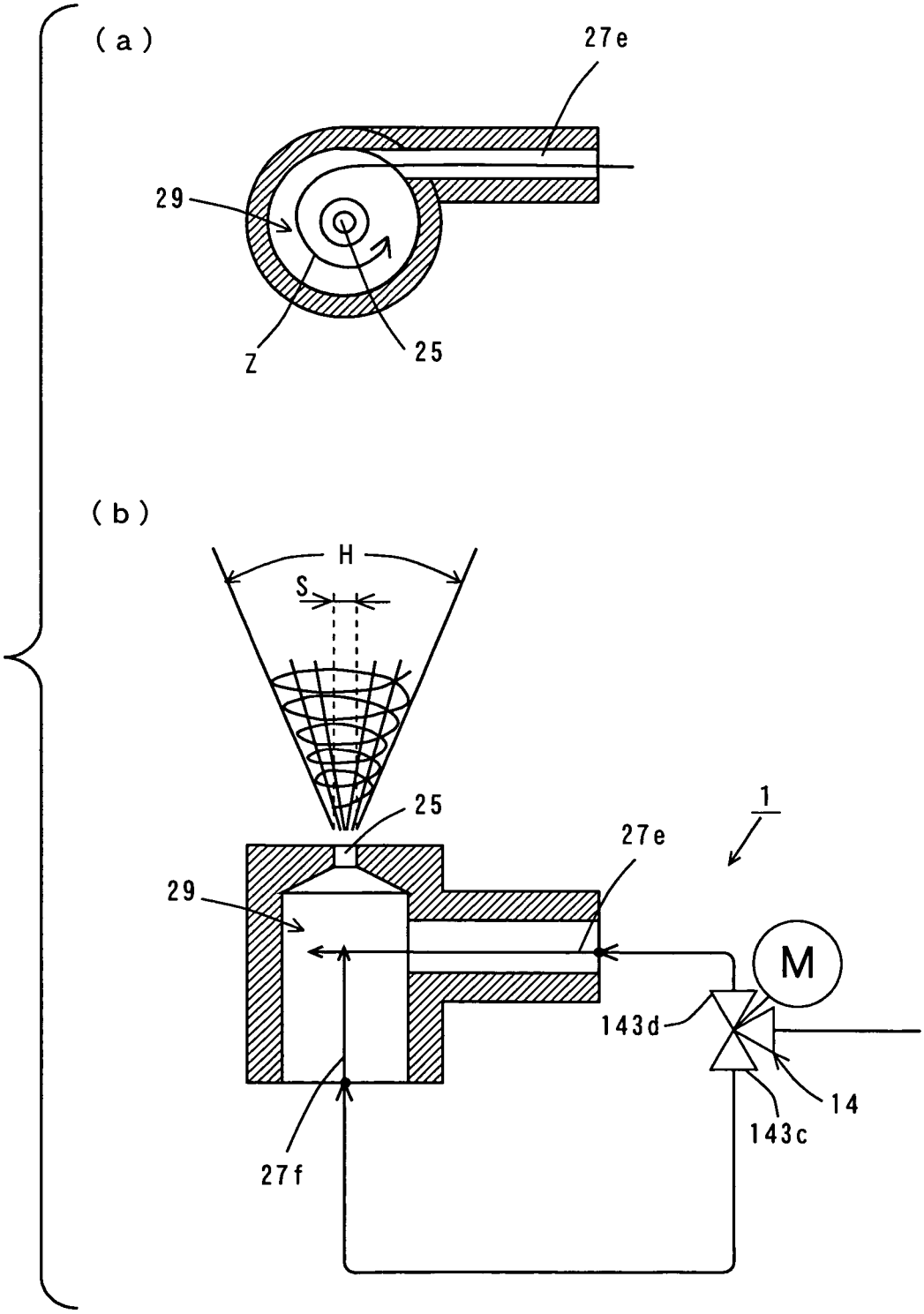
FIG. 51 is a schematic view showing a front end of a piston shown in FIG. 49.

FIG. 51 is a schematic view of the front end of the piston 20 shown in FIG. 49. FIG. 51(*a*) illustrates a case where the front end of the piston 20 is viewed from the top, and FIG. 51(*b*) illustrates a case where the front end of the piston 20 is viewed from the side.

As shown in FIG. 51(*b*), the first flow path 27*e* is first connected to a peripheral surface of the cylindrical swirl chamber 29, and the second flow path 27*f* is connected to a bottom surface of the cylindrical swirl chamber 29. The washing water from the washing water outlet 143*c* and the washing water from the washing water outlet 143*d* in the switching valve 14 are respectively supplied to the first flow path 27*e* and the second flow path 27*f*.

As shown in FIG. 51(*a*), the washing water supplied to the cylindrical swirl chamber 29 from the first flow path 27*e* flows in a swirling state indicated by an arrow Z by a curved shape of the inner peripheral surface of the cylindrical swirl chamber 29. On the other hand, the washing water supplied to the cylindrical swirl chamber 29 from the second flow path 27*b* flows in a linear state vertically upward.

The washing water in the swirling state in the first flow path 27*e* and the washing water in the linear state in the second flow path 27*f* are thus mixed with each other in the cylindrical swirl chamber 29, and obtained mixed washing water is sprayed from the spray hole 25.

When the flow rate of the washing water supplied from the first flow path 27*e* is higher than the flow rate of the washing water supplied from the second flow path 27*f*, for example, the washing water to be mixed in the cylindrical swirl chamber 29 is sprayed as dispersed spiral flow at a wider angle indicated by an arrow H in FIG. 51(*b*) in order to strongly maintain the swirling state caused by the curved shape of the cylindrical swirl chamber 29. When the user presses the spray form dispersion adjustment switch 302*l*, the washing water is sprayed as dispersed spiral flow, as described above.

On the other hand, when the flow rate of the washing water supplied from the second flow path 27*f* is higher than the flow rate of the washing water supplied from the first flow path 27*e*, the washing water to be mixed in the cylindrical swirl chamber 29 is sprayed as linear flow at a narrow angle indicated by an arrow S shown in FIG. 51(*b*) in order to strongly maintain the linear state. When the user presses the spray form concentration adjustment switch 302*k*, the washing water is sprayed as linear flow, as described above.

Consequently, the controller 4 controls the motor M in the switching valve 14 to change the ratio of the respective flow rates at the washing water outlets 143*c* and 143*d*, so that the spray form of the washing water sprayed from the spray hole 25 is changed.

In the sixth embodiment, when the water power adjustment switch 302*g* is pressed, the flow rate of the washing water at the washing water outlet 143*c* is higher than the flow rate of the washing water at the washing water outlet 143*d*, so that the spray form of the washing water approaches linear flow. When the water power adjustment switch 302*h* is pressed, the flow rate of the washing water at the washing water outlet 143*d* is higher than the flow rate at the washing water outlet 143*c*, so that the spray form of the washing water approaches dispersed spiral flow.

Description is now made of the spray form of washing water according to the sixth embodiment. In the sixth embodiment, the washing water is sprayed in various types of spray forms while the posterior nozzle 1 is moving between its forward position and its backward position by the motor 15.

Figure 52:
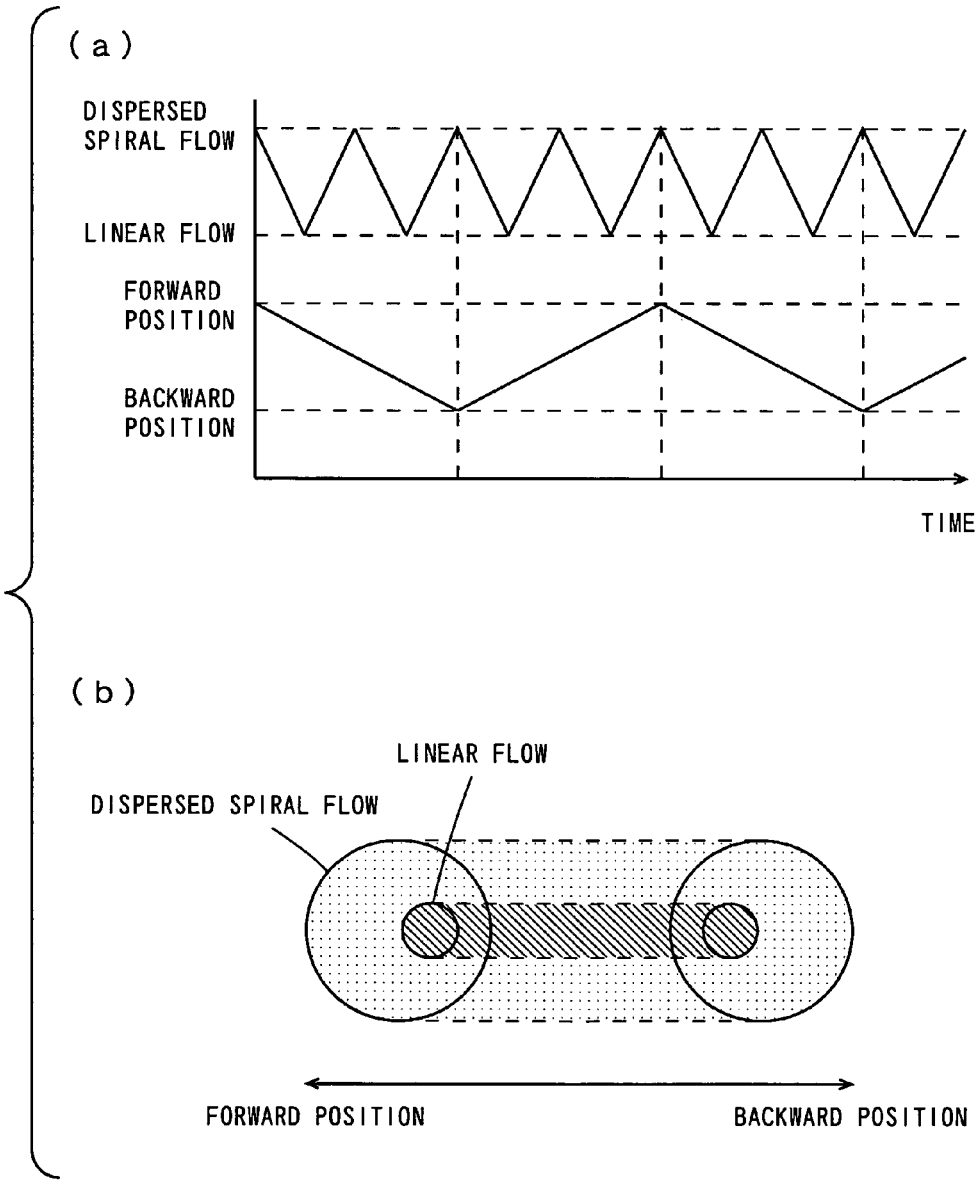
FIG. 52 is a schematic view showing a first example of the spray form of washing water in the sixth embodiment.

FIG. 52 is a schematic view showing a first example of the spray form of washing water according to the sixth embodiment.

FIG. 52(*a*) is a schematic view showing the change in the spray form of washing water with an elapse of time and the change in the position of the posterior nozzle 1, and FIG. 52(*b*) is a plan view showing in a pseudo manner the change in the spray form shown in FIG. 52(*a*). The spray form of washing water shown in FIG. 52 is executed by a user pressing the mode switch 321.

In FIG. 52(*a*), the horizontal axis indicates time, and the vertical axis indicates the spray form of washing water and the position of the posterior nozzle 1 that moves simultaneously with the spray of the washing water.

First, the posterior nozzle 1 starts to move toward a backward position from a forward position, and dispersed spiral flow is sprayed from the spray hole 25. Thereafter, the divergent angle of the dispersed spiral flow gradually decreases, so that linear flow is sprayed. Further, the divergent angle from the linear flow to the dispersed spiral flow gradually increases. The dispersed spiral flow and the linear flow are alternately switched in a time period elapsed until the posterior nozzle 1 moves to the backward position.

After the posterior nozzle 1 moves to the backward position, the posterior nozzle 1 starts to move to the forward position by return. In this case, the dispersed spiral flow and the linear flow are also alternately switched in a time period elapsed until the posterior nozzle 1 moves to the forward position.

In this case, a washing range of washing water sprayed to the private parts of the human body is a range, in which a circle represented by a dot pattern moves, formed by the dispersed spiral flow, as shown in FIG. 52(*b*). Within the movement range of the dispersed spiral flow, a linear washing range, indicated by hatching, formed by the linear flow is formed.

Consequently, a range in which the density of washing water is high is also formed by the linear flow at the center of the washing range in which the density of washing water is low. Thus, a wide range of the private parts of the human body can be sufficiently washed.

Furthermore, washing water scattered to the peripheries of the private parts of the human body by the linear flow having water power can be washed away by the dispersed spiral flow. Therefore, the private parts of the human body are kept cleaner.

Although in the present embodiment, the spray forms of washing water at the forward position and the backward position are taken as the dispersed spiral flow, the present invention is not limited to the same. They may be the linear flow.

Figure 53:
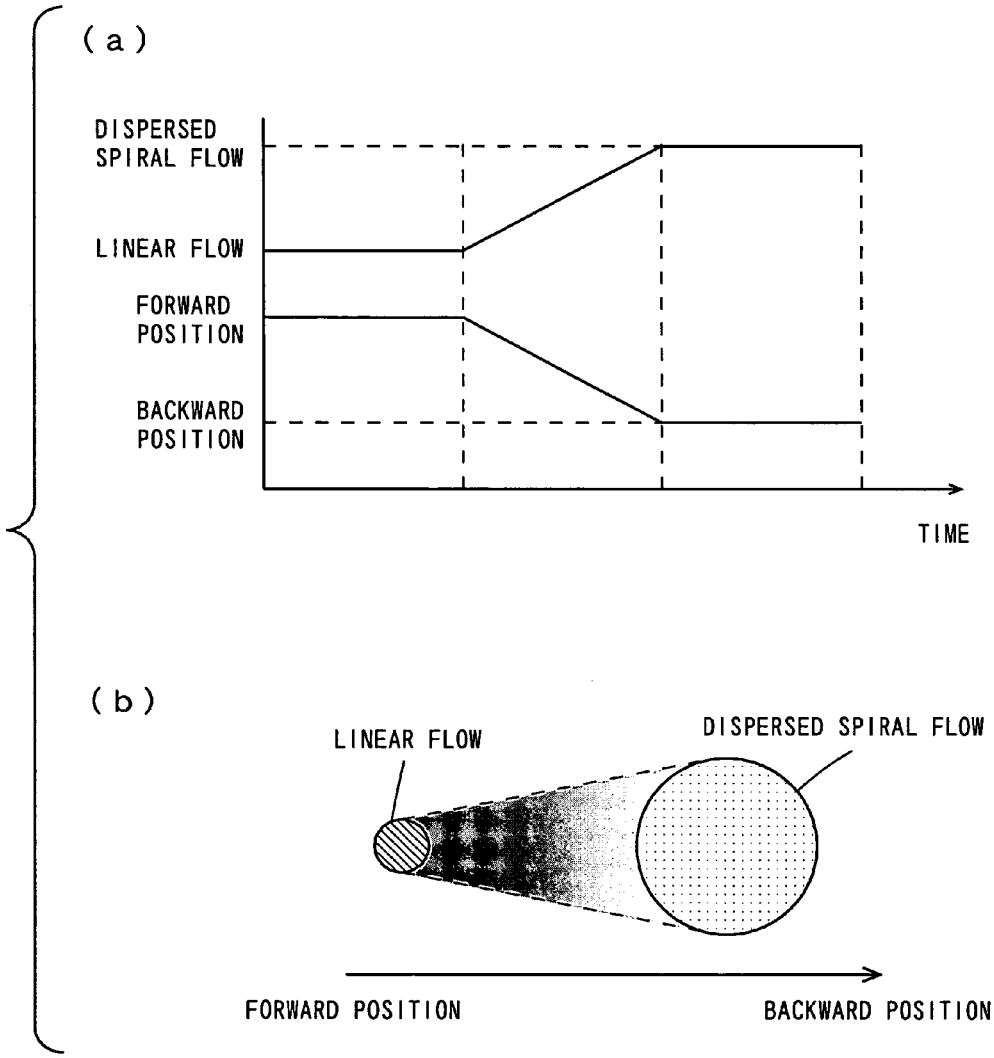
FIG. 53 is a schematic view showing a second example of the spray form of washing water in the sixth embodiment.

FIG. 53 is a schematic view showing a second example of the spray form of washing water according to the sixth embodiment.

FIG. 53(*a*) is a schematic view showing the change in the spray form of washing water with an elapse of time and the change in the position of the posterior nozzle 1, and FIG. 53(*b*) is a plan view showing in a pseudo manner the change in the spray form shown in FIG. 53(*a*). The spray form of washing water shown in FIG. 53 is executed by a user pressing the mode switch 322.

In FIG. 53(*a*), the horizontal axis indicates time, and the vertical axis indicates the spray form of washing water and the position of the posterior nozzle 1 that moves simultaneously with the spray of the washing water.

First, linear flow is sprayed from the spray hole 26 in a state where the posterior nozzle 1 is stopped for a predetermined time period at a forward position. Thereafter, the posterior nozzle 1 moves from the forward position to a backward position by the motor 15, and the divergent angle from the linear flow to the dispersed spiral flow gradually increases.

When the posterior nozzle 1 moves to the backward position, the divergent angle of the dispersed spiral flow reaches its maximum, so that dispersed spiral flow is sprayed from the spray hole 25 in a state where the posterior nozzle 1 is stopped for a predetermined time period at the backward position.

In this case, in a washing range of washing water sprayed to the private parts of the human body, a circular washing range by the linear flow is gradually expanded as the divergent angle of the dispersed spiral flow increases. Consequently, a wide range of the private parts of the human body can be sufficiently washed. At the time of female's urine, it is expected that the female private parts are effectively washed.

Figure 54:
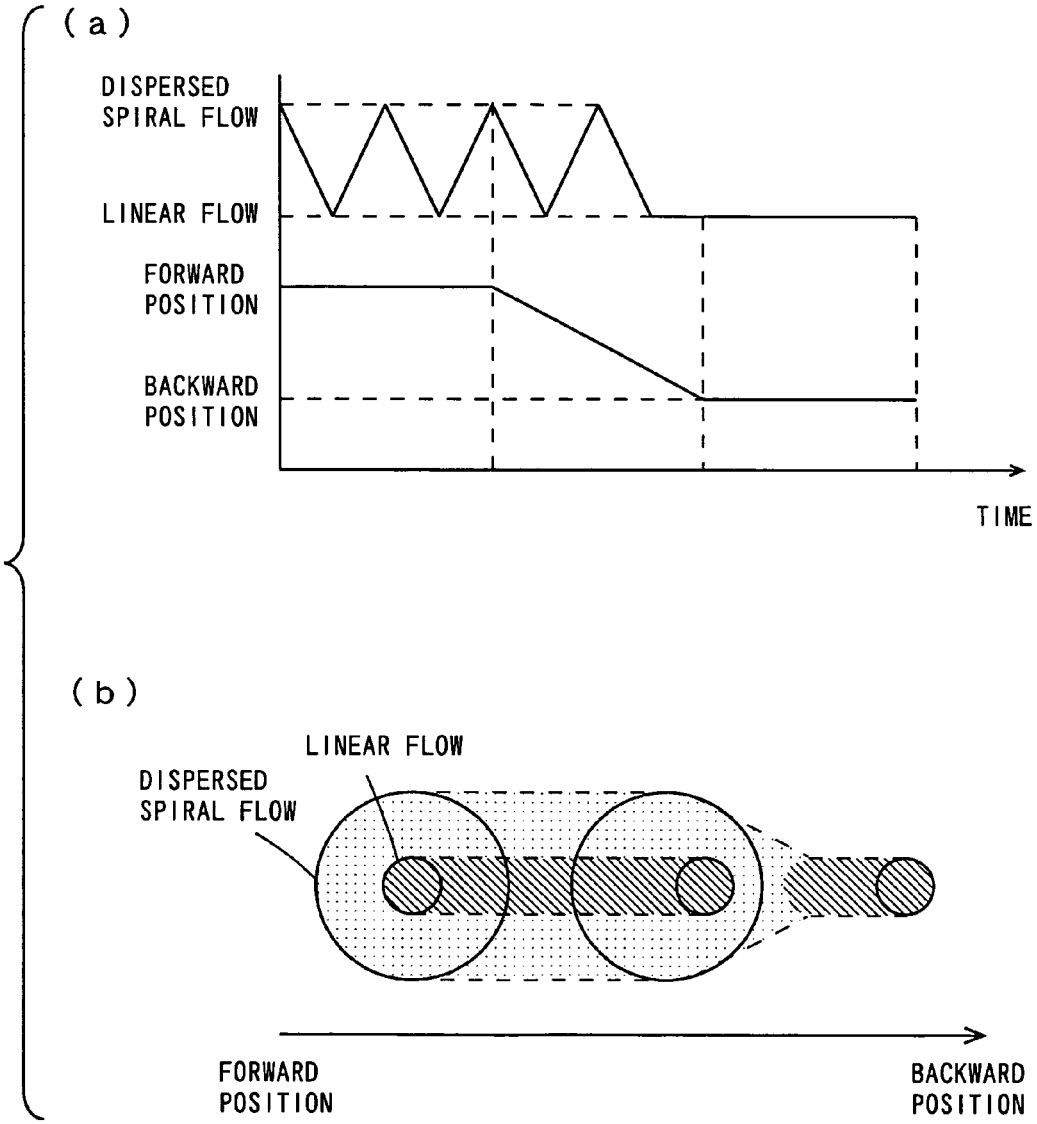
FIG. 54 is a schematic view showing a third example of the spray form of washing water in the sixth embodiment.

FIG. 54 is a schematic view showing a third example of the spray form of washing water according to the sixth embodiment.

FIG. 54(*a*) is a schematic view showing the change in the spray form of washing water with an elapse of time and the change in the position of the posterior nozzle 1, and FIG. 54(*b*) is a plan view showing in a pseudo manner the change in the spray form shown in FIG. 54(*a*). The spray form of washing water shown in FIG. 54 is executed by a user pressing the mode switch 323.

In FIG. 54(*a*), the horizontal axis indicates time, and the vertical axis indicates the spray form of washing water and the position of the posterior nozzle 1 that moves simultaneously with the spray of the washing water.

First, dispersed spiral flow and linear flow are alternately sprayed from the spray hole 25, as in the example shown in FIG. 52, in a state where the posterior nozzle 1 is stopped for a predetermined time period at a forward position.

Furthermore, the posterior nozzle 1 starts to move toward a backward position from the forward position while dispersed spiral flow and linear flow are alternately sprayed from the spray hole 25.

Thereafter, the washing water sprayed from the spray hole 26 becomes linear flow before the posterior nozzle 1 reaches the backward position.

After the posterior nozzle 1 reaches the backward position, the linear flow is sprayed for a predetermined time period in a state where the posterior nozzle 1 is stopped.

In this case, a washing range of washing water sprayed to the private parts of the human body is a range, in which a circle represented by a dot pattern moves, formed by the dispersed spiral flow, as shown in FIG. 54(*b*). Within the movement range of the dispersed spiral flow, a linear washing range, indicated by hatching, formed by the linear flow is formed. In addition thereto, the washing range formed by the dispersed spiral flow is gradually reduced, so that the washing range formed by the linear flow is formed.

Consequently, a wide range of the private parts of the human body can be sufficiently washed. Further, a washing effect serving as a bidet for cleaning the female private parts is expected.

Figure 55:
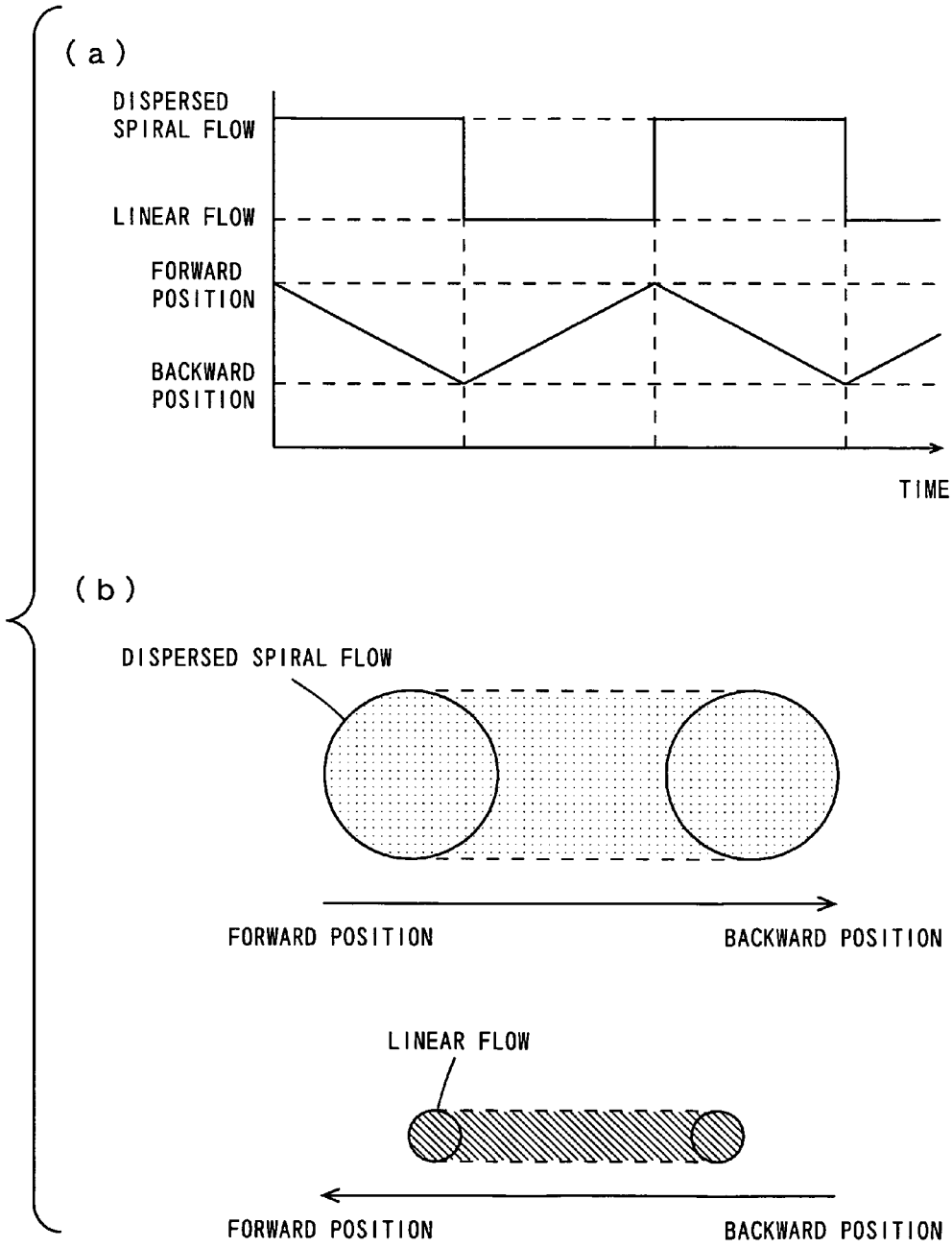
FIG. 55 is a schematic view showing a fourth example of the spray form of washing water in the sixth embodiment.

FIG. 55 is a schematic view showing a fourth example of the spray form of washing water according to the sixth embodiment.

FIG. 55(*a*) is a schematic view showing the change in the spray form of washing water with an elapse of time and the change in the position of the posterior nozzle 1, and FIG. 55(*b*) is a plan view showing in a pseudo manner the change in the spray form shown in FIG. 55(*a*). The spray form of washing water shown in FIG. 55 is executed by a user pressing the mode switch 324.

In FIG. 55(*a*), the horizontal axis indicates time, and the vertical axis indicates the spray form of washing water and the position of the posterior nozzle 1 that moves simultaneously with the spray of the washing water.

First, dispersed spiral flow is sprayed from the spray hole 25 while the nozzle 1 is moving from a forward position toward a backward position, and is instantaneously switched to linear flow at the same time that the posterior nozzle 1 reaches the backward position.

The linear flow is then sprayed from the spray hole 25 while the posterior nozzle 1 is moving toward the forward position, and is immediately switched to the dispersed spiral flow at the same time that the posterior nozzle 1 reaches the forward position. Thereafter, this operation is repeated for a predetermined time period.

In this case, when the posterior nozzle 1 moves from the forward position to the backward position, a washing range of washing water sprayed to the private parts of the human body is a range, in which a circle represented by a dot pattern moves, formed by the dispersed spiral flow, as shown in FIG. 55(*b*). On the other hand, when the posterior nozzle 1 moves from the backward position to the forward position, a washing range of washing water sprayed to the private parts of the human body is a linear range, indicated by hatching, formed by the linear flow.

Consequently, a wide range of the private parts of the human body can be sufficiently washed. Further, it is expected that loose faces and child's wetting or soiling are effectively washed.

In the sixth embodiment, the pump 13 corresponds to pressure means, the switching valve 14 corresponds to divergent angle adjustment means and flow rate adjustment means, the posterior nozzle 1, the bidet nozzle 2, and the nozzle cleaning nozzle 3 correspond to a nozzle device, the first flow path 27*e* corresponds to a first flow path, the second flow path 27*f* corresponds to a second flow path, the cylindrical swirl chamber 29 corresponds to rotating flow generation means, the heat exchanger 11 corresponds to heating means and an instantaneous heating device, the motor 15 for advancing or retreating corresponds to advancing and retreating driving means, the remote control device 300 corresponds to setting means, and the controller 4 corresponds to control means.

The spray form of washing water shown in FIGS. 52 to 55 is taken as an example. The present invention is not limited to the same. The change in the spray form of washing water for another effective washing and a method of moving the posterior nozzle 1 can be arbitrarily set, provided that the gist of the spray form of washing water is not changed.

The water pressure of the washing water sprayed from the spray hole 25 can be also changed by also pressing the water power strong adjustment switch 302*g* or the water power weak adjustment switch 302*h*, thereby making it possible to do washing further conforming to the taste, physical conditions, or the like of the user.

A time period during which the dispersed spiral flow and the linear flow are sprayed and the movement speed of the posterior nozzle 1 can be suitably set.

The invention claimed is:

1. A nozzle device, comprising:

a cylinder; and a piston configured to advance in a first direction to project from the cylinder and retreat in an opposing direction, which is opposite to the first direction, such that the piston is accommodated within the cylinder, wherein the piston includes:

a spray hole for spraying washing water;

a pipe forming a first flow path configured to extend in the first direction; and a cover member that includes a peripheral wall having a cylindrical shape configured to both surround the pipe and extend in the first direction, a front end of the cover member extending traverse to the first direction, the peripheral wall and the front end of the cover member being integrally formed of a cylindrical metal, the peripheral wall of the cover member having an upper surface extending in the first direction, wherein the spray hole is provided on the upper surface, and the front end of the cover member is closed so as to prevent the washing water from exiting therethrough in the first direction, a space between an outer surface of the pipe and an inner peripheral surface of the peripheral wall of the cover member forming a second flow path configured to cause the washing water to flow in the first direction, the second flow path being configured to surround the outer surface of the pipe in a circumferential direction of the cover member, the nozzle device further comprising:

a spray member configured to merge the washing water to be supplied from the first flow path and the washing water to be supplied from the second flow path and introduce the merged washing water into the spray hole to cause the washing water to be sprayed from the spray hole in a second direction traverse to the first direction, the spray member being provided between the front end of the pipe and the cover member.

2. The nozzle device according to claim 1, further comprising:

the spray member having an internal space with an opening at one end and an orifice at another end, the first flow path configured to introduce the washing water into the internal space from an open end in the first flow path, the second flow path configured to introduce the washing water to the internal space from a peripheral surface of the spray member, and the internal space having a cross-sectional area that gradually or continuously decreases from the opening to the orifice.

3. The nozzle device according to claim 2, wherein, in order from the opening to the orifice, the internal space includes first, second and third spaces having a common axis extending in the second direction, and the first, second, and third spaces have circular cross sections of which centers are on the common axis, a diameter of the circular cross section of the second space is smaller than a diameter of the circular cross section of the first space, and a diameter of the circular cross section of the third space is smaller than the diameter of the circular cross section of the second space, the second flow path is configured to supply the washing water to the second space.

4. The nozzle device according to claim 3, wherein the second space comprising a cylindrical space, and the second flow path is configured to supply washing water along an inner peripheral surface of the cylindrical space.

5. The nozzle device according to claim 4, wherein an axis of the second flow path is directed inward from a peripheral wall of the cylindrical space.

6. The nozzle device according to claim 3, wherein the diameter of the circular cross section of the first space continuously decreases from the opening to the second space.

7. The nozzle device according to claim 3, wherein the diameter of the circular cross section of the third space continuously decreases from the second space to the orifice.

8. The nozzle device according to claim 4, wherein the inner diameter of the cylindrical space is two times to five times the inner diameter of the orifice.

9. The nozzle device according to claim 2, wherein a cross-sectional area of the first flow path is larger than a cross-sectional area of the opening of the internal space.

10. The nozzle device according to claim 1, wherein the spray hole is formed on the surface extending in the first direction in a vicinity of a front end of the cover member, and the spray member is inserted into the front end of the cover member.

11. The nozzle device according to claim 1, wherein the front end of the cover member has a substantially hemispherical shape.

12. The nozzle device according to claim 1, wherein the cylindrical metal is stainless.

13. The nozzle device according to claim 1, wherein the cover member is formed by drawing forming.

14. The nozzle device according to claim 1, wherein a part of the surface extending in the first direction in a vicinity of the front end of the cover member is formed so as to have a flat surface, and the spray hole is formed on the flat surface.

15. The nozzle device according to claim 1, wherein the spray hole has a larger inner diameter than the orifice.

16. The nozzle device according to claim 1, wherein the spray member has a positioner abutting against an inner surface of the front end of the cover member such that the orifice is positioned relative to the spray hole.

17. The nozzle device according to claim 1, further comprising a positioner defined by a first flat portion formed in the cover member, and a second flat portion formed in the spray member, the pipe being inserted into the cover member such that the second flat portion in the spray member is opposite to the first flat portion in the cover member.

18. The nozzle device according to claim 17, further comprising an annular sealing member for watertightly sealing an area between the spray member around the orifice and the cover member around the spray hole.

19. The nozzle device according to claim 16, wherein the positioner comprises:

a front end abutment portion provided on a front end of the spray member and abutting against the inner surface at the front end of the cover member.

20. The nozzle device according to claim 16, wherein the positioner comprises a peripheral surface abutment portion provided in the spray member and abutting against an inner peripheral surface of the cover member.

21. The nozzle device according to claim 16, wherein the positioner comprises an engagement portion provided at a rear end of the cover member, and a portion to be engaged, provided at a rear end of the pipe, with which the engagement portion is engaged.

* * * * *